US007258970B2

(12) United States Patent
Yoshioka et al.

(10) Patent No.: US 7,258,970 B2
(45) **Date of Patent: *Aug. 21, 2007**

(54) PHOTOTHERMOGRAPHIC MATERIAL

(75) Inventors: Yasuhiro Yoshioka, Kanagawa (JP); Takahiro Ishizuka, Kanagawa (JP); Terukazu Yanagi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/214,181

(22) Filed: Aug. 8, 2002

(65) Prior Publication Data

US 2003/0104327 A1 Jun. 5, 2003

(30) Foreign Application Priority Data

Aug. 9, 2001 (JP) ..... P. 2001-242357
Aug. 31, 2001 (JP) ..... P. 2001-264110
Mar. 18, 2002 (JP) ..... P.2002-074564

(51) Int. Cl.
*G03C 1/38* (2006.01)
*G03C 1/498* (2006.01)

(52) U.S. Cl. ..... 430/631; 430/264; 430/607; 430/610; 430/613; 430/614; 430/619

(58) Field of Classification Search ..... 430/619, 430/631, 607, 613, 614, 610, 264
See application file for complete search history.

(56) References Cited

U.S. PATENT DOCUMENTS

| | | | | |
|---|---|---|---|---|
| 4,347,308 | A * | 8/1982 | Takeuchi et al. | 430/529 |
| 4,968,599 | A * | 11/1990 | Pitt et al. | 430/631 |
| 5,677,121 | A * | 10/1997 | Tsuzuki | 430/619 |
| 6,821,721 | B2 * | 11/2004 | Yoshioka | 430/619 |
| 2002/0197571 | A1 * | 12/2002 | Yamanouchi et al. | 430/523 |

FOREIGN PATENT DOCUMENTS

| | | | |
|---|---|---|---|
| EP | 1 096 310 | A2 | 5/2001 |
| JP | 60-244945 | A | 12/1985 |
| JP | 9-26654 | A | 1/1997 |
| JP | 2002-214554 | A | 8/2000 |

OTHER PUBLICATIONS

European Search Report dated Nov. 28, 2002.

* cited by examiner

*Primary Examiner*—Thorl Chea
(74) *Attorney, Agent, or Firm*—Sughrue Mion, PLLC

(57) ABSTRACT

A photothermographic material of the present invention comprises: a support; a photosensitive silver halide; a non-photosensitive organic silver salt; a heat developer; a binder; and a fluorine compound containing a specific structure.

6 Claims, No Drawings

PHOTOTHERMOGRAPHIC MATERIAL

FIELD OF THE INVENTION

The present invention relates to a photothermographic material (a heat-developable photosensitive material).

BACKGROUND OF THE INVENTION

In recent years, reduction of amount of waste processing solutions is strongly desired in the medical field from the standpoint of environmental protection and space savings. Techniques relating to photosensitive heat-developable photographic materials for use in medical diagnosis and photomechanical processes are required which enable efficient exposure by a laser image setter or laser imager and formation of a clear black image having high resolution and sharpness. The photosensitive heat-developable photographic material can provide users with a simple and non-polluting heat development processing system that eliminates the use of solution-type processing chemicals.

Although the same is required also in the field of general image-forming materials, the image for medical diagnosis in particular must be finely drawn and therefore, high image quality with excellent sharpness and graininess is needed. Moreover, in view of diagnostic convenience, an image of cold black tone is preferred. At present, various hard copy systems using a pigment or a dye are commercially available as a general image-forming system, such as ink jet printer and electrophotography, however, these are not a satisfactory output system for the medical-use image.

On the other hand, thermal image forming systems using an organic silver salt are described, for example, in U.S. Pat. Nos. 3,152,904 and 3,457,075, B. Shely, *Thermally Processed Silver Systems*, and Sturge, V. Walworth and A. Shepp (compilers), *Imaging Processes and Materials,* 8th ed., page 2, Neblette (1996). In particular, heat-developable photosensitive materials generally have a photosensitive layer comprising a binder matrix having dispersed therein a catalytic amount of a photocatalyst (for example, silver halide), a reducing agent, a reducible silver salt (for example, organic silver salt) and if desired, a color toner for controlling the silver tone. The heat-developable photosensitive material after image exposure is heated at a high temperature (for example, 80° C. or more) to bring about an oxidation-reduction reaction between the silver halide or reducible silver salt (acting as an oxidizing agent) and the reducing agent and thereby form a black silver image. The oxidation-reduction reaction is accelerated by the catalytic action of a silver halide latent image generated upon exposure. Therefore, the black silver image is formed in the exposed area. This is disclosed in many publications including U.S. Pat. No. 2,910,377 and JP-B-43-4924 (the term "JP-B" as used herein means an "examined Japanese patent publication"). As a medical image forming system using a heat-developable photosensitive material, "FM-DP L" (Fuji Medical Dry Imager) is put on the market.

For the production of a thermal image forming system using an organic silver salt, a method of producing the system by coating a solvent, and a method of producing the system by coating and drying a coating solution containing, as a main binder, an aqueous dispersion of fine polymer particles are known. The latter method needs only a simple production equipment and is suited for mass production, because a step for collecting a solvent is unnecessary.

In either the coating method using a solvent or the aqueous coating method using mainly water as the solvent, the coating of a heat-developable photosensitive material is difficult as compared with conventional photosensitive materials using gelatin as a main binder. In particular, high-speed coating causes generation of streaks or unevenness. In order to improve the productivity and profitability, improvement is demanded in the coatability.

Furthermore, use of an aqueous latex as a binder has a problem in that on touching with a hand wetted with sweat or oil, a fingerprint attaches and this causes discoloration in aging.

SUMMARY OF THE INVENTION

Accordingly, a first object of the present invention is to improve the coating suitability of the coating solution of a photothermographic material and prevent the generation of steaks or unevenness.

A second object of the present invention is to provide a photothermographic material reduced in the staining which is generated on touching with a hand wetted with sweat or oil.

These objects of the present invention can be attained by the following heat-developable photosensitive materials.

(1) A photothermographic material (a first embodiment) comprising:

a support;

a photosensitive silver halide;

a non-photosensitive organic silver salt;

a heat developer;

a binder; and a fluorine compound represented by the following formula (A):

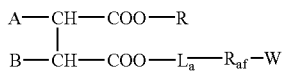

(A)

wherein R represents a substituted or unsubstituted alkyl group, $R_{af}$ represents a perfluoroalkylene group, W represents a hydrogen atom or a fluorine atom, $L_a$ represents a substituted or unsubstituted alkylene group, a substituted or unsubstituted alkyleneoxy group or a divalent group formed by combining these groups, one of A and B represents a hydrogen atom, the other represents $-L_b-SO_3M$, M represents a cation, and $L_b$ represents a single bond or a substituted or unsubstituted alkylene group.

(2) The photothermographic material as described in (1), wherein said heat developer is represented by the following formula (R):

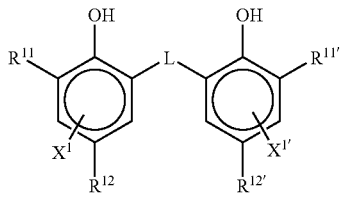

(R)

wherein $R^{11}$ and $R^{11'}$ each independently represents an alkyl group having from 1 to 20 carbon atoms, $R^{12}$ and $R^{12'}$ each independently represents a hydrogen atom or a substituent capable of substituting to the benzene ring, L represents a —S— group or a —$CHR^{13}$— group, $R^{13}$ represents a hydrogen atom or an alkyl group having from 1 to 20 carbon atoms, and $X^1$ and $X^{1'}$ each independently represents a hydrogen atom or a substituent capable of substituting to the benzene ring.

(3) The photothermographic material as described in (1), which comprises: an image-forming layer on the support; and a compound represented by formula (D) in the same surface side as the image-forming layer on the support:

(D)

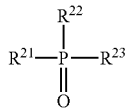

wherein $R^{21}$ to $R^{23}$ each independently represents an alkyl group, an aryl group, an alkoxy group, an aryloxy group, an amino group or a heterocyclic group, and these groups each may be unsubstituted or may have a substituent.

(4) The photothermographic material as described in (1), which comprises an image-forming layer on the support; and a compound represented by formula (H) in the same surface side as the image-forming layer on the support:

(H)

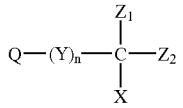

wherein Q represents an alkyl group, an aryl group or a heterocyclic group, Y represents a divalent linking group, n represents 0 or 1, $Z_1$ and $Z_2$ each represents a halogen atom, and X represents a hydrogen atom or an electron-withdrawing group.

(5) The photothermographic material as described in (2), which comprises a development accelerator having an effect of accelerating heat development on said heat developer represented by formula (R).

(6) The photothermographic material as described in (5), wherein said development accelerator is a hydrazine compound.

(7) The photothermographic material as described in (1), wherein said compound represented by formula (A) is a compound represented by the following formula (1):

(1)

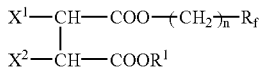

wherein $R^1$ represents a substituted or unsubstituted alkyl group having a total carbon atom number of 6 or more, provided that $R^1$ is not an alkyl group substituted by a fluorine atom, $R_f$ represents a perfluoroalkyl group having 6 or less carbon atoms, one of $X^1$ and $X^2$ represents a hydrogen atom, the other represents $SO_3M$, M represents a cation, and n represents an integer of 1 or more.

(8) The photothermographic material as described in (7), wherein in formula (1), $R_f$ is a perfluoroalkyl group having from 2 to 4 carbon atoms.

(9) A photothermographic material (a second embodiment) comprising:

a support;

a photosensitive silver halide;

a non-photosensitive organic silver salt;

a heat developer;

a binder; and a fluorine compound containing:

at least two fluorinated alkyl groups having 2 or more carbon atoms and 11 or less fluorine atoms; and at least one of an anionic hydrophilic group and a non-ionic hydrophilic group.

(10) The photothermographic material as described in (9), wherein said fluorine compound is a compound represented by the following formula (A-1):

(A-1)

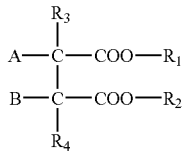

wherein $R_1$ and $R_2$ each represents a fluorinated alkyl group having 2 or more carbon atoms and 11 or less fluorine atoms, $R_3$ and $R_4$ each represents a hydrogen atom or an alkyl group, one of A and B represents a hydrogen atom, the other represents $-L_b-SO_3M_0$, $M_0$ represents a hydrogen atom or a cation, and $L_b$ represents a single bond or a substituted or unsubstituted alkylene group.

(11) The photothermographic material as described in (9), wherein said fluorine compound is a compound represented by the following formula (B):

(B)

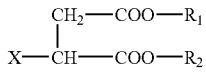

wherein $R_1$ and $R_2$ each represents a fluorinated alkyl group having 2 or more carbon atoms and 11 or less fluorine atoms, X represents $-L_b-SO_3M_0$, $M_0$ represents a hydrogen atom or a cation, and $L_b$ represents a single bond or a substituted or unsubstituted alkylene group.

(12) The photothermographic material as described in (11), wherein in said formula (B), $L_b$ is a single bond.

(13) The photothermographic material as described in (11), wherein in said formula (B), $L_b$ is a methylene group.

(14) The photothermographic material as described in (9), wherein said heat developer is represented by the following formula (R):

(R)

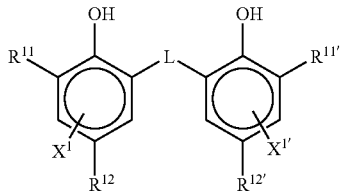

wherein $R^{11}$ and $R^{11'}$ each independently represents an alkylene group having from 1 to 20 carbon atoms, $R^{12}$ and $R^{12'}$ each independently represents a hydrogen atom or substituent capable of substituting to the benzene ring, L represents a —S— group or a —$CHR^{13}$— group, $R^{13}$ represents a hydrogen atom or an alkyl group having from 1 to 20 carbon atoms, and $X^1$ and $X^{1'}$ each independently represents a hydrogen atom or a group capable of substituting to the benzene ring.

(15) The photothermographic material as described in (9), which comprises: an image-forming layer on the support; and a compound represented by the following formula (D) in the same surface side as the image-forming layer on the support:

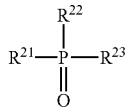

(D)

wherein $R^{21}$ to $R^{23}$ each independently represents an alkyl group, an aryl group, an alkoxy group, an aryloxy group, an amino group or a heterocyclic group, and these groups each may be unsubstituted or may have a substituent.

(16) The photothermographic material as described in (9), which comprises: an image-forming layer on the support; and a compound represented by the following formula (H) in the same surface side as the image-forming layer on the support:

$$Q\text{-}(Y)_n\text{—}C(Z_1)(Z_2)X \quad (H)$$

wherein Q represents an alkyl group, an aryl group or a heterocyclic group, Y represents a divalent linking group, n represents 0 or 1, $Z_1$ and $Z_2$ each represents a halogen group, and X represents a hydrogen atom or an electron-withdrawing group.

(17) The photothermographic material as described in (9), which comprises a development accelerator having an effect of accelerating development on said heat developer represented by formula (R).

(18) The photothermographic material as described in (17), wherein said development accelerator is a hydrazine compound.

DETAILED DESCRIPTION OF THE INVENTION

The present invention is described in detail below.

(Fluorine Compound)

The first embodiment of the present invention is characterized by the use of a fluorine compound represented by the following formula (A):

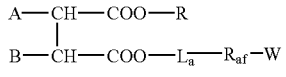

(A)

In formula (A), R represents a substituted or unsubstituted alkyl group. The substituted or unsubstituted alkyl group represented by R may be linear or branched or may have a cyclic structure.

The substituent may be any substituent but preferred examples thereof include an alkenyl group, an aryl group, an alkoxy group, a halogen atom (preferably Cl), a carboxylic acid ester group, a carbonamido group, a carbamoyl group, an oxycarbonyl group and a phosphoric acid ester group.

R is preferably an alkyl group having no fluorine as the substituent, more preferably an unsubstituted alkyl group. R preferably has a carbon number of 2 or more, more preferably 4 or more, still more preferably 6 or more.

$R_{af}$ represents a perfluoroalkylene group. The "perfluoroalkylene group" as used herein means a group where all hydrogen atoms of an alkylene group are replaced by fluorine. The perfluoroalkylene group may be linear or branched or may have a cyclic structure. $R_{af}$ preferably has a carbon number of 10 or less, more preferably 8 or less.

W represents a hydrogen atom or a fluorine atom but is preferably a fluorine atom.

$L_a$ represents a substituted or unsubstituted alkylene group, a substituted or unsubstituted alkyleneoxy group or a divalent group formed by combining these groups. The substituent is preferably a substituent described above for R. $L_a$ preferably has a carbon number of 4 or less and is preferably an unsubstituted alkylene group.

One of A and B represents a hydrogen atom and the other represents -$L_b$-$SO_3M$. M represents a cation.

Preferred examples of the cation represented by M include alkali metal ion (e.g., lithium ion, sodium ion, potassium ion), alkaline earth metal ion (e.g., barium ion, calcium ion) and ammonium ion.

Among these, more preferred are lithium ion, sodium ion, potassium ion and ammonium ion, still more preferred are lithium ion, sodium ion and potassium ion. The cation may be appropriately selected according to the total carbon number, substituent and branching degree of alkyl group, of the compound represented by formula (A).

In the case where the total of carbon numbers of R, $L_a$ and $R_{af}$ is 16 or more, lithium ion is preferred from the standpoint of attaining both the solubility (particularly in water) and the antistatic capability or coating uniformity.

$L_b$ represents a single bond or a substituted or unsubstituted alkylene group. The substituent is preferably a substituent described above for R. In the case where $L_b$ is an alkylene group, $L_b$ preferably has a C number of 2 or less and is preferably an unsubstituted alkylene group, more preferably a methylene group.

$L_b$ is most preferably a single bond.

In formula (A), it is more preferred to combine respective preferred embodiments described above. The compound of formula (A) is still more preferably represented by the following formula (1):

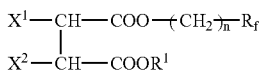

(1)

In formula (1), $R^1$ represents a substituted or unsubstituted alkyl group having a total carbon atom number of 6 or more, provided that $R^1$ is not an alkyl group substituted by a fluorine atom. The substituted or unsubstituted alkyl group represented by $R^1$ may be linear or branched or may have a cyclic structure.

Examples of the substituent include an alkenyl group, an aryl group, an alkoxy group, a halogen atom except for fluorine, a carboxylic acid ester group, a carbonamido group, a carbamoyl group, an oxycarbonyl group and a phosphoric acid ester group.

The substituted or unsubstituted alkyl group represented by $R^1$ preferably a total carbon number of 6 to 24. Preferred examples of the unsubstituted alkyl group having from 6 to 24 carbon atoms include an n-hexyl group, an n-heptyl group, an n-octyl group, a tert-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group, an eicosyl group, a 2-octyldodecyl group, a docosyl group, a tetracosyl group, a 2-decyltetradecyl group, a tricosyl group, a cyclohexyl group and a cycloheptyl group.

Preferred examples of the substituted alkyl group having a total carbon number of 6 to 24 including carbon atoms of the substituent include a 2-hexenyl group, an oleyl group, a linoleyl group, a linolenyl group, a benzyl group, a β-phenethyl group, a 2-methoxyethyl group, a 4-phenylbutyl group, a 4-acetoxyethyl group, a 6-phenoxyhexyl group, a 12-phenyldodecyl group, a 18-phenyloctadecyl group, a 12-(p-chlorophenyl)dodecyl group and a 2-(diphenyl phosphate) ethyl group.

The substituted or unsubstituted alkyl group represented by $R^1$ more preferably has a total carbon number of 6 to 18. Preferred examples of the unsubstituted alkyl group having from 6 to 18 carbon atoms include an n-hexyl group, a cyclohexyl group, an n-heptyl group, an n-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group and a 4-tert-butylcyclohexyl group.

Preferred examples of the substituted alkyl group having a total carbon number of 6 to 18 including carbon atoms of the substituent include a phenethyl group, a 6-phenoxyhexyl group, a 12-phenyldodecyl group, an oleyl group, a linoleyl group and an linolenyl group.

Among these, $R^1$ is more preferably an n-hexyl group, a cyclohexyl group, an n-heptyl group, an n-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group, an oleyl group, a linoleyl group or a linolenyl group, still more preferably a linear, cyclic or branched unsubstituted alkyl group having from 8 to 16 carbon atoms.

In formula (1), $R_f$ represents a perfluoroalkyl group having 6 or less carbon atoms.

The "perfluoroalkyl group" as used herein means a group where all hydrogen atoms of an alkyl group are replaced by fluorine. The alkyl group in the perfluoroalkyl group may be linear or branched or may have a cyclic structure.

Examples of the perfluoroalkyl group represented by $R_f$ include a trifluoromethyl group, a pentafluoroethyl group, a heptafluoro-n-propyl group, a heptafluoroisopropyl group, a nonafluoro-n-butyl group, a undecafluoro-n-pentyl group, a tridecafluoro-n-hexyl group and an undecafluorocyclohexyl group.

Among these, $R_f$ is preferably is a perfluoroalkyl group having from 2 to 4 carbon atoms (e.g., pentafluoroethyl, heptafluoro-n-propyl, heptafluoroisopropyl, nonafluoro-n-butyl), more preferably a heptafluoro-n-propyl group or a nonafluoro-n-butyl group.

In formula (1), n represents an integer of 1 or more, preferably an integer of 1 to 4, more preferably 1 or 2.

As for the combination of n and $R_f$, when n=1, $R_f$ is preferably a heptafluoro-n-propyl group or a nonafluoro-n-butyl group and when n=2, $R_f$ is preferably a nonafluoro-n-butyl group.

In formula (1), one of $X^1$ and $X^2$ represents a hydrogen atom and the other represents $SO_3M$. M represents a cation.

Preferred examples of the cation represented by M include alkali metal ion (e.g., lithium ion, sodium ion, potassium ion), alkaline earth metal ion (e.g., barium ion, calcium ion) and ammonium ion. Among these, preferred are lithium ion, sodium ion, potassium ion and ammonium ion.

Specific preferred examples of the fluorine compound represented by formula (A) are set forth below, however, the present invention is not limited by these specific examples.

In the following, for the sake of convenience, compounds where B is $SO_3M$ and A is a hydrogen atom are set forth, however, it is also possible that B is a hydrogen atom and A is $SO_3M$ in the following compounds, and these compounds are also included in specific examples of the fluorine compound of the present invention.

In the following structure denotations of compounds, unless otherwise indicated, the alkyl group and the perfluoroalkyl group mean an alkyl or perfluoroalkyl group having a linear structure. Also, in the structure denotations shown below, 2EH and 2BO stand for the following groups:

2EH: 2-ethylhexyl

2BO: 2-butyloctyl (FS-1)

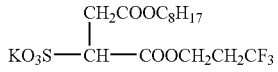

(FS-2)

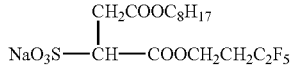

(FS-3)

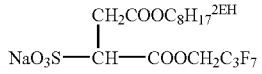

(FS-4)

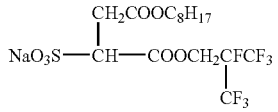

(FS-5)

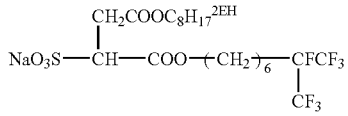

(FS-6)

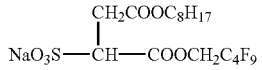

(FS-7)

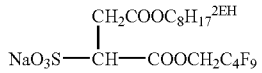

(FS-8)

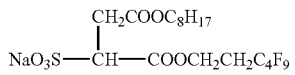

(FS-9)

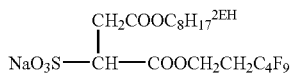

-continued (FS-10)

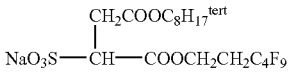

(FS-11)

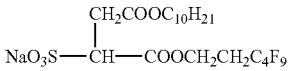

(FS-12)

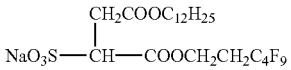

(FS-13)

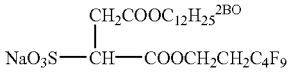

(FS-14)

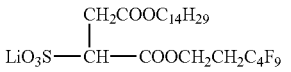

(FS-15)

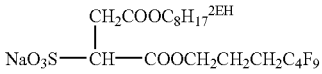

(FS-16)

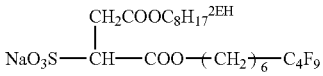

(FS-17)

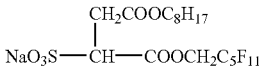

(FS-18)

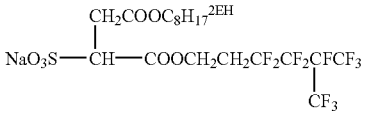

(FS-19)

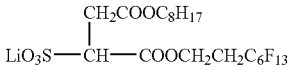

(FS-20)

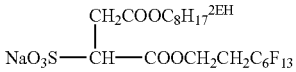

(FS-21)

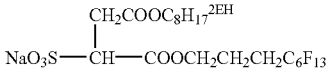

(FS-22)

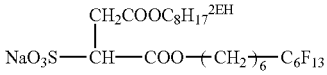

(FS-23)

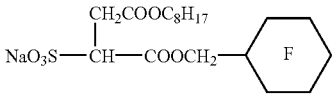

(FS-24)

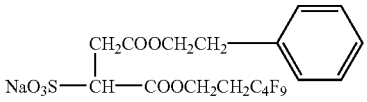

(FS-25)

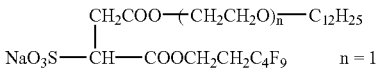

(FS-26)

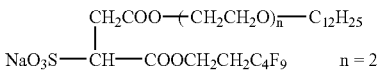

-continued (FS-27)

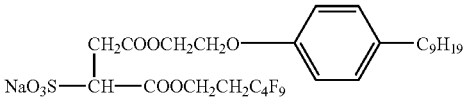

(FS-28)

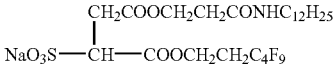

(FS-29)

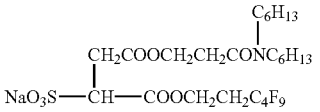

(FS-30)

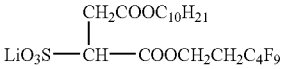

(FS-31)

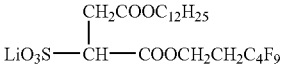

(FS-32)

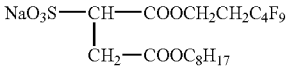

(FS-33)

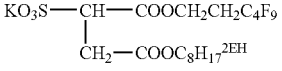

(FS-34)

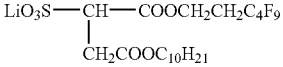

(FS-35)

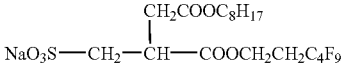

(FS-36)

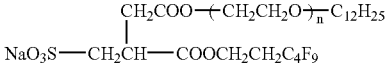

(FS-37)

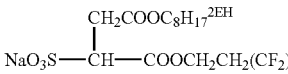

(FS-38)

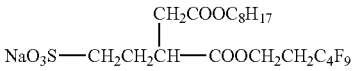

(FS-39)

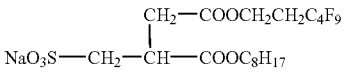

(FS-40)

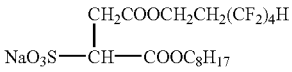

The fluorine compound represented by formula (A) can be easily synthesized by combining a general esterification reaction and a general sulfonation reaction.

The fluorine compound for use in the present invention is preferably used as a surfactant in the coating composition for forming a layer (particularly, a protective layer, an undercoat layer or a back layer) constituting a silver halide photographic photosensitive material. The fluorine compound is more preferably used for the formation of a hydrophilic colloid layer as an uppermost layer of a photographic photosensitive material, because effective antistatic property and uniformity of coating can be obtained.

The photosensitive material according to the second embodiment of the present invention comprises a fluorine compound containing two or more fluorinated alkyl groups having 2 or more carbon atoms and 11 or less fluorine atoms, and at least one of an anionic hydrophilic group and a nonionic hydrophilic group.

The fluorine compound for use in the present invention may have any structure insofar as it contains two or more fluorinated alkyl groups described above and at least either one of an anionic hydrophilic group and a nonionic hydrophilic group.

In the fluorinated alkyl group for use in the present invention, the fluorine atom number is 11 or less, preferably from 3 to 9, more preferably from 5 to 9. The carbon atom number is 2 or more, preferably from 4 to 16, more preferably from 5 to 12, still more preferably from 6 to 10.

The fluorinated alkyl group for use in the present invention is preferably a group represented by the following formula (1):

-La-Raf-W (1)

In formula (1), La represents a substituted or unsubstituted alkylene group, a substituted or unsubstituted alkyleneoxy group, or a divalent group formed by combining these groups. The substituent may be any group but preferred examples thereof include an alkenyl group, an aryl group, an alkoxy group, a halogen atom (preferably Cl), a carboxylic acid ester group, a carbonamido group, a carbamoyl group, an oxycarbonyl group and a phosphoric acid ester group.

La preferably has a carbon number of 8 or less, more preferably 4 or less, and is preferably an unsubstituted alkylene group. Raf represents a perfluoroalkylene group having from 1 to 5 carbon atoms and is preferably a perfluoroalkylene group having from 2 to 4 carbon atoms. The perfluoroalkylene group as used herein means an alkylene group where all hydrogen atoms of an alkylene group are replaced by fluorine. The perfluoroalkylene group may be linear or branched or may have a cyclic structure. W represents a hydrogen atom, a fluorine atom or an alkyl group and is preferably a hydrogen atom or a fluorine atom.

Raf is most preferably a perfluoroalkylene group having 4 carbon atoms. When the fluorine compound for use in the present invention is a mixture of compounds different in the carbon number of Raf, the compound where Raf has a carbon number of 4 (C4 form) preferably occupies a larger percentage.

The percentage of the C4 form in the mixture is preferably 20% or more, more preferably 50% or more, still more preferably 80% or more, particularly preferably 90% or more. The percentage of the component of C6 or more is preferably smaller because if the compound having $R_{af}$ of C6 or more is contained in a large percentage, the solubility in water decreases. Also, the percentage of the component of C3 or less is preferably smaller because if the component of C3 or less is contained, the effect of decreasing the static surface force becomes low as compared with the C4 form.

The anionic hydrophilic group means an acidic group having a pKa of 7 or less, or an alkali metal salt or ammonium salt thereof. Specific examples of the anionic hydrophilic group include a sulfo group, a carboxyl group, a phosphonic acid group, a carbamoylsulfamoyl group, a sulfamoylsulfamoyl group, an acylsulfamoyl group, and salts thereof. Among these, preferred are a sulfo group, a carboxyl group, a phosphonic acid group, and salts thereof, more preferred are a sulfo group and salts thereof.

Examples of the cation seed for forming salts include lithium, sodium, potassium, cesium, ammonium, tetramethylammonium, tetrabutylammonium and methylpyridinium. Among these, preferred are lithium, sodium, potassium and ammonium.

Examples of the nonionic hydrophilic group include a hydroxyl group and a polyalkyleneoxy group. Among these, a polyalkyleneoxy group is preferred.

A polyalkyleneoxy group and an anionic hydrophilic group described above may be simultaneously contained within the same molecule, and this is a preferred structure in the present invention. Also, a combination use of an anionic compound and a nonionic compound is effective and preferred.

Specific examples of the fluorinated alkyl group for use in the present invention include the following groups, however, the present invention is not limited thereto:

—$C_2F_5$ group, —$C_3F_7$ group, —$C_4F_9$ group, —$C_5F_{11}$ group, —$CH_2$—$C_4F_9$ group, —$C_4F_8$-H group, —$C_2H_4$—$C_4F_9$ group, —$C_4H_8$—$C_4F_9$ group, —$C_6H_{12}$—$C_4F_9$ group, —$C_8H_{16}$—$C_4F_9$ group, —$C_4H_8$—$C_2F_5$ group, —$C_4H_8$—$C_3F_7$ group, —$C_4H_8$—$C_5F_{11}$ group, —$C_8H_{16}$—$C_2F_5$ group, —$C_2H_4$—$C_4F_8$—H group, —$C_4H_8$—$C_4F_8$—H group, —$C_6H_{12}$—$C_4F_8$—H group, —$C_6H_{12}$—$C_2F_4$—H group, —$C_8H_{16}$—$C_2F_4$—H group, —$C_6H_{12}$—$C_4F_8$—$CH_3$ group, —$C_2H_4$—$C_3F_7$ group, —$C_2H_4$—$C_5F_{11}$ group, —$C_4H_8$—$CF(CF_3)_2$ group, —$CH_2CF_3$ group, —$C_4H_8$—$CH(C_2F_5)_2$ group, —$C_4H_8$-$CH(CF_3)_2$ group, —$C_4H_8$—$C(CF_3)_3$ group, —$CH_2(CF_2CF_2)_2H$ group and —$CH_2CF_2CF_2H$ group.

In the present invention, the fluorine compound is more preferably represented by the following formula (A-1):

(A-1)

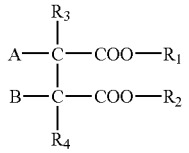

In formula (A-1), $R_1$ and $R_2$ each independently represents a fluorinated alkyl group having 2 or more carbon atoms and 11 or less fluorine atoms, and $R_3$ and $R_4$ each independently represents a hydrogen atom or a substituted or unsubstituted alkyl group.

Specific examples of the fluorinated alkyl group represented by $R_1$ and $R_2$ include the groups described above. Also, the preferred structure is similarly the structure represented by formula (1). Preferred structures among those structures are also the same as those described above for the fluorinated alkyl group.

The substituted or unsubstituted alkyl group represented by $R_3$ and $R_4$ may be linear or branched or may have a cyclic structure. The substituent may be any substituent but preferred examples thereof include an alkenyl group, an aryl group, an alkoxy group, a halogen atom (preferably Cl), a carboxylic acid ester group, a carbonamido group, a carbamoyl group, an oxycarbonyl group and a phosphoric acid ester group.

One of A and B represents a hydrogen atom and the other represents -$L_b$-$SO_3M_0$. $M_0$ represents a cation. Preferred examples of the cation represented by M include alkali metal ion (e.g., lithium ion, sodium ion, potassium ion), alkaline earth metal ion (e.g., barium ion, calcium ion) and ammonium ion. Among these, more preferred are lithium ion, sodium ion, potassium ion and ammonium ion, still more preferred are lithium ion, sodium ion and potassium ion. The cation may be appropriately selected according to the total carbon number, substituent and branching degree of alkyl group, of the compound represented by formula (A-1). In the case where the total of carbon numbers of $R^1$, $R^2$, $R^3$ and $R^4$ is 16 or more, lithium ion is preferred from the standpoint of attaining both the solubility (particularly in water) and the antistatic capability or coating uniformity.

$L_b$ represents a single bond or a substituted or unsubstituted alkylene group. The substituent is preferably a substituent described above for $R_3$. In the case where $L_b$ is an alkylene group, $L_b$ preferably has a C number of 2 or less and is preferably an unsubstituted alkylene group, more preferably a methylene group. $L_b$ is most preferably a methylene group or a single bond.

In formula (A-1), it is more preferred to combine respective preferred embodiments described above. The compound of formula (A-1) is still more preferably represented by the following formula (B):

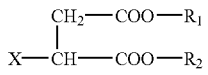

(B)

In formula (B), $R_1$ and $R_2$ each independently represents a fluorinated alkyl group represented by the following formula (1):

-La-Raf-W (1)

In formula (1), La represents a substituted or unsubstituted alkylene group, a substituted or unsubstituted alkyleneoxy group, or a divalent group formed by combining these groups. The substituent may be any group but preferred examples thereof include an alkenyl group, an aryl group, an alkoxy group, a halogen atom (preferably Cl), a carboxylic acid ester group, a carbonamido group, a carbamoyl group, an oxycarbonyl group and a phosphoric acid ester group.

La preferably has a carbon number of 8 or less, more preferably 4 or less, and is preferably an unsubstituted alkylene group. Raf represents a perfluoroalkylene group having from 1 to 5 carbon atoms and is preferably a perfluoroalkylene group having from 2 to 4 carbon atoms. The perfluoroalkylene group as used herein means an alkylene group where all hydrogen atoms of an alkylene group are replaced by fluorine. The perfluoroalkylene group may be linear or branched or may have a cyclic structure. W represents a hydrogen atom, a fluorine atom or an alkyl group and is preferably a hydrogen atom or a fluorine atom.

In formula (B), X represents $-Lb-SO_3M_0$, wherein Lb represents a methylene group or a single bond and $M_0$ represents a cation. Preferred examples of the cation represented by M include alkali metal ion (e.g., lithium ion, sodium ion, potassium ion), alkaline earth metal ion (e.g., barium ion, calcium ion) and ammonium ion. Among these, more preferred are lithium ion, sodium ion, potassium ion and ammonium ion.

Specific examples of the fluorine compound of the present invention are set forth below, however, the present invention is not limited to these specific examples.

In the following structure denotations of compounds, unless otherwise indicated, the alkyl group and the perfluoroalkyl group mean an alkyl or perfluoroalkyl group having a linear structure.

(FS-41)

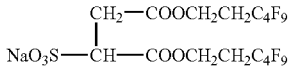

(FS-42)

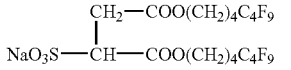

(FS-43)

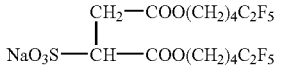

(FS-44)

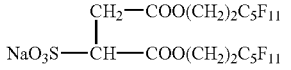

(FS-45)

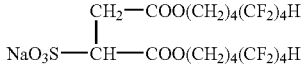

(FS-46)

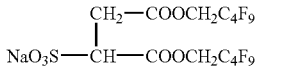

(FS-47)

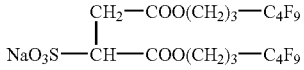

(FS-48)

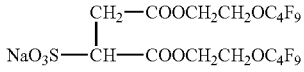

(FS-49)

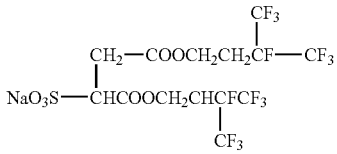

(FS-50)

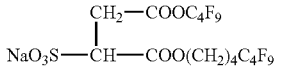

(FS-51)

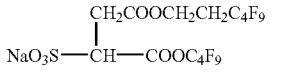

(FS-52)

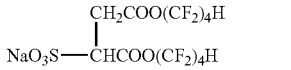

(FS-53)

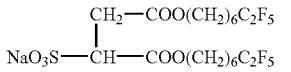

(FS-54)

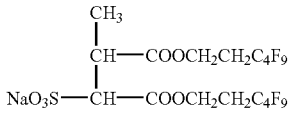

(FS-55)

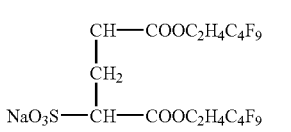

(FS-56)

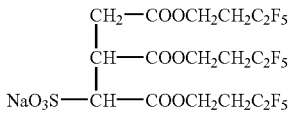

-continued
(FS-57)
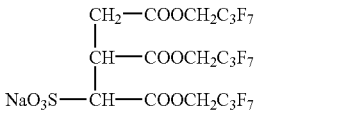
(FS-58)
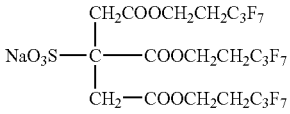
(FS-59)
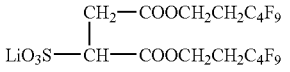
(FS-60)
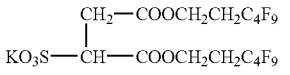
(FS-61)
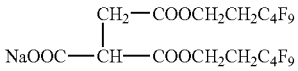
(FS-62)
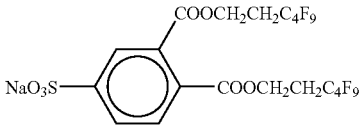
(FS-63)
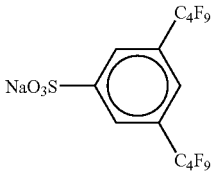
(FS-64)
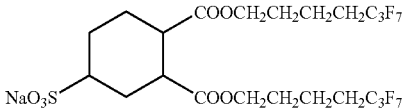
(FS-65)
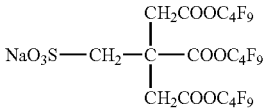
(FS-66)
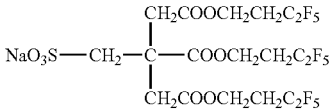
(FS-67)
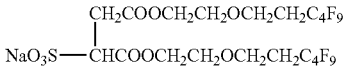
(FS-68)
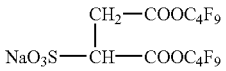
(FS-69)
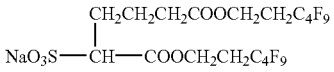
(FS-70)
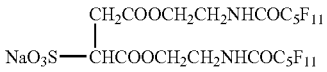
(FS-71)
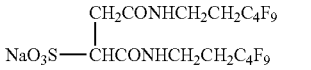
-continued
(FS-72)
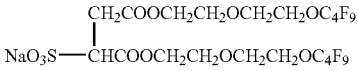
(FS-73)
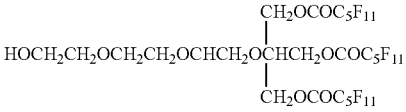
(FS-74)
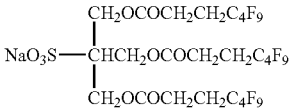
(FS-75)
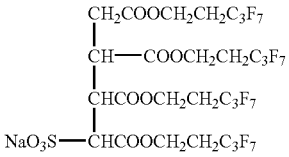
(FS-76)
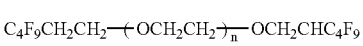
n = 5 ~ 10
(FS-77)
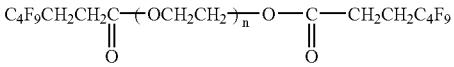
n = 5 ~ 10
(FS-78)
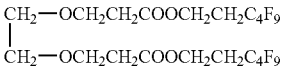
(FS-79)
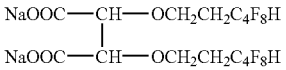
(FS-80)
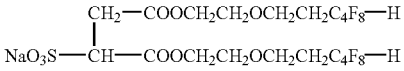
(FS-81)
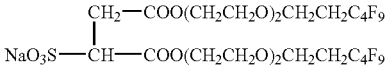
(FS-82)
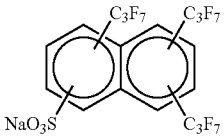
(FS-83)
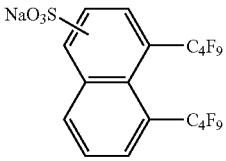
(FS-84)
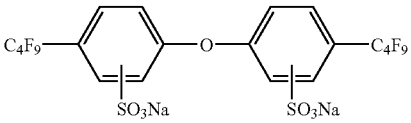

-continued (FS-85)

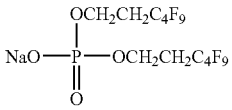

(FS-86)

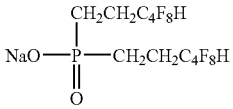

(FS-87)

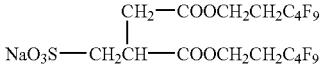

(FS-88)

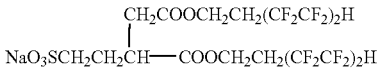

(FS-89)

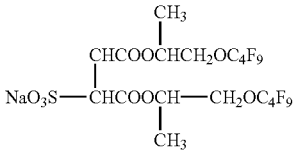

(FS-90)

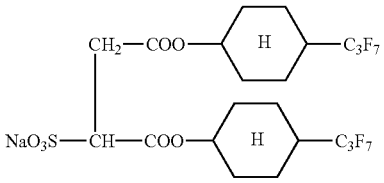

(FS-91)

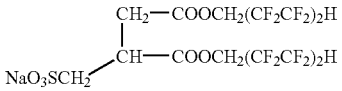

(FS-92)

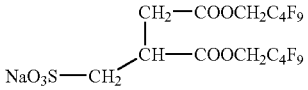

(FS-93)

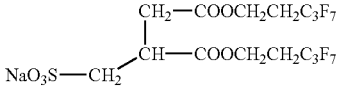

(FS-94)

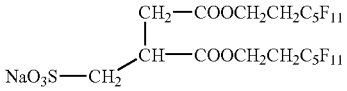

(FS-95)

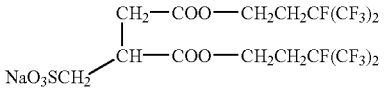

(FS-96)

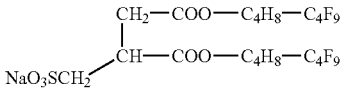

(FS-97)

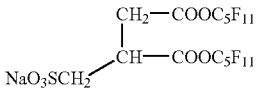

(FS-98)

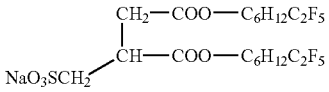

-continued (FS-99)

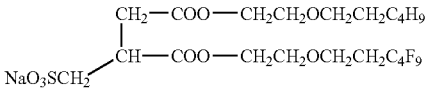

(FS-100)

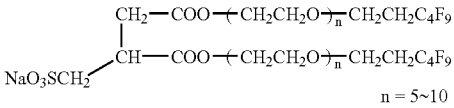

n = 5~10

(FS-101)

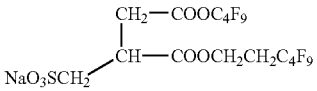

(FS-102)

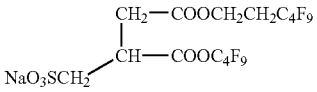

(FS-103)

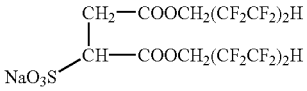

(FS-104)

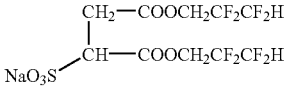

(FS-105)

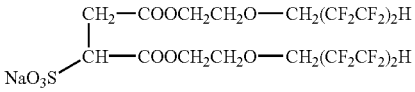

(FS-106)

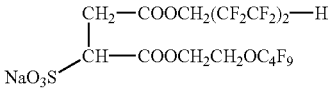

These fluorine compound can be easily synthesized by combining a general esterification reaction and a general sulfonation reaction.

The fluorine compound for use in the present invention is preferably used as a surfactant in the coating composition for forming a layer (particularly, a protective layer, an undercoat layer or a back layer) constituting a silver halide photographic photosensitive material. The fluorine compound is more preferably used for the formation of a non-photosensitive layer farthest from the support in either the same side as or the opposite side to an image-forming layer or in both sides, because effective antistatic property and uniformity of coating can be obtained. The coating composition containing the fluorine compound of the present invention as a surfactant is described below.

The aqueous coating composition containing the fluorine compound, which is used for the heat-developable photosensitive material of the present invention, contains the surfactant for use in the present invention and a medium in which the surfactant is dissolved and/or dispersed. In addition, the coating composition may appropriately contain other components according to the purpose. In the aqueous coating composition, the medium is preferably an aqueous medium. Examples of the aqueous medium include water and a mixed solvent of water and an organic solvent other than water (for example, methanol, ethanol, isopropyl alcohol, n-butanol, methyl cellosolve, dimethylformamide, acetone). The medium for the coating composition containing the fluorine compound preferably contains 50 wt % (% by weight) or more of water.

In the present invention, the fluorine compounds of the present invention may be used individually or in combination of two or more thereof. Other surfactant may also be used in combination with the fluorine compound of the present invention. The surfactant which can be used in combination include anionic surfactants, cationic surfactants and nonionic surfactants. Also, the surfactant which is used in combination may be a polymer surfactant or may be a fluorine-containing surfactant other than the surfactant of the present invention. The surfactant used in combination is preferably an anionic or nonionic surfactant. Examples of the surfactant which can be used in combination include surfactants described in JP-A-62-215272 (pp. 649-706), *Research Disclosure* (*RD*), Item 17643, pp. 26-27 (December, 1978), *ibid*., 18716, page 650 (November, 1979), and *ibid*., 307105, pp. 875-876 (November, 1989).

A polymer compound is a representative example of the other component which can be used in combination. The polymer compound may be a polymer soluble in an aqueous medium (hereinafter referred to as a "soluble polymer") or may be a dispersion of polymer (so-called polymer latex). The soluble polymer is not particularly limited but examples thereof include gelatin, polyvinyl alcohol, casein, agar, gum arabi, hydroxyethyl cellulose, methyl cellulose and carboxymethyl cellulose. Examples of the polymer latex include homopolymers and copolymers of various vinyl monomers [for example, acrylate derivatives, methacrylate derivatives, acrylamide derivatives, methacrylamide derivatives, styrene derivatives, conjugate diene derivatives, N-vinyl compounds, O-vinyl compounds, vinyl nitrites and other vinyl compounds (e.g., ethylene, vinylidene chloride)], and dispersions of condensed polymer (e.g., polyester, polyurethane, polycarbonate, polyamide). Specific examples of this polymer compound include polymer compounds described in JP-A-62-215272 (pp. 707-763), *Research Disclosure* (*RD*), Item 17643, page 651 (December, 1978), *ibid*., 18716, page 650 (November, 1979), and *ibid*., 307105, pp. 873-874 (November, 1989).

The aqueous coating composition containing the fluorine compound for use in the present invention may contain other various compounds according to the layer where the coating composition is used in the photosensitive material. Examples thereof include various couplers, ultraviolet absorbents, color mixing inhibitors, antistatic agents, scavengers, antifoggants, film hardening agents, dyestuffs and antifungals. As described above, the aqueous coating composition containing the fluorine compound is preferably used for the formation of a hydrophilic colloid layer as an uppermost layer of a photographic photosensitive material and in this case, the coating composition may contain, in addition to a hydrophilic colloid (for example, gelatin) and the fluorine compound, other surfactant, a matting agent, a slipping agent, a colloidal silica, a gelatin plasticizer and the like.

In the present invention, the amount of the fluorine compound used is not particularly limited and the amount used thereof can be freely determined according to the structure of the compound used, the site where the compound is used, the kind and amount of other materials contained in the composition, and the like. For example, in the case of using the fluorine compound in a coating solution for a hydrophilic colloid (gelatin) layer as an uppermost layer of a heat-developable photosensitive material, the concentration of the fluorine compound in the coating composition is preferably from 0.003 to 0.5 wt % and based on the gelatin solid content, preferably from 0.03 to 5 wt %.

(Description of Organic Silver Salt)

The organic silver salt which can be used in the present invention is relatively stable to light but forms a silver image when heated at 80° C. or more in the presence of an exposed photocatalyst (e.g., a latent image of photosensitive silver halide) and a reducing agent. The organic silver salt may be any organic substance containing a source capable of reducing silver ion. Such a non-photosensitive organic silver salt is described in JP-A-10-62899 (the term "JP-A" as used herein means an "unexamined published Japanese patent application") (paragraphs 0048 to 0049), EP-A-0803764 (page 18, line 24 to page 19, line 37), EP-A-0962812, JP-A-11-349591, JP-A-2000-7683 and JP-A-2000-72711. The organic silver salt is preferably a silver salt of an organic acid, particularly a silver salt of a long chain aliphatic carboxylic acid (having from 10 to 30 carbon atoms, preferably from 15 to 28 carbon atoms). Preferred examples of the silver salt of a fatty acid include silver behenate, silver arachidate, silver stearate, silver oleate, silver laurate, silver caproate, silver myristate, silver palmitate, and mixtures thereof. Of these fatty acid silver salts, preferred in the present invention are the fatty acid silver salts having a silver behenate content of 50 mol % or more, more preferably 80 mol % or more, still more preferably 90 mol % or more.

The shape of the organic silver salt which can be used in the present invention is not particularly limited, and the organic silver salt may have any shape of needle form, bar form, tabular form and scaly form.

In the present invention, the organic silver salt is preferably in the scaly form. Also, a short needle-like grain where the ratio of a long axis to a short axis is 5 or less, a rectangular parallelopiped grain, a cubic grain or a pebble-like amphoteric grain is preferably used. These organic silver salt grains have a characteristic feature that fogging upon heat development is reduced as compared with a long needle-like grain where the ratio of a long axis to a short axis is 5 or more. In the present invention, the scaly organic silver salt is defined as follows. Assuming that when an organic acid silver salt grain is observed through an electron microscope and the shape thereof is approximated to a rectangular parallelopiped, the sides of the rectangular parallelopiped are a, b and c (c may be equal to b) from the shortest side, x is calculated and determined according to the following formula using shorter values a and b:

$$x=b/a$$

In this manner, x of about 200 grains is determined and grains satisfying the relationship of an average value x (average)$\geqq$1.5 are defined as a scaly grain. The relationship is preferably 30$\geqq$x (average)$\geqq$1.5, more preferably 20$\geqq$x (average)$\geqq$2.0. Incidentally, the needle-like grain has a relationship of 1$\leqq$x (average)<1.5.

In the scaly grain, (a) can be regarded as the thickness of a tabular grain where the main planes are the face having sides (b) and (c). The average of (a) is preferably from 0.01 to 0.23 μm, more preferably from 0.1 to 0.20 μm. The average of c/b is preferably from 1 to 6, more preferably from 1.05 to 4, still more preferably from 1.1 to 3, particularly preferably from 1.1 to 2.

The grain size distribution of the organic silver salt is preferably monodisperse. The term "monodisperse" as used herein means that the percentage of the value obtained by dividing the standard deviation of the length of short axis or long axis by the length of short axis or long axis, respectively, is preferably 100% or less, more preferably 80% or less, still more preferably 50% or less. The shape of the organic silver salt can be determined from a transmission electron microscope image of an organic silver salt dispersion. Another method for determining the monodispersity is a method of determining the standard deviation of a volume weight average diameter of the organic silver salt. The percentage (coefficient of variation) of the value obtained by dividing the standard deviation by the volume weight average diameter is preferably 100% or less, more preferably 80% or less, still more preferably 50% or less. In the measurement of monodispersity, for example, laser light is irradiated on an organic silver salt dispersed in a solution, an autocorrelation function of fluctuation of scattered light with respect to the time change is determined and from the autocorrelation function obtained, the grain size (volume weight average diameter) can be determined.

As for the production of the organic silver salt used in the present invention and the dispersion method thereof, known methods can be employed. Examples thereof include the methods described in JP-A-10-62899, EP-A-0803763, EP-A-0962812, JP-A-11-349591, JP-A-2000-7683, JP-A-2000-72711, and Japanese Patent Application Nos. 11-348228 to 11-348230, 11-203413, 2000-90093, 2000-195621, 2000-191226, 2000-213813, 2000-214155 and 2000-191226.

If a photosensitive silver salt is present together on dispersion of the organic silver salt, fog increases and sensitivity seriously decreases. Therefore, it is preferred to contain substantially no photosensitive silver salt at the dispersion. In the present invention, the amount of the photosensitive silver salt dispersed in a water dispersion is preferably 1 mol % or less, more preferably 0.1 mol % or less, per mol of the organic silver salt in the solution. It is still more preferred that the photosensitive silver salt is not added positively.

In the present invention, a photosensitive material can be produced by mixing the organic silver salt water dispersion and the photosensitive silver salt water dispersion. The mixing ratio of the organic silver salt to the photosensitive silver salt can be selected according to the purpose, however, the ratio of the photosensitive silver salt to the organic silver salt is preferably from 1 to 30 mol %, more preferably from 2 to 20 mol %, still more preferably from 3 to 15 mol %. A method of mixing two or more organic silver salt water dispersions and two or more photosensitive silver salt water dispersions is preferably employed for controlling the photographic properties.

The organic silver salt for use in the present invention may be used in any desired amount, however, the amount in terms of silver is preferably from 0.1 to 5 g/m$^2$, more preferably from 0.3 to 3 g/m$^2$, still more preferably from 0.5 to 2.0 g/m$^2$.

(Description of Reducing Agent)

The heat-developable photosensitive material of the present invention preferably contains a heat developer which is a reducing agent for the organic silver salt. The reducing agent for the organic silver salt may be any substance (preferably an organic substance) capable of reducing silver ion into metal silver. Examples of this reducing agent include those described in JP-A-11-65021 (paragraph Nos. 0043 to 0045) and EP-A-0803764 (page 7, line 34 to page 18, line 12).

In the present invention, the reducing agent is preferably a so-called hindered phenol reducing agent or a bisphenol reducing agent, having a substituent at the ortho position of the phenolic hydroxyl group, more preferably a compound represented by the following formula (R):

(R)

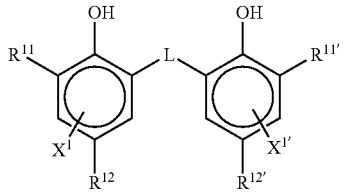

wherein $R^{11}$ and $R^{11'}$ each independently represents an alkyl group having from 1 to 20 carbon atoms, $R^{12}$ and $R^{12'}$ each independently represents a hydrogen atom or a substituent capable of substituting to the benzene ring, L represents a —S— group or a —CHR$^{13}$— group, $R^{13}$ represents a hydrogen atom or an alkyl group having from 1 to 20 carbon atoms, and $X^1$ and $X^{1'}$ each independently represents a hydrogen atom or a group capable of substituting to the benzene ring.

Formula (R) is described in detail. $R^{11}$ and $R^{11'}$ each independently represents a substituted or unsubstituted alkyl group having from 1 to 20 carbon atoms. The substituent of the alkyl group is not particularly limited but preferred examples thereof include an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group and a halogen atom.

$R^{12}$ and $R^{12'}$ each independently represents a hydrogen atom or a substituent capable of substituting to the benzene ring, and $X^1$ and $X^{1'}$ each independently represents a hydrogen atom or a group capable of substituting to the benzene ring. Preferred examples of the group capable of substituting to the benzene ring include an alkyl group, an aryl group, a halogen atom, an alkoxy group and an acylamino group.

L represents a —S— group or a —CHR$^{13}$— group. $R^{13}$ represents a hydrogen atom or an alkyl group having from 1 to 20 carbon atoms, and the alkyl group may have a substituent. Specific examples of the unsubstituted alkyl group represented by $R^{13}$ include a methyl group, an ethyl group, a propyl group, a butyl group, a heptyl group, a undecyl group, an isopropyl group, a 1-ethylpentyl group and a 2,4,4-trimethylpentyl group. Examples of the substituent of the alkyl group include those described above as the substituent for $R^{11}$.

$R^{11}$ and $R^{11'}$ each preferably represents a secondary or tertiary alkyl group having from 3 to 15 carbon atoms, and specific examples thereof include an isopropyl group, an isobutyl group, a tert-butyl group, a tert-amyl group, a tert-octyl group, a cyclohexyl group, a cyclopentyl group, 1-methylcyclohexyl group and a 1-methylcyclopropyl group. $R^{11}$ and $R^{11'}$ each is more preferably a tertiary alkyl group having from 4 to 12 carbon atoms, more preferably a tert-butyl group, a tert-amyl group or a 1-methylcyclohexyl group, most preferably a tert-butyl group.

$R^{12}$ and $R^{12'}$ each preferably represents an alkyl group having from 1 to 20 carbon atoms, and specific examples thereof include a methyl group, an ethyl group, a propyl group, a butyl group, an isopropyl group, a tert-butyl group, a tert-amyl group, a cyclohexyl group, a 1-methylcyclohexyl group, a benzyl group, a methoxymethyl group and a methoxyethyl group. Of these, more preferred are a methyl group, an ethyl group, a propyl group, an isopropyl group and a tert-butyl group.

$X^1$ and $X^{1'}$ are each preferably a hydrogen atom, a halogen atom or an alkyl group, more preferably a hydrogen atom.

L is preferably a —$CHR^{13}$— group.

$R^{13}$ is preferably a hydrogen atom or an alkyl group having from 1 to 15 carbon atoms. Preferred examples of the alkyl group include a methyl group, an ethyl group, a propyl group, an isopropyl group and a 2,4,4-trimethylpentyl group. $R^{13}$ is more preferably a hydrogen atom, a methyl group, an ethyl group, a propyl group or an isopropyl group.

When $R^{13}$ is a hydrogen atom, $R^{12}$ and $R^{12'}$ are each preferably an alkyl group having from 2 to 5 carbon atoms, more preferably an ethyl group or a propyl group, most preferably an ethyl group.

When $R^{13}$ is a primary or secondary alkyl group having from 1 to 8 carbon atoms, $R^{12}$ and $R^{12'}$ are each preferably a methyl group. The primary or secondary alkyl group having from 1 to 8 carbon atoms represented by $R^{13}$ is preferably a methyl group, an ethyl group, a propyl group or an isopropyl group, more preferably a methyl group, an ethyl group or a propyl group.

When $R^{11}$, $R^{11'}$, $R^{12}$ and $R^{12'}$ are all a methyl group, $R^{13}$ is preferably a secondary alkyl group. In this case, the secondary alkyl group represented by $R^{13}$ is preferably an isopropyl group, an isobutyl group or a 1-ethylpentyl group, more preferably an isopropyl group.

The above-described reducing agent differs in heat developability and developed silver color tone depending on what are used in combination as $R^{11}$, $R^{11'}$, $R^{12}$, $R^{12'}$ and $R^{13}$. These properties can be controlled by combining two or more reducing agents and therefore, the combination use of two or more reducing agents is preferred according to the purpose.

Specific examples of the reducing agent for use in the present invention including the compounds represented by formula (R) are set forth below, however, the present invention is not limited thereto.

(R-1)

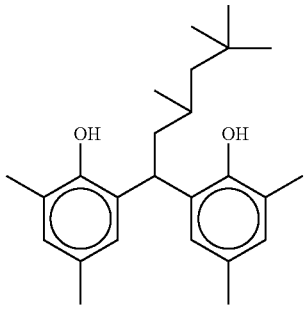

-continued (R-2)

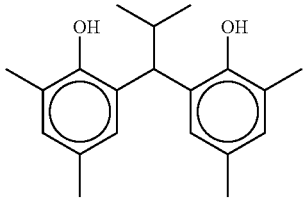

(R-3)

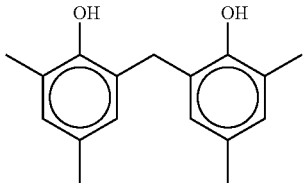

(R-4)

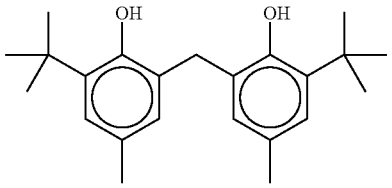

(R-5)

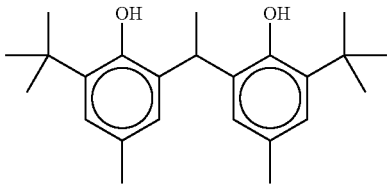

(R-6)

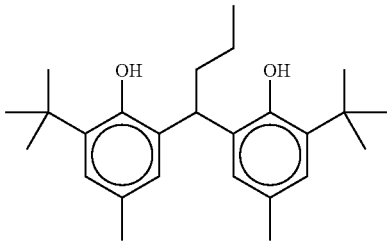

(R-7)

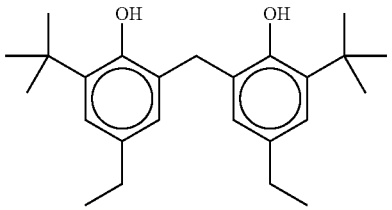

(R-8)

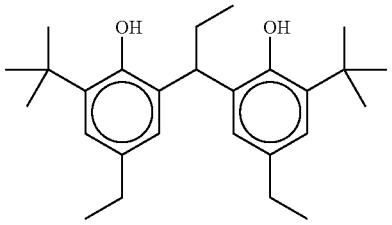

-continued
(R-9)
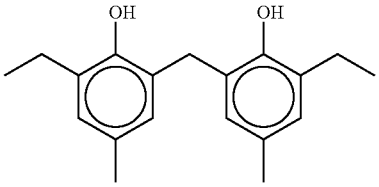
(R-10)
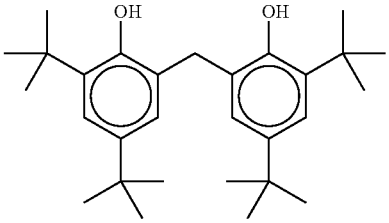
(R-11)
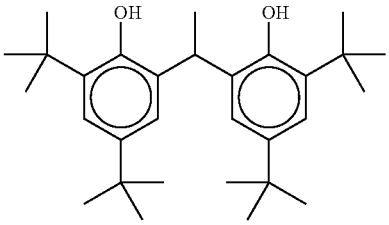
(R-12)
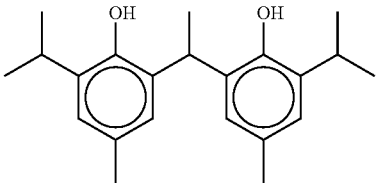
(R-13)
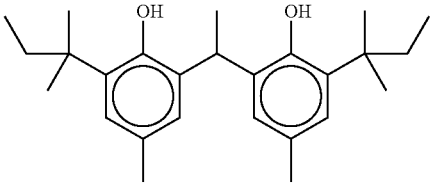
(R-14)
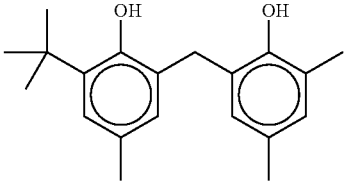
(R-15)
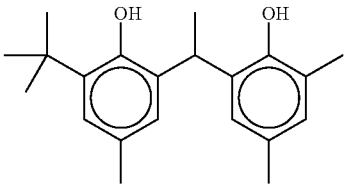
-continued
(R-16)
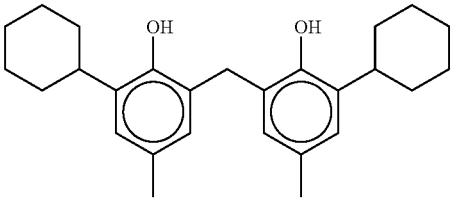
(R-17)
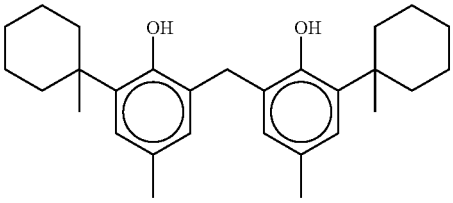
(R-18)
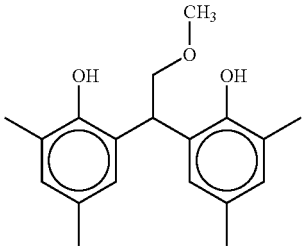
(R-19)
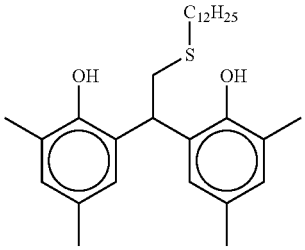
(R-20)
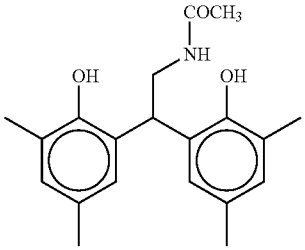
(R-21)
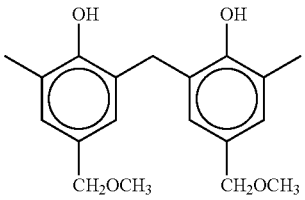
(R-22)
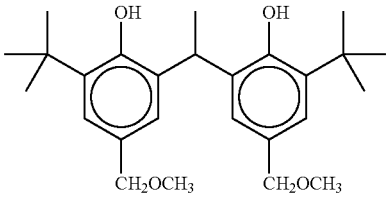

-continued (R-23)

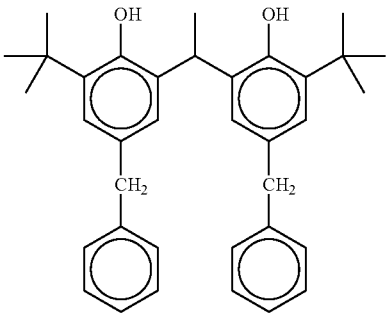

(R-24)

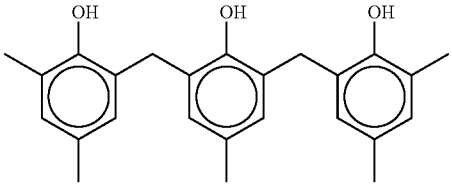

(R-25)

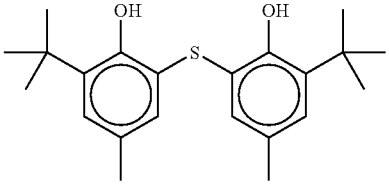

(R-26)

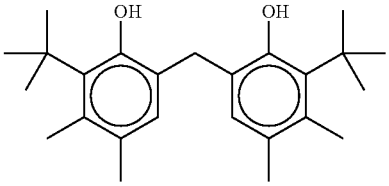

(R-27)

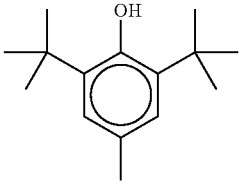

(R-28)

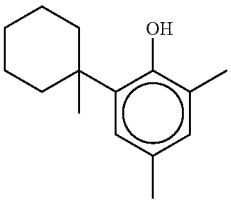

(R-29)

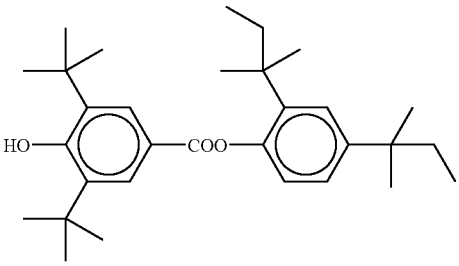

-continued (R-30)

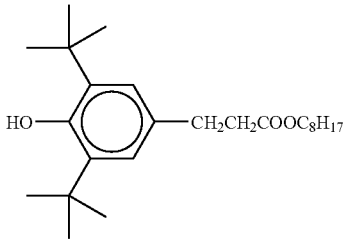

(R-31)

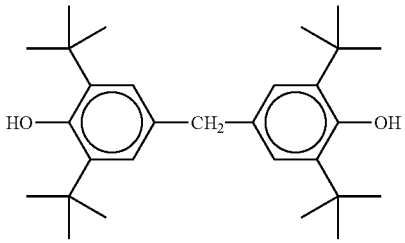

(R-32)

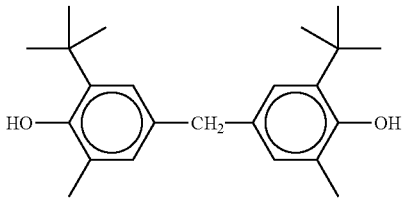

(R-33)

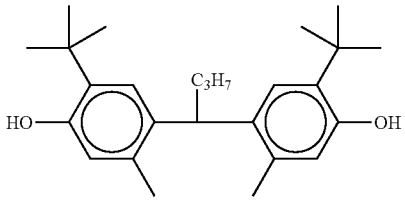

(R-34)

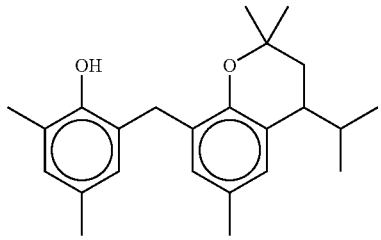

In the present invention, the amount of the reducing agent added is preferably from 0.1 to 3.0 g/m$^2$, more preferably from 0.2 to 1.5 g/m$^2$, still more preferably from 0.3 to 1.0 g/m$^2$. The reducing agent is preferably contained in an amount of 5 to 50 mol %, more preferably 8 to 30 mol %, still more preferably 10 to 20 mol %, per mol of silver on the surface having an image-forming layer. The reducing agent is preferably incorporated into an image-forming layer.

In adding the reducing agent to a coating solution and thereby incorporating it into the photosensitive material, the reducing agent may be added in any form, for example, in the form of a solution, an emulsified dispersion or a solid fine grain dispersion.

Well-known examples of the emulsification dispersion method include a method of dissolving the reducing agent using an oil such as dibutyl phthalate, tricresyl phosphate, glyceryl triacetate or diethyl phthalate, or an auxiliary solvent such as ethyl acetate or cyclohexanone, and mechanically forming an emulsified dispersion.

Examples of the solid fine grain dispersion method include a method of dispersing the reducing agent in the powder form in an appropriate solvent such as water using a ball mill, a colloid mill, a vibrating ball mill, a sand mill, a jet mill, a roller mill or an ultrasonic wave, thereby preparing a solid dispersion. At this time, a protective colloid (e.g., polyvinyl alcohol) or a surfactant (for example, an anionic surfactant such as sodium triisopropylnaphthalenesulfonate (a mixture of three substances different in the substitution position of an isopropyl group)) may be used. In the above-described mills, beads such as zirconia are commonly used as a dispersion medium and Zr dissolved out from these beads may be mixed in the dispersion. The content thereof is usually from 1 to 1,000 ppm, though this varies depending on the dispersing conditions. It is not a problem in practice if the content of Zr in the photosensitive material is 0.5 mg or less per g of silver.

In the water dispersion, an antiseptic (e.g., benzoisothiazolinone sodium salt) is preferably added.

(Description of Development Accelerator)

In the heat-developable photosensitive material of the present invention, a development accelerator is used and as the development accelerator, a sulfonamide phenol-base compound represented by formula (A) of JP-A-2000-267222 and JP-A-2000-330234, a hindered phenol-base compound represented by formula (II) of JP-A-2001-92075, a hydrazine-base compound represented by formula (I) of JP-A-10-62895 and JP-A-11-15116, or formula (1) of Japanese Patent Application No. 2001-074278, or a phenol-base or naphthol-base compound represented by formula (2) of Japanese Patent Application No. 2000-76240 is preferably used. The development accelerator for use in the present invention is more preferably a hydrazine compound.

The development accelerator is used in the range from 0.1 to 20 mol %, preferably from 0.5 to 10 mol %, more preferably from 1 to 5 mol %, based on the reducing agent. The development accelerator may be introduced into the photosensitive material using the same methods as described above for the reducing agent but is preferably added as a solid dispersion or emulsified dispersion. In the case of addition as an emulsified dispersion, the development accelerator is preferably added as an emulsified dispersion obtained using a low boiling point auxiliary solvent and a high boiling point solvent which is a solid at an ordinary temperature, or as a so-called oil-less emulsified dispersion using no high boiling point solvent.

(Description of Hydrogen Bond-Forming Compound)

In the case where the reducing agent for use in the present invention has an aromatic hydroxyl group (—OH), particularly, in the case of a bisphenol described above, a non-reducing compound having a group capable of forming a hydrogen bond with the hydroxyl group or amino group is preferably used in combination. Examples of the group capable of forming a hydrogen bond with the hydroxyl group or amino group include a phosphoryl group, a sulfoxide group, a sulfonyl group, a carbonyl group, an amide group, an ester group, a urethane group, a ureido group, a tertiary amino group and a nitrogen-containing aromatic group. Of these, preferred are the compounds having a phosphoryl group, a sulfoxide group, an amide group (provided that it does not have a >N—H group but is blocked like >N—Ra (wherein Ra is a substituent except for H)), a urethane group (provided that it does not have a >N—H group but is blocked like >N—Ra (wherein Ra is a substituent except for H)) or a ureido group (provided that it does not have a >N—H group but is blocked like >N—Ra (wherein Ra is a substituent except for H)).

In the present invention, the hydrogen bond-forming compound is particularly preferably a compound represented by the following formula (D):

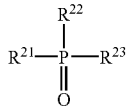

(D)

In formula (D), $R^{21}$ to $R^{23}$ each independently represents an alkyl group, an aryl group, an alkoxy group, an aryloxy group, an amino group or a heterocyclic group, and these groups each may be unsubstituted or may have a substituent. When $R^{21}$ to $R^{23}$ each have a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group and a phosphoryl group. The substituent is preferably an alkyl group or an aryl group and examples thereof include a methyl group, an ethyl group, an isopropyl group, a tert-butyl group, a tert-octyl group, a phenyl group, a 4-alkoxyphenyl group and a 4-acyloxyphenyl group.

Specific examples of the alkyl group represented by each of $R^{21}$ to $R^{23}$ include a methyl group, an ethyl group, a butyl group, an octyl group, a dodecyl group, an isopropyl group, a tert-butyl group, a tert-amyl group, a tert-octyl group, a cyclohexyl group, a 1-methylcyclohexyl group, a benzyl group, a phenethyl group and a 2-phenoxypropyl group. Examples of the aryl group include a phenyl group, a cresyl group, a xylyl group, a naphthyl group, a 4-tert-butylphenyl group, a 4-tert-octylphenyl group, a 4-anisidyl group and a 3,5-dichlorophenyl group. Examples of the alkoxy group include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group and a benzyloxy group. Examples of the aryloxy group include a phenoxy group, a cresyloxy group, an isopropylphenoxy group, a 4-tert-butylphenoxy group, a naphthoxy group and a biphenyloxy group. Examples of the amino group include a dimethylamino group, a diethylamino group, a dibutylamino group, a dioctylamino group, an N-methyl-N-hexylamino group, a dicyclohexylamino group, a diphenylamino group and an N-methyl-N-phenylamino group.

$R^{21}$ to $R^{23}$ each is preferably an alkyl group, an aryl group, an alkoxy group or an aryloxy group. In view of the effect of the present invention, at least one of $R^{21}$ to $R^{23}$ is preferably an alkyl group or an aryl group and more preferably, two or more thereof are an alkyl group or an aryl group. In view of the availability at a low cost, it is preferred that $R^{21}$ to $R^{23}$ all are the same group.

Specific examples of the hydrogen bond-forming compound including the compound represented by formula (D) for use in the present invention are set forth below, however, the present invention is not limited thereto.

(D-1)
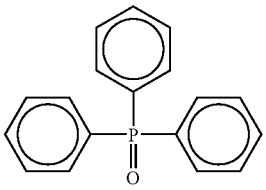
(D-2)
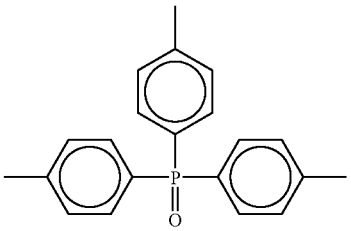
(D-3)
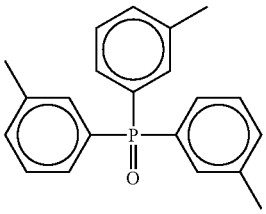
(D-4)
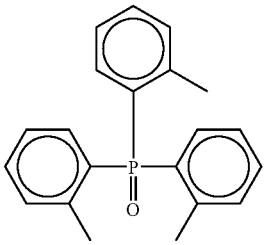
(D-5)
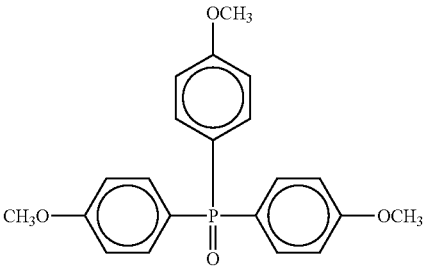
(D-6)
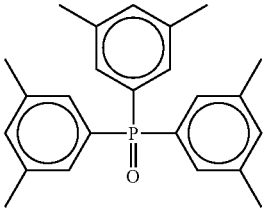
-continued
(D-7)
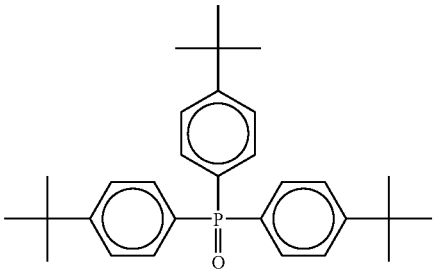
(D-8)
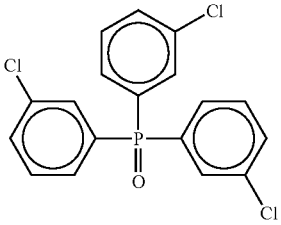
(D-9)
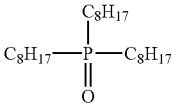
(D-10)
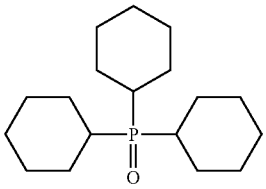
(D-11)
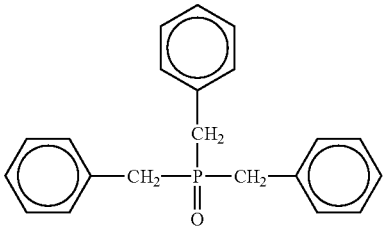
(D-12)
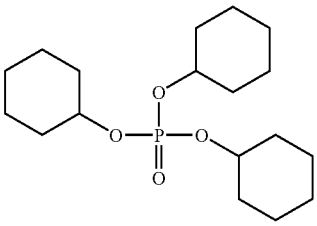
(D-13)
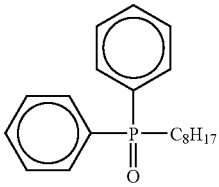

-continued (D-14)

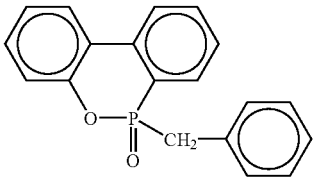

(D-15)

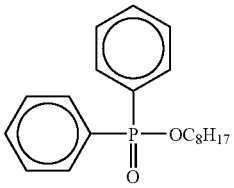

(D-16)

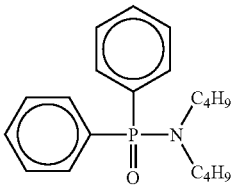

(D-17)

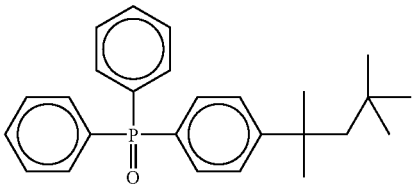

(D-18)

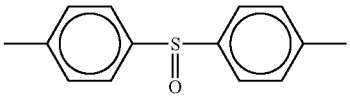

(D-19)

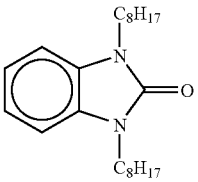

(D-20)

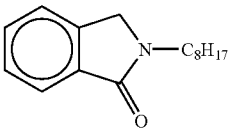

(D-21)

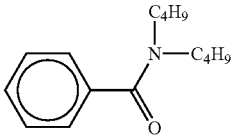

In addition to these compounds, specific examples of the hydrogen bond-forming compound include those described in European Patent No. 1096310 and Japanese Patent Application Nos. 2000-270498 and 2001-124796.

The compound represented by formula (D) for use in the present invention is added to a coating solution and thereby used in the photosensitive material and in this case, the compound can be added, similarly to the reducing agent, in the form of a solution, an emulsified dispersion or a solid fine grain dispersion. In the solution state, this compound forms a hydrogen bond-forming complex with a compound having a phenolic hydroxyl group or an amino group and depending on the combination of the reducing agent and the compound represented by formula (D), the complex can be isolated in the crystal state. Use of the thus-isolated crystal powder as a solid fine grain dispersion is particularly preferred for attaining stable performance. Also, a method of mixing the reducing agent with the compound represented by formula (D) each in the powder form and dispersing the resulting mixture in a sand grinder mill by using an appropriate dispersant, thereby forming a complex, can be preferably used.

The compound of the formula (D) for use in the present invention is preferably used in the range from 1 to 200 mol %, more preferably from 10 to 150 mol %, still more preferably from 20 to 100 mol %, based on the reducing agent.

(Description of Silver Halide)

The photosensitive silver halide for use in the present invention is not particularly limited on the halogen composition and silver chloride, silver chlorobromide, silver bromide, silver iodobromide, silver iodochlorobromide or silver iodide may be used. Among these, silver bromide and silver iodobromide are preferred. The halogen composition distribution within the grain may be uniform or the halogen composition may be stepwise or continuously changed. A silver halide grain having a core/shell structure may also be preferably used. With respect to the structure, the core/shell grain preferably has from 2 to 5-ply structure, more preferably from 2 to 4-ply structure. Furthermore, a technique of localizing silver bromide or silver iodide on the silver chloride, silver bromide or silver chlorobromide grain surface may also be preferably used.

The method for forming a photosensitive silver halide is well known in the art and, for example, the methods described in *Research Disclosure*, No. 17029 (June, 1978) and U.S. Pat. No. 3,700,458 may be used. Specifically, a method of adding a silver-supplying compound and a halogen-supplying compound to gelatin or other polymer solution to prepare a photosensitive silver halide and mixing the silver halide with an organic silver salt is used. In addition, the methods described in JP-A-11-119374 (paragraph Nos. 0217 to 0224), JP-A-11-98708 and JP-A-2000-347335 are also preferably used.

The size of photosensitive silver halide grain is preferably small for the purpose of suppressing occurrence of white turbidity after the image formation. Specifically, the grain size is preferably 0.20 μm or less, more preferably from 0.01 to 0.15 μm, still more preferably from 0.02 to 0.12 μm. The grain size as used herein means a diameter of a circle image having the same area as the projected area of a silver halide grain (in the case of a tabular grain, the projected area of a main plane).

Examples of the shape of a silver halide grain include cubic form, octahedral form, tabular form, spherical form, bar form and pebble-like form. In the present invention, a cubic grain is particularly preferred. A silver halide grain having rounded corners can also be preferably used. Although the face index (Miller indices) of the outer surface of a photosensitive silver halide grain is not particularly limited, [100] faces capable of giving a high spectral sensitization efficiency upon adsorption of a spectral sensitizing dye preferably occupy a high percentage. The percentage is preferably 50% or more, more preferably 65% or more, still more preferably 80% or more. The percentage of [100] faces according to the Miller indices can be determined by the method described in T. Tani, *J. Imaging Sci.,* 29, 165 (1985) utilizing the adsorption dependency of [111] face and [100] face when a sensitizing dye is adsorbed.

In the present invention, a silver halide grain having allowed a hexacyano metal complex to be present on the outermost surface thereof is preferred. Examples of the hexacyano metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$. $[Cr(CN)_6]^{3-}$ and $[Re(CN)_6]^{3-}$. In the present invention, hexacyano Fe complexes are preferred.

The hexacyano metal complex is present in the form of ion in an aqueous solution and therefore, the counter cation is not important but a cation easily miscible with water and suitable for the precipitation operation of a silver halide emulsion is preferably used. Examples thereof include alkali metal ions such as sodium ion, potassium ion, rubidium ion, cesium ion and lithium ion, ammonium ions, and alkylammonium ions (e.g., tetramethylammonium ion, tetraethylammonium ion, tetrapropylammonium ion, tetra(n-butyl)ammonium ion).

The hexacyano metal complex can be added after mixing it with water, a mixed solvent of water and an appropriate organic solvent miscible with water (for example, an alcohol, an ether, a glycol, a ketone, an ester or an amide), or gelatin.

The amount of the hexacyano metal complex added is preferably from $1\times10^{-5}$ to $1\times10^{-2}$ mol, more preferably from $1\times10^{-4}$ to $1\times10^{-3}$ mol, per mol of silver.

For allowing the hexacyano metal complex to exist on the outermost surface of a silver halide grain, the hexacyano metal complex is directly added after the completion of addition of an aqueous silver nitrate solution used for the grain formation but before the starting of chemical sensitization step of performing chalcogen sensitization such as sulfur sensitization, selenium sensitization and tellurium sensitization or noble metal sensitization such as gold sensitization, for example, before the completion of charging step, during the water washing step, during the dispersion step, or before the chemical sensitization step. In order to prevent growth of silver halide fine grains, the hexacyano metal complex is preferably added without delay after the grain formation and is preferably added before the completion of charging step.

The addition of hexacyano metal complex may be started after silver nitrate added for the grain formation is added to consume 96 wt %, preferably 98 wt %, more preferably 99 wt %, of the total amount.

When the hexacyano metal complex is added after the addition of an aqueous silver nitrate solution immediately before the completion of grain formation, the hexacyano metal complex can adsorb to the outermost surface of a silver halide grain and most of the complexes adsorbed form a sparingly-soluble salt with silver ion on the grain surface. This silver salt of hexacyanoferrate(II) is a salt more sparingly soluble than AgI and therefore, the fine grains can be prevented from re-dissolving, making it possible to produce silver halide fine grains having a small grain size.

The photosensitive silver halide grain for use in the present invention contains a metal of Group VIII to Group X in the Periodic Table (showing Group I to Group XVIII) or a metal complex thereof. The metal of Group VIII to Group X of the Periodic Table or the center metal of metal complex is preferably rhodium, ruthenium or iridium. These metal complexes may be used individually, or two or more complexes of the same or different metals may be used in combination. The metal or metal complex content is preferably from $1\times10^{-9}$ to $1\times10^{-3}$ mol per mol of silver. These heavy metals and metal complexes and the addition methods therefor are described in JP-A-7-225449, JP-A-11-65021 (paragraph Nos. 0018 to 0024) and JP-A-11-119374 (paragraph Nos. 0227 to 0240).

Furthermore, metal atoms (for example, $[Fe(CN)_6]^{4-}$) which can be contained in the silver halide grain for use in the present invention, and the methods for desalting and chemical sensitization of a silver halide emulsion are described in JP-A-11-84574 (paragraph Nos. 0046 to 0050), JP-A-11-65021 (paragraph Nos. 0025 to 0031) and JP-A-11-119374 (paragraph Nos. 0242 to 0250).

For the gelatin contained in the photosensitive silver halide emulsion for use in the present invention, various gelatins can be used. In order to maintain good dispersion state of the photosensitive silver halide emulsion in the organic silver salt-containing coating solution, a low molecular weight gelatin having a molecular weight of 500 to 60,000 is preferably used. This low molecular weight gelatin may be used either during the grain formation or at the dispersion after desalting but is preferably used at the dispersion after desalting.

As for the sensitizing dye which can be used in the present invention, a sensitizing dye capable of spectrally sensitizing a silver halide grain in the desired wavelength region when adsorbed to the silver halide grain and having a spectral sensitivity suitable for the spectral characteristics of exposure light source can be advantageously selected. Examples of the sensitizing dye and the addition method therefor include compounds described in JP-A-11-65021 (paragraph Nos. 0103 to 0109), compounds represented by formula (II) of JP-A-10-186572, dyes represented by formula (I) and described in paragraph No. 0106 of JP-A-11-119374, dyes described in U.S. Pat. Nos. 5,510,236 and 3,871,887 (Example 5), dyes disclosed in JP-A-2-96131 and JP-A-59-48753, and those described in EP-A-0803764 (page 19, line 38 to page 20, line 35) and Japanese Patent Application Nos. 2000-86865, 2000-102560 and 2000-205399. These sensitizing dyes may be used individually or in combination of two or more thereof. In the present invention, the sensitizing dye is preferably added to the silver halide emulsion in the time period after desalting until the coating, more preferably after desalting until initiation of chemical ripening.

In the present invention, the amount of the sensitizing dye added may be appropriately selected according to the performance such as sensitivity or fogging but is preferably from $10^{-6}$ to 1 mol, more preferably from $10^{-4}$ to $10^{-1}$ mol, per mol of silver halide in the photosensitive layer.

In the present invention, a supersensitizer may be used for improving the spectral sensitization efficiency. Examples of the supersensitizer for use in the present invention include the compounds described in EP-A-587338, U.S. Pat. Nos. 3,877,943 and 4,873,184, JP-A-5-341432, JP-A-11-109547 and JP-A-10-111543.

The photosensitive silver halide grain for use in the present invention is preferably subjected to chemical sensitization by sulfur sensitization, selenium sensitization or tellurium sensitization. As for the compound which is preferably used in the sulfur sensitization, selenium sensitization or tellurium sensitization, known compounds can be used, for example, compounds described in JP-A-7-128768 can be used. In the present invention, tellurium sensitization is particularly preferred and compounds described in JP-A-11-65021 (paragraph No. 0030) and compounds represented by formulae (II), (III) and (IV) of JP-A-5-313284 are more preferred.

In the present invention, the chemical sensitization may be performed at any stage after the grain formation but before the coating and, for example, can be performed, after desalting, (1) before spectral sensitization, (2) simultaneously with spectral sensitization, (3) after spectral sensitization or (4) immediately before coating. The chemical sensitization is particularly preferably performed after spectral sensitization.

The amount used of the sulfur, selenium or tellurium sensitizer for use in the present invention varies depending on the silver halide grain used, chemical ripening conditions and the like but is from $10^{-8}$ to $10^{-2}$ mol, preferably on the order from $10^{-7}$ to $10^{-3}$ mol, per mol of silver halide. In the present invention, the conditions for chemical sensitization is not particularly limited but the pH is from 5 to 8, the pAg is from 6 to 11 and the temperature is approximately from 40 to 95° C.

In the silver halide emulsion for use in the present invention, a thiosulfonic acid compound may be added by the method described in EP-A-293917.

In the photosensitive material for use in the present invention, only one photosensitive silver halide emulsion may be used or two or more emulsions (different, for example, in the average grain size, the halogen composition, the crystal habit or the chemical sensitization conditions) may be used in combination. By using a plurality of photosensitive silver halide emulsions different in the sensitivity, gradation can be controlled. Examples of the technique thereon include those described in JP-A-57-119341, JP-A-53-106125, JP-A-47-3929, JP-A-48-55730, JP-A-46-5187, JP-A-50-73627 and JP-A-57-150841. The difference in sensitivity between respective emulsions is preferably 0.2logE or more.

The amount of the photosensitive silver halide added is, in terms of the coated silver amount per $m^2$ of the photosensitive material, preferably from 0.03 to 0.6 $g/m^2$, more preferably from 0.07 to 0.4 $g/m^2$, most preferably from 0.05 to 0.3 $g/m^2$. The amount of the photosensitive silver halide added per mol of the organic silver salt is preferably from 0.01 to 0.5 mol, more preferably from 0.02 to 0.3 mol, still more preferably from 0.03 to 0.2 mol.

The method for and the conditions in the mixing of separately prepared photosensitive silver halide and organic silver salt are not particularly limited insofar as the effect of the present invention is satisfactorily brought out but a method of mixing silver halide grains and organic silver salt each after the completion of preparation by a high-speed agitator or in a ball mill, a sand mill, a colloid mill, a vibration mill, a homogenizer or the like, or a method of completing the preparation of an organic silver salt by mixing a photosensitive silver halide of which preparation is completed, at any timing during the preparation of organic silver salt may be used. For controlling the photographic property, it is preferred to mix two or more water dispersions of organic silver salt with two or more water dispersions of photosensitive silver salt.

In the present invention, the timing of adding silver halide to a coating solution for the image-forming layer is preferably from 180 minutes before coating to immediately before coating, preferably from 60 minutes to 10 seconds before coating, however, the mixing method and the mixing conditions are not particularly limited insofar as the effect of the present invention can be satisfactorily brought out. Specific examples of the mixing method include a method of mixing the silver halide with the solution in a tank designed to give a desired average residence time which is calculated from the addition flow rate and the liquid transfer amount to the coater, and a method using a static mixer described in N. Harnby, M. F. Edwards and A. W. Nienow (translated by Koji Takahashi), *Ekitai Kongo Gijutsu* (*Liquid Mixing Technique*), Chap. 8, Nikkan Kogyo Shinbun Sha (1989).

(Description of Binder)

In the present invention, the binder used for the organic silver salt-containing layer may be any polymer and the suitable binder is transparent or translucent and generally colorless. Examples thereof include natural resins, polymers and copolymers; synthetic resins, polymers and copolymers; and film-forming mediums such as gelatins, rubbers, poly (vinyl alcohols), hydroxyethyl celluloses, cellulose acetates, cellulose acetate butyrates, poly(vinyl pyrrolidones), casein, starch, poly(acrylic acids), poly(methyl methacrylates), poly (vinyl chlorides), poly(methacrylic acids), styrene-maleic anhydride copolymers, styrene-acrylonitrile copolymers, styrene-butadiene copolymers, poly(vinyl acetals) (e.g., poly(vinyl formal), poly(vinyl butyral)), poly(esters), poly (urethanes), phenoxy resin, poly(vinylidene chlorides), poly (epoxides), poly(carbonates), poly(vinyl acetates), poly(olefins), cellulose esters and poly(amides). The binder may also be coated and formed from water, an organic solvent or an emulsion.

In the present invention, the binder which can be used in combination in the organic silver salt-containing layer preferably has a glass transition temperature of 10 to 80° C. (hereinafter sometimes called a "high Tg binder"), more preferably from 15 to 70° C., still more preferably from 20 to 65° C.

In the present specification, the Tg is calculated by the following formula:

$$1/Tg=\Sigma(Xi/Tgi)$$

wherein assuming that the polymer is resultant of the copolymerization of n monomer components from i=1 to i=n, Xi is the weight fraction ($\Sigma Xi=1$) of the i-th monomer and Tgi is the glass transition temperature (absolute temperature) of a homopolymer of the i-th monomer, provided that $\Sigma$ is the sum of i=1 to i=n. Incidentally, for the glass transition temperature (Tgi) of a homopolymer of each monomer, the values described in J. Brandrup and E. H. Immergut, *Polymer Handbook,* 3rd ed., Wiley-Interscience (1989) are employed.

If desired, two or more binders may be used in combination. Also, a binder having a glass transition temperature of 20° C. or more and a binder having a glass transition temperature of less than 20° C. may be used in combination. When two or more polymers different in Tg are blended, the weight average Tg thereof preferably falls within the above-described range.

In the present invention, the organic silver salt-containing layer is preferably formed by coating and drying a coating solution where 30 wt % or more of the solvent is water.

In the present invention, the performance is enhanced when the organic silver salt-containing layer is formed by coating and drying a coating solution where 30 wt % or more of the solvent is water, and furthermore when the binder of the organic silver salt-containing layer is soluble or dispersible in an aqueous solvent (water solvent), particularly when the binder is composed of a polymer latex having an equilibrium moisture content of 2 wt % or less at 25° C. and 60% RH. In a most preferred form, the binder is prepared to have an ion conductivity of 2.5 mS/cm or less. Examples of the method for such preparation include a method of synthesizing a polymer and then purifying it using a membrane having a separating function.

The term "an aqueous solvent" in which the above-described polymer is soluble or dispersible means water or a mixture of water and 70 wt % or less of a water-miscible organic solvent. Examples of the water-miscible organic solvent include alcohol-base solvents such as methyl alcohol, ethyl alcohol and propyl alcohol, cellosolve-base solvents such as methyl cellosolve, ethyl cellosolve and butyl cellosolve, ethyl acetate, and dimethylformamide.

The term "aqueous solvent" is used here also for a system where the polymer is not thermodynamically dissolved but is present in a so-called dispersed state.

The term "equilibrium moisture content at 25° C. and 60% RH" can be expressed as follows using the weight W1 of a polymer in the humidity equilibration in an atmosphere of 25° C. and 60% RH and the weight W0 of a polymer in the bone dry state at 25° C.:

Equilibrium moisture content at 25° C. and 60%

$$RH=[(W1-W0)/W0]\times 100\ (wt\%)$$

With respect to the definition and the measuring method of moisture content, for example, *Kobunshi Kogaku Koza* 14, *Kobunshi Zairyo Shiken Hou* (*Lecture* 14 *of Polymer Engineering, Polymer Material Testing Method*), compiled by Kobunshi Gakkai, Chijin Shokan, may be referred to.

In the present invention, the equilibrium moisture content at 25° C. and 60% RH of the binder polymer is preferably 2 wt % or less, more preferably from 0.01 to 1.5 wt %, still more preferably from 0.02 to 1 wt %.

In the present invention, a polymer dispersible in an aqueous solvent is particularly preferred. Examples of the dispersed state include a case where fine particles of a water-insoluble hydrophobic polymer are dispersed in the form of latex, and a case where polymer molecules are dispersed in the molecular state or by forming micelles. Either case is preferred but the case where particles are dispersed in the latex form is more preferred. The average particle size of the dispersed particles is from 1 to 50,000 nm, preferably from 5 to 1,000 nm, more preferably from 10 to 500 nm, still more preferably from 50 to 200 nm. The particle size distribution of the dispersed particles is not particularly limited and the dispersed particles may have either a wide particle size distribution or a monodisperse particle size distribution. A method of using a mixture of two or more dispersed particles having a monodisperse particle size distribution is also preferred in controlling the physical properties of the coating solution.

In the present invention, a preferred embodiment of the polymer dispersible in an aqueous solvent is a hydrophobic polymer such as acrylic polymers, poly(esters), rubbers (e.g., SBR resin), poly(urethanes), poly(vinyl chlorides), poly(vinyl acetates), poly(vinylidene chlorides) and poly (olefins). These polymers may be a linear, branched or crosslinked polymer and also may be a homopolymer obtained by the polymerization of a single monomer or a copolymer obtained by the polymerization of two or more monomers. In the case of a copolymer, the copolymer may be a random copolymer or a block copolymer. The molecular weight of this polymer is, in terms of the number average molecular weight, from 5,000 to 1,000,000, preferably from 10,000 to 200,000. If the molecular weight is too small, the emulsion layer formed is insufficient in the mechanical strength, whereas if the molecular weight is excessively large, the film forming property is poor. The molecular weight outside the above-described range is therefore not preferred. A crosslinkable polymer latex is particularly preferred.

(Specific Examples of Latex)

Specific preferred examples of the polymer latex are set forth below. In the following, the polymer latex is expressed using starting material monomers. The numerical value in the parentheses is the unit of wt % and the molecular weight is a number average molecular weight. In the case where a polyfunctional monomer is used, since a crosslinked structure is formed and the concept of molecular weight cannot be applied, the term "cross-linkable" is shown and the molecular weight is omitted. "Tg" indicates a glass transition temperature.

P-1: latex of -MMA(70)-EA(27)-MAA(3)- (molecular weight: 37,000, Tg: 61° C.)

P-2: latex of -MMA(70)-2EHA(20)-St(5)-AA(5)- (molecular weight: 40,000, Tg: 59° C.)

P-3: latex of -St(50)-Bu(47)-MAA(3)- (crosslinkable, Tg: −17° C.)

P-4: latex of -St(68)-Bu(29)-AA(3)- (crosslinkable, Tg: 17° C.)

P-5: latex of -St(71)-Bu(26)-AA(3)- (crosslinkable, Tg: 24° C.)

P-6: latex of -St(70)-Bu(27)-IA(3)- (crosslinkable)

P-7: latex of -St(75)-Bu(24)-AA(1)- (crosslinkable, Tg: 29° C.)

P-8: latex of -St(60)-Bu(35)-DVB(3)-MAA(2)- (crosslinkable)

P-9: latex of -St(70)-Bu(25)-DVB(2)-AA(3)- (crosslinkable)

P-10: latex of -VC(50)-MMA(20)-EA(20)-AN(5)-AA(5)- (molecular weight: 80,000)

P-11: latex of -VDC(85)-MMA(5)-EA(5)-MAA(5)- (molecular weight: 67,000)

P-12: latex of -Et(90)-MAA(10)- (molecular weight: 12,000)

P-13: latex of -St(70)-2EHA(27)-AA(3) (molecular weight: 130,000, Tg: 43° C.)

P-14: latex of -MMA(63)-EA(35)-AA(2) (molecular weight: 33,000, Tg: 47° C.)

P-15: latex of -St(70.5)-Bu(26.5)-AA(3)- (crosslinkable, Tg: 23° C.)

P-16: latex of -St(69.5)-Bu(27.5)-AA(3)- (crosslinkable, Tg: 20.5° C.)

The abbreviations in the above-described structures indicate the following monomers: MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, and IA: itaconic acid.

These polymer latexes are commercially available and the following polymers may be used. Examples of the acrylic polymer include "Sebian A-4635, 4718 and 4601" (produced by Daicel Chemical Industries, Ltd.) and "Nipol Lx811, 814, 821, 820 and 857" (produced by Nippon Zeon K. K.); examples of the poly(esters) include "FINETEX ES650, 611, 675 and 850" (produced by Dai-Nippon Ink & Chemicals, Inc.), and "WD-size" and "WMS" (produced by Eastman Chemical Products, Inc.); examples of the poly (urethanes) include "HYDRAN AP10, 20, 30 and 40" (produced by Dai-Nippon Ink & Chemicals, Inc.); examples of the rubbers include "LACSTAR 7310K, 3307B, 4700H and 7132C" (produced by Dai-Nippon Ink & Chemicals, Inc.), "Nipol Lx416, 410, 438C and 2507" (produced by Nippon Zeon K. K.); examples of the poly(vinyl chlorides) include "G351 and G576" (produced by Nippon Zeon K. K.); examples of the poly(vinylidene chlorides) include "L502 and L513" (produced by Asahi Chemical Industry Co., Ltd.); and examples of the poly(olefins) include "Chemipearl S120 and SA100" (produced by Mitsui Petrochemical Industries, Ltd.).

These polymer latexes may be used individually or, if desired, as a blend of two or more thereof.

(Preferred Latex)

The polymer latex for use in the present invention is particularly preferably a latex of styrene-butadiene copolymer. In the styrene-butadiene copolymer, a weight ratio of the styrene monomer unit to the butadiene monomer unit is preferably from 40:60 to 95:5. Furthermore, the styrene monomer unit and the butadiene monomer unit preferably account for 60 to 99 wt % of the copolymer. The polymer latex for use in the invention preferably contains acrylic acid or methacrylic acid in an amount of 1 to 6 wt %, more preferably 2 to 5 wt %, based on the sum of styrene and butadiene. The polymer latex for use in the invention preferably contains acrylic acid.

Examples of the styrene-butadiene copolymer latex which is preferably used in the present invention include the above-described latexes P-3 to P-8 and P-15 and commercially available products LACSTAR-3307B, 7132C and Nipol Lx416.

The organic silver salt-containing layer of the photosensitive material of the present invention may contain, if desired, a hydrophilic polymer such as gelatin, polyvinyl alcohol, methyl cellulose, hydroxypropyl cellulose or carboxymethyl cellulose. The amount of the hydrophilic polymer added is preferably 30 wt % or less, more preferably 20 wt % or less, based on the entire binder in the organic silver salt-containing layer.

In the present invention, the organic silver salt-containing layer (namely, image-forming layer) is preferably formed using a polymer latex. The amount of the binder in the organic silver salt-containing layer is, in terms of a weight ratio of entire binder/organic silver salt, from 1/10 to 10/1, preferably from 1/3 to 5/1, more preferably from 1/1 to 3/1.

This organic silver salt-containing layer usually serves also as a photosensitive layer (emulsion layer) containing a photosensitive silver halide which is a photosensitive silver salt. In this case, the weight ratio of entire binder/silver halide is from 400 to 5, preferably from 200 to 10.

In the present invention, the total binder amount of the image-forming layer is preferably from 0.2 to 30 g/m$^2$, more preferably from 1 to 15 g/m$^2$, still more preferably from 2 to 10 g/m$^2$. The image-forming layer for use in the present invention may contain a crosslinking agent for forming a crosslinked structure or a surfactant for improving the coatability.

(Preferred Solvent for Coating Solution)

In the present invention, the solvent (here, for the sake of simplicity, the solvent and the dispersion medium are collectively called a solvent) in the coating solution for the organic silver salt-containing layer of the photosensitive material is preferably an aqueous solvent containing 30 wt % or more of water. As for the component other than water, an optional water-miscible organic solvent may be used, such as methyl alcohol, ethyl alcohol, isopropyl alcohol, methyl cellosolve, ethyl cellosolve, dimethylformamide and ethyl acetate. The solvent of the coating solution preferably has a water content of 50 wt % or more, more preferably 70 wt % or more. Examples of preferred solvent compositions include, in addition to water, water/methyl alcohol=90/10, water/methyl alcohol=70/30, water/methyl alcohol/dimethylformamide=80/15/5, water/methyl alcohol/ethyl cellosolve=85/10/5 and water/methyl alcohol/isopropyl alcohol=85/10/5 (the numerals are wt %).

(Description of Antifoggant)

Examples of the antifoggant, stabilizer and stabilizer precursor which can be used in the present invention include those described in JP-A-10-62899-62899 (paragraph No. 0070) and EP-A-0803764 (page 20, line 57 to page 21, line 7), and compounds described in JP-A-9-281637, JP-A-9-329864, U.S. Pat. No. 6,083,681, and European Patent 1048975. The antifoggant preferably used in the present invention is an organic halide and examples thereof include those disclosed in the patents cited in JP-A-11-65021 (paragraph Nos. 0111 to 0112). In particular, organic halogen compounds represented by formula (P) of JP-A-2000-284399, organic polyhalogen compounds represented by formula (II) of JP-A-10-339934, and organic polyhalogen compounds described in JP-A-2001-31644 and JP-A-2001-33911 are preferred.

(Description of Polyhalogen Compound)

The organic polyhalogen compound preferably used in the present invention is specifically described below. The polyhalogen compound preferred in the present invention is a compound represented by the following formula (H):

$$Q\text{-}(Y)_n\text{—}C(Z_1)(Z_2)X \qquad (H)$$

wherein Q represents an alkyl group, an aryl group or a heterocyclic group, Y represents a divalent linking group, n represents 0 or 1, $Z_1$ and $Z_2$ each represents a halogen atom and X represents a hydrogen atom or an electron-withdrawing group.

In formula (H), Q preferably represents a phenyl group substituted by an electron-withdrawing group having a Hammett substituent constant σp of a positive value. The Hammett substituent constant is described, for example, in *Journal of Medicinal Chemistry*, Vol. 16, No. 11, 1207-1216 (1973). Examples of this electron-withdrawing group include halogen atoms (e.g., fluorine (σp: 0.06), chlorine (σp: 0.23), bromine (σp: 0.23), iodine (σp: 0.18)), trihalomethyl groups (e.g., tribromomethyl (σp: 0.29), trichloromethyl (σp: 0.33), trifluoromethyl (σp: 0.54)), a cyano group (σp: 0.66), a nitro group (σp: 0.78), aliphatic.aryl or heterocyclic sulfonyl groups (e.g., methanesulfonyl (σp: 0.72)), aliphatic.aryl or heterocyclic acyl groups (e.g., acetyl (σp: 0.50), benzoyl (σp: 0.43)), alkynyl groups (e.g., C≡CH (σp: 0.23)), aliphatic.aryl or heterocyclic oxycarbonyl groups (e.g., methoxycarbonyl (σp: 0.45), phenoxycarbonyl (σp: 0.44)), a carbamoyl group (σp: 0.36), a sulfamoyl group (σp: 0.57), a sulfoxide group, a heterocyclic group and a phosphoryl group. The σp value is preferably from 0.2 to 2.0, more preferably from 0.4 to 1.0. Among these electron-withdrawing groups, preferred are a carbamoyl group, an alkoxycarbonyl group, an alkylsulfonyl group and an alkylphosphoryl group, and most preferred is a carbamoyl group.

X is preferably an electron-withdrawing group, more preferably a halogen atom, an aliphatic.aryl or heterocyclic sulfonyl group, an aliphatic.aryl or heterocyclic acyl group, an aliphatic.aryl or heterocyclic oxycarbonyl group, a carbamoyl group or a sulfamoyl group, still more preferably a halogen atom. Among the halogen atoms, preferred are chlorine, bromine and iodine, more preferred are chlorine and bromine, and still more preferred is bromine.

Y preferably represents —C(=O)—, —SO— or —$SO_2$—, more preferably —C(=O)— or —$SO_2$—, still more preferably —$SO_2$—. n represents 0 or 1, preferably 1.

Specific examples of the compound represented by formula (H) for use in the present invention are set forth below.

(H-1)
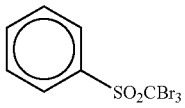
(H-2)
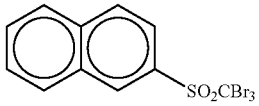
(H-3)
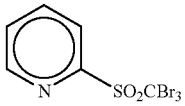
(H-4)
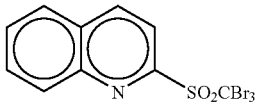
(H-5)
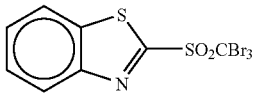
(H-6)
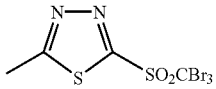
(H-7)
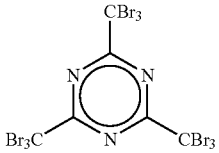
(H-8)
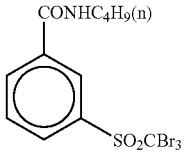
(H-9)
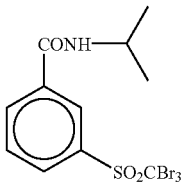
(H-10)
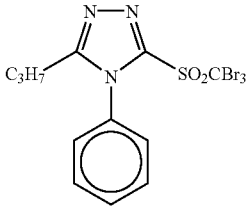
-continued
(H-11)
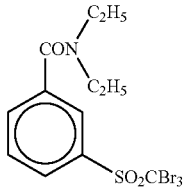
(H-12)
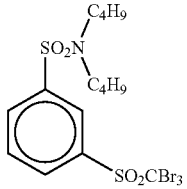
(H-13)
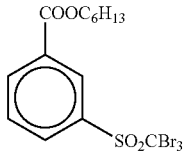
(H-14)
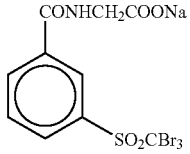
(H-15)
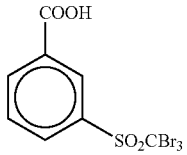
(H-16)
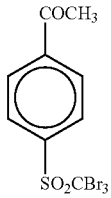
(H-17)
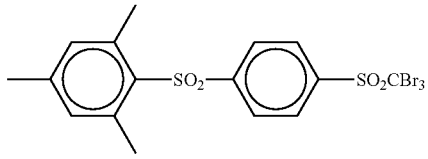
(H-18)
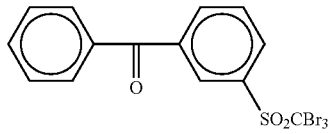
(H-19)
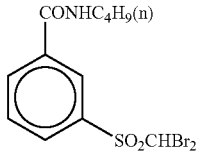

-continued (H-20)

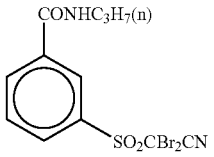

(H-21)

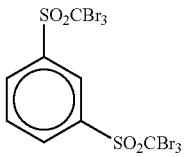

(H-22)

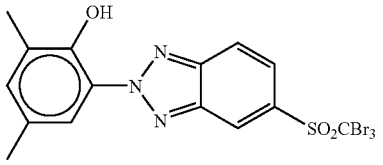

(H-23)

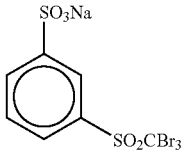

(H-24)

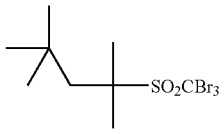

The compound represented by formula (H) is preferably used in the range from $10^{-4}$ to 1 mol, more preferably from $10^{-3}$ to 0.5 mol, still more preferably from $1\times10^{-3}$ to 0.2 mol, per mol of the non-photosensitive silver salt in the image-forming layer.

In the present invention, for incorporating the antifoggant into the photosensitive material, the methods described above for the incorporation of a reducing agent may be used. The organic polyhalogen compound is also preferably added in the form of a solid fine particle dispersion.

(Other Antifoggants)

Other examples of the antifoggant include mercury(II) salts described in JP-A-11-65021 (paragraph No. 0113), benzoic acids described in the same patent publication (paragraph No. 0114), salicylic acid derivatives described in JP-A-2000-206642, formalin scavenger compounds represented by formula (S) of JP-A-2000-221634, triazine compounds according to claim 9 of JP-A-11-352624, compounds represented by formula (III) of JP-A-6-11791, and 4-hydroxy-6-methyl-1,3,3a,7-tetrazaindene.

For the purpose of preventing fogging, the heat-developable photosensitive material of the present invention may contain an azolium salt. Examples of the azolium salt include compounds represented by formula (XI) of JP-A-59-193447, compounds described in JP-B-55-12581, and compounds represented by formula (II) of JP-A-60-153039. The azolium salt may be added to any site of the photosensitive material but is preferably added to a layer on the surface having a photosensitive layer, more preferably to the organic silver salt-containing layer. The timing of adding azolium salt may be any step during the preparation of the coating solution. In the case of adding the azolium salt to the organic silver salt-containing layer, the addition may be made in any step between the preparation of the organic silver salt and the preparation of the coating solution, however, the addition is preferably made between after the preparation of the organic silver salt and immediately before the coating. The azolium salt may be added in any form such as powder, solution or fine grain dispersion. The azolium salt may also be added as a mixed solution with other additives such as sensitizing dye, reducing agent and toning agent. In the present invention, the azolium salt may be added in any amount but the amount added is preferably from $1\times10^{-6}$ to 2 mol, more preferably from $1\times10^{-3}$ to 0.5 mol, per mol of silver.

In the present invention, a mercapto compound, a disulfide compound or a thione compound may be incorporated so as to control development by preventing or accelerating the development, enhance the spectral sensitization efficiency or improve the shelf life before or after the development. Examples of these compounds include compounds described in JP-A-10-62899 (paragraph Nos. 0067 to 0069), compounds represented by formula (I) and specific examples thereof in paragraph Nos. 0033 to 0052 of JP-A-10-186572, and compounds described in EP-A-0803764 (page 20, lines 36 to 56). Among these, mercapto-substituted heteroaromatic compounds described in JP-A-9-297367, JP-A-9-304875 and JP-A-2001-100358 are preferred.

(Description of Color Toning Agent)

A color toning agent is preferably added to the heat-developable photosensitive material of the present invention. Examples of the color toning agent include those described in JP-A-62899 (paragraph Nos. 0054 to 0055), EP-A-0803764 (page 21, lines 23 to 48), JP-A-2000-356317 and Japanese Patent Application No. 2000-187298. Particularly preferred are phthalazinones (phthalazinone, phthalazinone derivatives, and metal salts of phthalazinone, e.g., 4-(1-naphthyl)phthalazinone, 6-chlorophthalazinone, 5,7-dimethoxyphthalazinone, 2,3-dihydro-1,4-phthalazinedione); combinations of a phthalazinone and a phthalic acid (e.g., phthalic acid, 4-methylphthalic acid, 4-nitrophthalic acid, diammonium phthalate, sodium phthalate, potassium phthalate, tetrachlorophthalic anhydride); phthalazines (phthalazine, phthalazine derivatives, and metal salts of phthalazine, e.g., 4-(1-naphthyl)phthalazine, 6-isopropylphthalazine, 6-tert-butylphthalazine, 6-chlorophthalazine, 5,7-dimethoxyphthalazine, 2,3-dihydrophthalazine); and combinations of a phthalazine and a phthalic acid. Among these, preferred are combinations of a phthalazine and a phthalic acid, and more preferred is a combination of 6-isopropylphthalazine and phthalic acid or 4-methylphthalic acid.

(Other Additives)

The plasticizer and lubricant which can be used in the photosensitive layer in the present invention are described in JP-A-11-65021 (paragraph No. 0117); the ultrahigh contrast-providing agent for the formation of an ultrahigh contrast image and addition method or amount added thereof, which can be used in the present invention, are described in JP-A-11-65021 supra (paragraph No. 0118), JP-A-11-223898 (paragraph Nos. 0136 to 0193), JP-A-2000-284399 (compounds represented by formula (H), formulae (1) to (3) and formulae (A) and (B)) and Japanese Patent Application No. 11-91652 (compounds represented by formulae (III) to (V), specific compounds: Chem. 21 to Chem. 24); and the contrast-promoting agent which can be used in the present invention is described in JP-A-11-65021 (paragraph No. 0102) and JP-A-11-223898 (paragraph Nos. 0194 to 0195).

In the case of using a formic acid or a formate as a strong foggant, the formic acid or formate is preferably contained in an amount of 5 mmol or less, more preferably 1 mmol or less, per mol of silver, in the side having an image-forming layer containing a photosensitive silver halide.

In the case where an ultrahigh contrast-providing agent is used in the heat-developable photosensitive material of the present invention, an acid resulting from the hydration of diphosphorus pentoxide, or a salt thereof is preferably used in combination. Examples of the acid resulting from the hydration of diphosphorus pentoxide, and salts thereof include metaphosphoric acid (and salts thereof), pyrophosphoric acid (and salts thereof), orthophosphoric acid (and salts thereof), triphosphoric acid (and salts thereof), tetraphosphoric acid (and salts thereof), and hexametaphosphoric acid (and salts thereof). Among these, particularly preferred are orthophosphoric acid (and salts thereof) and hexametaphosphoric acid (and salts thereof). Specific examples of the salts include sodium orthophosphate, sodium dihydrogenorthophosphate, sodium hexametaphosphate and ammonium hexametaphosphate.

The amount used (coated amount per $m^2$ of the photosensitive material) of the acid resulting from the hydration of disphosphorus pentoxide, or a salt thereof may be a desired amount in accordance with the properties such as sensitivity and fog, but is preferably from 0.1 to 500 $mg/m^2$, more preferably from 0.5 to 100 $mg/m^2$.

(Description of Layer Structure)

In the heat-developable photosensitive material of the present invention, a surface protective layer may be provided so as to prevent the adhesion of the image-forming layer. The surface protective layer may be a single layer or composed of a plurality of layers. The surface protective layer is described in JP-A-11-65021 (paragraph Nos. 0119 to 0120) and Japanese Patent Application No. 2000-171936.

In the present invention, the binder for the surface protective layer is preferably gelatin but polyvinyl alcohol (PVA) is also preferably used or used in combination with gelatin. Examples of the gelatin which can be used include inert gelatin (e.g., "Nitta Gelatin 750") and phthalated gelatin (e.g., "Nitta Gelatin 801"). Examples of PVA include those described in JP-A-2000-171936 (paragraph Nos. 0009 to 0020) and preferred examples thereof include completely saponified product "PVA-105", partially saponified product "PVA-205" and "PVA-335", and modified polyvinyl alcohol "MP-203" (each trade name, produced by Kuraray Co., Ltd.). The coated amount (per $m^2$ of the support) of polyvinyl alcohol of the protective layer (per one layer) is preferably from 0.3 to 4.0 $g/m^2$, more preferably from 0.3 to 2.0 $g/m^2$.

Particularly when the heat-developable photosensitive material of the present invention is used for printing where the dimensional change becomes a problem, a polymer latex is preferably used for the surface protective layer or the back layer. This polymer latex is described in Taira Okuda and Hiroshi Inagaki (compilers), *Gosei Jushi Emulsion* (*Synthetic Resin Emulsion*), Kobunshi Kankokai (1978), Takaaki Sugimura, Yasuo Kataoka, Soichi Suzuki and Keishi Kasahara (compilers), *Gosei Latex no Oyo* (*Application of Synthetic Latex*), Kobunshi Kankokai (1993), and Soichi Muroi, *Gosei Latex no Kagaku* (*Chemistry of Synthetic Latex*), Kobunshi Kankokai (1970). Specific examples of the polymer latex include a latex of methyl methacrylate (33.5 wt %)/ethyl acrylate (50 wt %)/methacrylic acid (16.5 wt %) copolymer, a latex of methyl methacrylate (47.5 wt %)/butadiene (47.5 wt %)/itaconic acid (5 wt %) copolymer, a latex of ethyl acrylate/methacrylic acid copolymer, a latex of methyl methacrylate (58.9 wt %)/2-ethylhexyl acrylate (25.4 wt %)/styrene (8.6 wt %)/2-hydroxyethyl methacrylate (5.1 wt %)/acrylic acid (2.0 wt %) copolymer and a latex of methyl methacrylate (64.0 wt %)/styrene (9.0 wt %)/butyl acrylate (20.0 wt %)/2-hydroxyethyl methacrylate (5.0 wt %)/acrylic acid (2.0 wt %) copolymer. For the binder of the surface protective layer, a combination of polymer latexes described in Japanese Patent Application No. 11-6872, and techniques described in Japanese Patent Application Nos. 11-143058 (paragraph Nos. 0021 to 0025), 11-6872 (paragraph Nos. 0027 to 0028) and 10-199626 (paragraph Nos. 0023 to 0041) may also be applied. The percentage of the polymer latex in the surface protective layer is preferably from 10 to 90 wt %, more preferably from 20 to 80 wt %, based on the entire binder.

The coated amount (per $m^2$ of the support) of the entire binder (including water-soluble polymer and latex polymer) for the surface protective layer (per one layer) is preferably from 0.3 to 5.0 $g/m^2$, more preferably from 0.3 to 2.0 $g/m^2$.

In the present invention, the temperature at the preparation of a coating solution for the image-forming layer is preferably from 30 to 65° C., more preferably from 35 to less than 60° C., still more preferably from 35 to 55° C. Furthermore, the coating solution for the image-forming layer immediately after the addition of the polymer latex is preferably kept at a temperature of 30 to 65° C.

In the present invention, the image-forming layer is composed of one or more layer(s) on the support. In the case where the image-forming layer is composed of a single layer, the layer comprises an organic silver salt, a photosensitive silver halide, a reducing agent and a binder and if desired, additionally contains desired materials such as a color toning agent, a coating aid and other adjuvants. In the case where the image-forming layer is composed of two or more layers, a first image-forming layer (usually a layer adjacent to the support) contains an organic silver salt and a photosensitive silver halide, and a second image-forming layer or these two layers contain some other components. In the structure of a multicolor photosensitive heat-developable photographic material, a combination of these two layers may be provided for each color or as described in U.S. Pat. No. 4,708,928, all the components may be contained in a single layer. In the case of a multi-dye multicolor photosensitive heat-developable photographic material, the emulsion layers are held separated from each other by interposing a functional or nonfunctional barrier layer between respective photosensitive layers, as described in U.S. Pat. No. 4,460,681.

In the present invention, the photosensitive layer may contain various dyes or pigments (for example, C.I. Pigment Blue 60, C.I. Pigment Blue 64, C.I. Pigment Blue 15:6) from the standpoint of improving the tone, inhibiting the generation of interference fringes on laser exposure or preventing the irradiation. These are described in detail in WO98/36322, JP-A-10-268465 and JP-A-11-338098.

In the heat-developable photosensitive material of the present invention, an antihalation layer can be provided in the side farther from a light source with respect to the photosensitive layer.

The heat-developable photosensitive material generally has a non-photosensitive layer in addition to the photosensitive layer. The non-photosensitive layer can be classified by its position, into (1) a protective layer provided on a photosensitive layer (in the side farther from the support), (2) an interlayer provided between a plurality of photosensitive layers or between a photosensitive layer and a protective layer, (3) an undercoat layer provided between a photosensitive layer and a support, and (4) a back layer provided in the side opposite the photosensitive layer. In the photosensitive material, a filter layer is provided as the layer (1) or (2) and an antihalation layer is provided as the layer (3) or (4).

The antihalation layer is described in JP-A-11-65021 (paragraph Nos. 0123 to 0124), JP-A-11-223898, JP-A-9-230531, JP-A-10-36695, JP-A-10-104779, JP-A-11-231457, JP-A-11-352625 and JP-A-11-352626.

The antihalation layer contains an antihalation dye having absorption at the exposure wavelength. In the case where the exposure wavelength is present in the infrared region, an infrared ray-absorbing dye is used and in this case, the dye preferably has no absorption in the visible region.

In the case of preventing the halation using a dye having absorption in the visible region, it is preferred to allow substantially no color of the dye to remain after the formation of an image. For this purpose, means capable of decolorizing under the action of heat at the heat development is preferably used. In particular, the non-photosensitive layer is preferably rendered to function as an antihalation layer by adding thereto a thermally decolorizable dye and a base precursor. JP-A-11-231457 describes these techniques.

The amount of the decolorizable dye is determined according to the use purpose of the dye. In general, the decolorizable dye is used in an amount of giving an optical density (absorbance) in excess of 0.1 when measured at the objective wavelength. The optical density is preferably from 0.15 to 2, more preferably 0.2 to 1. For attaining such an optical density, the amount of the dye used is generally on the order of 0.001 to 1 g/m$^2$.

By such decolorization of a dye, the optical density after heat development can be reduced to 0.1 or less. Two or more decolorizable dyes may be used in combination in the thermally decolorizable recording material or heat-developable photosensitive material. Also, two or more base precursors may be used in combination.

In the thermal decolorization using these decolorizable dye and base precursor, a substance (e.g., diphenylsulfone, 4-chlorophenyl(phenyl)sulfone) capable of lowering the melting point by 3° C. or more when mixed with the base precursor, described in JP-A-11-352626, or 2-naphthylbenzoate is preferably used in combination in view of the thermal decolorizability and the like.

In the present invention, a coloring agent having an absorption maximum at 300 to 450 nm can be added for the purpose of improving silver tone or change of image in aging. Examples of such a coloring agent include those described in JP-A-62-210458, JP-A-63-104046, JP-A-63-103235, JP-A-63-208846, JP-A-63-306436, JP-A-63-314535, JP-A-01-61745 and JP-A-2001-100363.

This coloring agent is usually added in the range from 0.1 mg/m$^2$ to 1 g/m$^2$ and the layer to which the coloring agent is added is preferably a back layer provided in the side opposite the photosensitive layer.

The heat-developable photosensitive material of the present invention is preferably a so-called one-side photosensitive material having at least one photosensitive layer containing a silver halide emulsion in one side of the support and having a back layer in the other side.

(Description of Matting Agent)

In the present invention, a matting agent is preferably added for improving the conveyance property. Examples of the matting agent include those described in JP-A-11-65021 (paragraph Nos. 0126 to 0127). The amount of the matting agent added is, in terms of the coated amount per m$^2$ of the photosensitive material, preferably from 1 to 400 mg/m$^2$, more preferably from 5 to 300 mg/m$^2$.

The matting agent may have either a fixed form or an amorphous form but preferably has a fixed form and is preferably spherical. The average particle size of the matting agent is preferably from 0.5 to 10 μm, more preferably from 1.0 to 8.0 μm, still more preferably from 2.0 to 6.0 μm. The coefficient of variation in the size distribution is preferably 50% or less, more preferably 40% or less, still more preferably 30% or less. The term "coefficient of variation" as used herein means a value expressed by (standard deviation of particle size)/(average particle size)×100. It is also preferred to use two matting agents having a small coefficient of variation and different in the average particle size at a ratio of 3 or more.

The matting degree on the emulsion surface may be any value insofar as a stardust failure does not occur, but is preferably, in terms of the Beck smoothness, from 30 to 2,000 seconds, more preferably from 40 to 1,500 seconds. The Beck smoothness can be easily determined according to Japanese Industrial Standard (JIS) P8119, "Test Method for Smoothness of Paper and Paperboard by Beck Tester" and TAPPI Standard Method T479.

As for the matting degree of the back layer for use in the present invention, the Beck smoothness is preferably from 10 to 1,200 seconds, more preferably from 20 to 800 seconds, still more preferably from 40 to 500 seconds.

In the present invention, the matting agent is preferably incorporated into the outermost surface layer, a layer acting as the outermost surface layer, or a layer close to the outer surface, of the photosensitive material, or is preferably incorporated into a layer acting as a protective layer.

The back layer which can be applied to the present invention is described in JP-A-11-65021 (paragraph Nos. 0128 to 0130).

In the present invention, the pH on the layer surface of the heat-developable photosensitive layer before heat development is preferably 7.0 or less, more preferably 6.6 or less. The lower limit thereof is not particularly limited but is about 3. The most preferred pH range is from 4 to 6.2. For adjusting the pH on the layer surface, a nonvolatile acid such as organic acid (e.g., phthalic acid derivative) or sulfuric acid, or a volatile base such as ammonia is preferably used from the standpoint of reducing the pH on the layer surface. In particular, ammonia is preferred for achieving a low layer surface pH, because ammonia is readily volatilized and can be removed before the coating step or the heat development.

Furthermore, a combined use of ammonia with a nonvolatile base such as sodium hydroxide, potassium hydroxide or lithium hydroxide is also preferred. The method of measuring the pH on the layer surface is described in Japanese Patent Application No. 11-87297 (paragraph No. 0123).

In the present invention, a hardening agent may be used for each of the layers such as photosensitive layer, protective layer and back layer. Preferred examples of the hardening agent include those described in T. H. James, *The Theory of the Photographic Process Fourth Edition*, pp. 77-87, Macmillan Publishing Co., Inc. (1977), chrome alum, 2,4-dichloro-6-hydroxy-s-triazine sodium salt, N,N-ethylenebis (vinylsulfonacetamide), N,N-propylenebis (vinylsulfonacetamide), polyvalent metal ion described in *ibid.*, page 78, polyisocyanates described in U.S. Pat. No. 4,281,060 and JP-A-6-208193, epoxy compounds described in U.S. Pat. No. 4,791,042, and vinyl sulfone-base compounds described in JP-A-62-89048.

The hardening agent is added as a solution. The timing of adding this solution to the coating solution for protective layer is from 180 minutes before coating to immediately before coating, preferably from 60 minutes to 10 seconds before coating. The mixing method and conditions for the mixing are not particularly limited insofar as the effect of the present invention is satisfactorily brought out. Specific examples of the mixing method include a method of mixing the solutions in a tank designed to give a desired average residence time which is calculated from the addition flow rate and the liquid transfer amount to the coater, and a method using a static mixer described in N. Harnby, M. F. Edwards and A. W. Nienow (translated by Koji Takahashi), *Ekitai Kongo Gijutsu* (*Liquid Mixing Technique*), Chap. 8, Nikkan Kogyo Shinbun Sha (1989).

The solvent which can be applied to the present invention is described in JP-A-11-65021 (paragraph No. 0133), the support is described in paragraph No. 0134 of the same, the antistatic or electrically conducting layer is described in paragraph No. 0135 of the same, the method for obtaining a color image is described in paragraph No. 0136 of the same, and the slipping agent is described in JP-A-11-84573 (paragraph Nos. 0061 to 0064) and Japanese Patent Application No. 11-106881 (paragraph Nos. 0049 to 0062).

In the present invention, the photosensitive material preferably has an electrically conducting layer containing a metal oxide. The electrically conducting material for the electrically conducting layer is preferably a metal oxide increased in the electrical conductivity by introducing an oxygen defect or a different metal atom into the metal oxide. Preferred examples of the metal oxide include ZnO, $TiO_2$ and $SnO_2$. It is preferred to add Al or In to $ZnO_2$, add Sb, Nb, P or a halogen element to $SnO_2$, and add Nb or Ta to $TiO_2$. In particular, $SnO_2$ having added thereto Sb is preferred. The amount of the different metal atom added is preferably from 0.01 to 30 mol %, more preferably from 0.1 to 10 mol %. The shape of the metal oxide may be any one of spherical form, needle-like form and plate-like form but in view of the effect of imparting electrical conductivity, a needle-like particle having a long axis/short axis ratio of 2.0 or more, preferably from 3.0 to 50 is preferred. The amount of the metal oxide used is preferably from 1 to 1,000 mg/m$^2$, more preferably from 10 to 500 mg/m$^2$, still more preferably from 20 to 200 mg/m$^2$. In the present invention, the electrically conducting layer may be provided either in the emulsion surface side or in the back surface side but is preferably provided between a support and a back layer. Specific examples of the electrically conducting layer for use in the present invention include those described in JP-A-7-295146 and JP-A-11-223901.

Specific examples of the fluorine-containing surfactant which can be used in combination with the fluorine compound of the present invention include compounds described in JP-A-11-65021 (paragraph No. 0132), JP-A-10-197985, JP-A-2000-19680 and JP-A-2000-214554. Also, a high-molecular fluorine-containing surfactant described in JP-A-9-281636 can also be used in combination. In the present invention, a fluorine-containing surfactant described in Japanese Patent Application No. 2000-206560 can also be used in combination.

The transparent support is preferably polyester, particularly polyethylene terephthalate, subjected to a heat treatment in the temperature range from 130 to 185° C. so as to relax the internal distortion remaining in the film during the biaxial stretching and thereby eliminate the occurrence of thermal shrinkage distortion during the heat development. In the case of a heat-developable photosensitive material for medical uses, the transparent support may be colored with a bluish dye (for example, Dye-1 described in Example of JP-A-8-240877) or may be colorless. For the support, an undercoat technique of, for example, undercoating a water-soluble polyester described in JP-A-11-84574, a styrene-butadiene copolymer described in JP-A-10-186565, or a vinylidene chloride copolymer described in JP-A-2000-39684 and Japanese Patent Application No. 11-106881 (paragraph Nos. 0063 to 0080) is preferably applied. As for the antistatic layer or undercoat, techniques described in JP-A-59-143430, JP-A-56-143431, JP-A-58-62646, JP-A-56-120519, JP-A-11-84573 (paragraph Nos. 0040 to 0051), U.S. Pat. No. 5,575,957 and JP-A-11-223898 (paragraph Nos. 0078 to 0084) can be applied.

The heat-developable photosensitive material is preferably a mono-sheet type (a type where an image can be formed on the heat-developable photosensitive material without using another sheet such as image-receiving material).

The heat-developable photosensitive material may further contain an antioxidant, a stabilizer, a plasticizer, an ultraviolet absorber and a coating aid. These various additives are added to either a photosensitive layer or a non-photosensitive layer. These additives are described in WO98/36322, EP-A-803764, JP-A-10-186567 and JP-A-10-18568.

The heat-developable photosensitive material of the present invention may be coated in any manner. To speak specifically, various coating operations including extrusion coating, slide coating, curtain coating, dip coating, knife coating, flow coating, and extrusion coating using a hopper of the type described in U.S. Pat. No. 2,681,294 may be used. The extrusion coating or slide coating described in Stephen F. Kistler and Petert M. Schweizer, *LIQUID FILM COATING*, pp. 399-536, CHAPMAN & HALL (1977) is preferred. In particular, the slide coating is more preferred. An example of the shape of the slide coater used in the slide coating is shown in FIG. 11*b*.1 of *ibid.*, page 427. If desired, two or more layers may be simultaneously coated using a method described in *ibid.*, pp. 399-536, U.S. Pat. No. 2,761,791 and British Patent No. 837,095.

The coating solution for the organic silver salt-containing layer used in the present invention is preferably a so-called thixotropy fluid. This technique is described in JP-A-11-52509. The coating solution for the organic silver salt-containing layer used in the present invention preferably has a viscosity of 400 to 100,000 mPa·s, more preferably from 500 to 20,000 mPa·s, at a shear rate of 0.1 $S^{-1}$. At a shear rate of 1,000 $S^{-1}$, the viscosity is preferably from 1 to 200 mPa·s, more preferably from 5 to 80 mPa·s.

Examples of the technique which can be used in the heat-developable photosensitive material of the present invention include those described in EP-A-803764, EP-A-883022, WO98/36322, JP-A-56-62648, JP-A-58-62644, JP-A-9-43766, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to JP-A-10-186572, JP-A-10-197974, JP-A-10-197982, JP-A-10-197983, JP-A-10-197985 to JP-A-10-197987, JP-A-10-207001, JP-A-10-207004, JP-A-10-221807, JP-A-10-282601, JP-A-10-288823, JP-A-10-288824, JP-A-10-307365, JP-A-10-

312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898, JP-A-11-352627, JP-A-11-305377, JP-A-11-305378, JP-A-11-305384, JP-A-11-305380, JP-A-11-316435, JP-A-11-327076, JP-A-11-338096, JP-A-11-338098, JP-A-11-338099, JP-A-11-343420 and Japanese Patent Application Nos. 2000-187298, 2000-10229, 2000-47345, 2000-206642, 2000-98530, 2000-98531, 2000-112059, 2000-112060, 2000-112104, 2000-112064 and 2000-171936.

(Description of Packaging Material)

The photosensitive material of the present invention is preferably wrapped with a packaging material having a low oxygen permeability and/or water permeability so as to suppress fluctuation in the photographic performance during stock storage or improve the curl or curling habit. The oxygen permeability at 25° C. is preferably 50 ml/atm·$m^2$·day or less, more preferably 10 ml/atm·$m^2$·day or less, still 2 more preferably 1.0 ml/atm·$m^2$·day or less. The water permeability is preferably 10 g/atm·$m^2$·day or less, more preferably 5 g/atm·$m^2$·day or less, still more preferably 1 g/atm·$m^2$·day or less.

Specific examples of the packaging material having a low oxygen permeability and/or a low water permeability include packaging materials described in JP-A-8-254793 and JP-A-2000-206653.

(Description of Heat Development)

The heat-developable photosensitive material of the present invention may be developed by any method but the development is usually performed by raising the temperature of an imagewise exposed heat-developable photosensitive material. The development temperature is preferably from 80 to 250° C., more preferably from 100 to 140° C., still more preferably from 110 to 130° C. The development time is preferably from 1 to 60 seconds, more preferably from 3 to 30 seconds, still more preferably from 5 to 25 seconds, particularly preferably from 7 to 15 seconds.

The heat development system may be either a drum-type heater or a plate-type heater but the plate heater system is preferred. The heat development system using the plate heater is preferably a system described in JP-A-11-1335721, which is a heat developing apparatus of obtaining a visible image by bringing a heat-developable photosensitive material having formed thereon a latent image into contact with heating means in the heat-developing section, wherein the heating means comprises a plate heater, a plurality of press rollers are disposed to face each other along one surface of the plate heater, and the heat-developable photosensitive material is passed between the press rollers and the plate heater, thereby performing the heat development. The plate heater is preferably divided into 2 to 6 stages and the temperature at the leading end is preferably lowered by approximately from 1 to 10° C. For example, four plate heaters capable of independently controlling the temperature are used and these heaters are controlled to 112° C., 119° C., 121° C. and 120° C., respectively. Such a method is described also in JP-A-54-30032, where the water content or organic solvent contained in the heat-developable photosensitive material can be excluded out of the system and the heat-developable photosensitive material can be prevented from change in the shape of the support, which is otherwise caused by abrupt heating of the heat-developable photosensitive layer.

Any light source may be used for exposing the heat-developable photosensitive material of the present invention, but the exposure light source is preferably laser light. The laser for use in the present invention is preferably a gas laser (e.g., $Ar^+$, He—Ne), a YAG laser, a dye laser or a semiconductor laser. Also, a semiconductor laser combined with a second harmonic generating device may be used. A gas or semiconductor laser capable of emitting light from red to infrared is preferred.

Examples of the medical-use laser imager equipped with an exposure section and a heat-development section include Fuji Medical Dry Laser Imager "FM-DP L". The MF-DP L is described in *Fuji Medical Review*, No. 8, pp. 39-55 and, needless to say, the technique described therein can be applied as a laser imager for the heat-developable photosensitive material of the present invention. Furthermore, the heat-developable photosensitive material of the present invention can also be used as a heat-developable photosensitive material for a laser imager in the "AD network" proposed from Fuji Medical System as a network system adaptable for the DICOM standard.

The heat-developable photosensitive material of the present invention forms a black-and-white image by the silver image and is preferably used as a heat-developable photosensitive material for medical diagnosis, industrial photography, printing or COM.

The present invention is described in greater detail below by referring to Examples, however, it should understood that the present invention is not limited thereto.

EXAMPLE 1

(Preparation of PET Support)

PET having an intrinsic viscosity IV of 0.66 (measured at 25° C. in phenol/tetrachloroethane=6/4 (by weight)) was obtained in a usual manner using terephthalic acid and ethylene glycol. The resulting PET was pelletized and the pellets obtained were dried at 130° C. for 4 hours, melted at 300° C., extruded from a T-die and then quenched to prepare an unstretched film having a thickness large enough to give a thickness of 175 μm after the heat setting.

This film was stretched to 3.3 times in the machine direction using rolls different in the peripheral speed and then stretched to 4.5 times in the cross direction by a tenter. At this time, the temperatures were 110° C. and 130° C., respectively. Subsequently, the film was heat set at 240° C. for 20 seconds and relaxed by 4% in the cross direction at the same temperature. Thereafter, the chuck part of the tenter was slit, both edges of the film were knurled, and the film was taken up at 4 kg/$cm^2$ to obtain a roll having a thickness of 175 μm.

(Surface Corona Treatment)

Both surfaces of the support were treated at room temperature at 20 m/min using a solid state corona treating machine "Model 6 KVA" (manufactured by Pillar Technologies). From the current and voltage read at this time, it was known that a treatment of 0.375 kV·A·min/m was applied to the support. The treatment frequency here was 9.6 kHz and the gap clearance between the electrode and the dielectric roll was 1.6 mm.

(Preparation of Undercoated Support)

(1) Preparation of Coating Solution for Undercoat Layer Formulation (1) (for Undercoat Layer in the Photosensitive Layer Side):

| | |
|---|---|
| "PESRESIN A-520" (30 wt % solution) produced by Takamatsu Yushi K.K. | 59 g |
| Polyethylene glycol monononylphenyl ether (average ethylene oxide number: 8.5), 10 wt % solution | 5.4 g |
| "MP-1000" (fine polymer particles, average particle size: 0.4 μm) produced by Soken Kagaku K.K. | 0.91 g |
| Distilled water | 935 ml |

Formulation (2) (for First Layer on the Back Surface):

| | |
|---|---|
| Styrene/butadiene copolymer latex (solid content: 40 wt %, styrene/butadiene weight ratio: 68/32) | 158 g |
| 2,4-Dichloro-6-hydroxy-S-triazine sodium salt, 8 wt % aqueous solution | 20 g |
| 1 wt % aqueous solution of sodium laurylbenzenesulfonate | 10 ml |
| Distilled water | 854 ml |

Formulation (3) (for Second Layer on the Back Surface):

| | |
|---|---|
| $SnO_2$/SbO (9/1 by weight, average particle size: 0.038 μm, 17 wt % dispersion) | 84 g |
| Gelatin (10 wt % aqueous solution) | 89.2 g |
| "METROSE TC-5" (2 wt % aqueous solution) produced by Shin-Etsu Chemical Co., Ltd. | 8.6 g |
| "MP-1000" produced by Soken Kagaku K.K. | 0.01 g |
| 1 Wt % aqueous solution of sodium dodecylbenzenesulfonate | 10 ml |
| NaOH (1 wt %) | 6 ml |
| "PROXEL" (produced by ICI) | 1 ml |
| Distilled water | 805 ml |

Both surfaces of the 175 μm-thick biaxially stretched polyethylene terephthalate support obtained above each was subjected to the above-described corona discharge treatment and on one surface (photosensitive layer surface), the undercoating solution of formulation (1) was applied by a wire bar to have a wet coated amount of 6.6 ml/$m^2$ (per one surface) and dried at 180° C. for 5 minutes. Thereafter, on the opposite surface thereof (back surface), the undercoating solution of formulation (2) was applied by a wire bar to have a wet coated amount of 5.7 ml/$m^2$ and dried at 180° C. for 5 minutes. On the opposite surface (back surface), the undercoating solution of formulation (3) was further applied by a wire bar to have a wet coated amount of 7.7 ml/$m^2$ and dried at 180° C. for 6 minutes, thereby obtaining an undercoated support.

(Preparation of Coating Solution for Back Surface)

(Preparation of Solid Fine Particle Dispersion (a) of Base Precursor)

Base Precursor Compound 1 (64 g), 28 g of diphenylsulfone and 10 g of surfactant "Demol N" (produced by Kao Corporation) were mixed with 220 ml of distilled water. The mixed solution was dispersed using beads in a sand mill (¼ Gallon Sand Grinder Mill, manufactured by AIMEX K. K.) to obtain Solid Fine Particle Dispersion (a) of Base Precursor Compound, having an average particle size of 0.2 μm.

(Preparation of Solid Fine Particle Dispersion of Dye)

Cyanine Dye Compound 1 (9.6 g) and 5.8 g of sodium p-dodecylbenzenesulfonate were mixed with 305 ml of distilled water and the mixed solution was dispersed using beads in a sand mill (¼ Gallon Sand Grinder Mill, manufactured by AIMEX K. K.) to obtain a solid fine particle dispersion of dye, having an average particle size of 0.2 μm.

(Preparation of Coating Solution for Antihalation Layer)

Gelatin (17 g), 9.6 g of polyacrylamide, 56 g of Solid Fine Particle Dispersion (a) of Base Precursor obtained above, 50 g of the solid fine particle dispersion of dye obtained above, 1.5 g of monodisperse polymethyl methacrylate fine particles (average particle size: 8 μm, standard deviation of particle size: 0.4), 0.03 g of benzoisothiazolinone, 2.2 g of sodium polyethylenesulfonate, 0.1 g of Blue Dye Compound 1, 0.1 g of Yellow Dye Compound 1 and 844 ml of water were mixed to prepare a coating solution for antihalation layer.

(Preparation of Coating Solution for Protective Layer on Back Surface)

In a container kept at 40° C., 50 g of gelatin, 0.2 g of sodium polystyrenesulfonate, 2.4 g of N,N-ethylene-bis (vinylsulfonacetamide), 1 g of sodium tert-octylphenoxyethoxyethanesulfonate, 30 mg of benzoisothiazolinone, 37 mg of Fluorine-Containing Surfactant (F-1) (N-perfluorooctylsulfonyl-N-propylalanine potassium salt), 150 mg of Fluorine-Containing Surfactant (F-2) (polyethylene glycol mono(N-perfluorooctylsulfonyl-N-propyl-2-aminoethyl) ether [ethylene oxide average polymerization degree: 15]), 64 mg of Fluorine-Containing Surfactant (F-3), 32 mg of Fluorine-Containing Surfactant (F-4), 8.8 g of an acrylic acid/ethyl acrylate copolymer (copolymerization weight ratio: 5/95), 0.6 g of "Aerosol OT" (produced by American Cyanamide), 1.8 g of liquid paraffin emulsion as liquid paraffin and 950 ml of water were mixed to prepare a coating solution for protective layer on the back surface.

(Preparation of Silver Halide Emulsion)

<Preparation of Silver Halide Emulsion 1>

A solution was prepared by adding 3.1 ml of a 1 wt % potassium bromide solution, 3.5 ml of sulfuric acid in a concentration of 0.5 mol/L and 31.7 g of phthalated gelatin to 1,421 ml of distilled water and while stirring the solution in a stainless steel-made reaction pot and thereby keeping the liquid temperature at 30° C., the entire amount of Solution A prepared by diluting 22.22 g of silver nitrate with distilled water to a volume of 95.4 ml and the entire amount of Solution B prepared by diluting 15.3 g of potassium bromide and 0.8 g of potassium iodide with distilled water to a volume of 97.4 ml were added at a constant flow rate over 45 seconds. Thereto, 10 ml of an aqueous 3.5 wt % hydrogen peroxide solution was added and then, 10.8 ml of a 10 wt % aqueous solution of benzimidazole was further added.

Thereafter, the entire amount of Solution C prepared by diluting 51.86 g of silver nitrate with distilled water to a volume of 317.5 ml and the entire amount of Solution D obtained by diluting 44.2 g of potassium bromide and 2.2 g of potassium iodide with distilled water to a volume of 400 ml were added. Here, Solution C was added at a constant flow rate over 20 minutes and Solution D was added by the controlled double jet method while maintaining the pAg at 8.1. Ten minutes after the initiation of addition of Solution C and Solution D, the entire amount of potassium hexachloroiridate(III) was added to a concentration of $1\times10^{-4}$ mol per mol of silver. Furthermore, 5 seconds after the completion of addition of Solution C, the entire amount of an aqueous potassium hexacyanoferrate(II) solution was added to a concentration of $3\times10^{-4}$ mol per mol of silver.

Then, the pH was adjusted to 3.8 using sulfuric acid in a concentration of 0.5 mol/L and after stirring was stopped, the resulting solution was subjected to precipitation/desalting/water washing. The pH was then adjusted to 5.9 using sodium hydroxide in a concentration of 1 mol/L, thereby preparing a silver halide dispersion at a pAg of 8.0.

While stirring the silver halide dispersion obtained above and thereby keeping it at 38° C., 5 ml of a methanol solution containing 0.34 wt % of 1,2-benzoisothiazolin-3-one was added and after 40 minutes, a methanol solution containing Spectral Sensitizing Dye A and Spectral Sensitizing Dye B at a molar ratio of 1:1 was added in an amount, as a total of Sensitizing Dye A and Sensitizing Dye B, of $1.2\times10^{-3}$ mol per mol of silver. After 1 minute, the temperature was elevated to 47° C. and 20 minutes after the elevation of temperature, a methanol solution of sodium benzenethiosulfonate was added in an amount of $7.6\times10^{-5}$ mol per mol of silver. After 5 minutes, a methanol solution of Tellurium Sensitizer B was further added in an amount of $2.9\times10^{-4}$ mol per mol of silver and then, the solution was ripened for 91 minutes.

Thereto, 1.3 ml of a 0.8 wt % methanol solution of N,N'-dihydroxy-N"-diethylmelamine was added and after 4 minutes, a methanol solution of 5-methyl-2-mercaptobenzimidazole and a methanol solution of 1-phenyl-2-heptyl-5-mercapto-1,3,4-triazole were added in an amount of $4.8\times10^{-3}$ mol and $5.4\times10^{-3}$ mol, respectively, per mol of silver to prepare Silver Halide Emulsion 1.

The grains in the thus-prepared silver halide emulsion were silver iodobromide grains having an average equivalent-sphere diameter of 0.042 μm and a coefficient of variation in the equivalent-sphere diameter of 20% and uniformly containing 3.5 mol % of iodide. The grain size and the like were determined as an average of 1,000 grains using an electron microscope. The percentage of [100] faces in this grain was 80% as determined using the Kubelka-Munk equation.

<Preparation of Silver Halide Emulsion 2>

Silver Halide Emulsion 2 was prepared in the same manner as in the preparation of Silver Halide Emulsion 1 except that the liquid temperature at the grain formation was changed from 30° C. to 47° C., Solution B was obtained by diluting 15.9 g of potassium bromide with distilled water to a volume of 97.4 ml, Solution D was obtained by diluting 45.8 g of potassium bromide with distilled water to a volume of 400 ml, the addition time of Solution C was changed to 30 minutes and potassium hexacyanoferrate(II) was excluded. Also, precipitation/desalting/water washing/dispersion were performed in the same manner as in the preparation of Silver Halide Emulsion 1.

Thereafter, spectral sensitization, chemical sensitization and addition of 5-methyl-2-mercaptobenzimidazole and 1-phenyl-2-heptyl-5-mercapto-1,3,4-triazole were performed in the same manner as in the preparation of Emulsion 1 except that the amount added of the methanol solution containing Spectral Sensitizing Dye A and Spectral Sensitizing Dye B at a molar ratio of 1:1 was changed, as a total of Sensitizing Dye A and Sensitizing Dye B, to $7.5\times10^{-4}$ mol per mol of silver, the amount of Tellurium Sensitizer B added was changed to $1.1\times10^{-4}$ mol per mol of silver, and the amount of 1-phenyl-2-heptyl-5-mercapto-1,3,4-triazole added was changed to $3.3\times10^{-3}$ mol per mol of silver. Thus, Silver Halide Emulsion 2 was obtained.

The emulsion grains of Silver Halide Emulsion 2 were pure silver bromide cubic grains having an average equivalent-sphere diameter of 0.080 μm and a coefficient of variation in the equivalent-sphere diameter of 20%.

<Preparation of Silver Halide Emulsion 3>

Silver Halide Emulsion 3 was prepared in the same manner as in the preparation of Silver Halide Emulsion 1 except that the liquid temperature at the grain formation was changed from 30° C. to 27° C. Also, precipitation/desalting/water washing/dispersion were performed in the same manner as in the preparation of Silver Halide Emulsion 1.

Thereafter, Silver Halide Emulsion 3 was obtained in the same manner as Emulsion 1 except that a solid dispersion (aqueous gelatin solution) containing Spectral Sensitizing Dye A and Spectral Sensitizing Dye B at a molar ratio of 1:1 was added in an amount, as a total of Sensitizing Dye A and Sensitizing Dye B, of $5.2\times10^{-4}$ mol per mol of silver, and the amount of Tellurium Sensitizer B added was changed to $5.2\times10^{-4}$ mol per mol of silver.

The emulsion grains of Silver Halide Emulsion 3 were silver iodobromide grains having an average equivalent-sphere diameter of 0.034 μm and a coefficient of variation in the equivalent-sphere diameter of 20% and uniformly containing 3.5 mol % of iodide.

<Preparation of Mixed Emulsion A for Coating Solution>

70 Wt % of Silver Halide Emulsion 1, 15 wt % of Silver Halide Emulsion 2 and 15 wt % of Silver Halide Emulsion 3 were dissolved and thereto, a 1 wt % aqueous solution of benzothiazolium iodide was added in an amount of $7\times10^{-3}$ mol per mol of silver. Furthermore, water was added to adjust the silver halide content to 38.2 g in terms of silver per kg of the mixed emulsion for coating solution.

<Preparation of Fatty Acid Silver Salt Dispersion>

Behenic acid (87.6 kg, "Edenor C22-85R", trade name, produced by Henkel Co.), 423 L of distilled water, 49.2 L of an aqueous NaOH solution in a concentration of 5 mol/L, and 120 L of tert-butyl alcohol were mixed. The mixture was reacted by stirring at 75° C. for one hour to obtain a sodium behenate solution. Separately, 206.2 L (pH 4.0) of an aqueous solution containing 40.4 kg of silver nitrate was prepared and kept at 10° C. A reactor containing 635 L of distilled water and 30 L of tert-butyl alcohol was kept at 30° C. and while thoroughly stirring, the entire amount of the sodium behenate solution obtained above and the entire amount of the aqueous silver nitrate solution prepared above were added at constant flow rates over the period of 93 minutes and 15 seconds and the period of 90 minutes, respectively. At this time, only the aqueous silver nitrate solution was added for the period of 11 minutes after the initiation of addition of the aqueous silver nitrate solution, then addition of the sodium behenate solution was started, and only the sodium behenate solution was added for the period of 14 minutes and 15 second after the completion of addition of the aqueous silver nitrate solution.

During the addition, the temperature inside the reactor was kept at 30° C. and the outer temperature was controlled to make constant the liquid temperature. The piping in the system of adding the sodium behenate solution was kept warm by circulating hot water in the outer side of a double pipe, whereby the outlet liquid temperature at the distal end of the addition nozzle was adjusted to 75° C. The piping in the system of adding the aqueous silver nitrate solution was kept warm by circulating cold water in the outer side of a double pipe. The addition site of sodium behenate solution and the addition site of aqueous silver nitrate solution were symmetrically arranged centered around the stirring axis. Also, these addition sites were each adjusted to a height of not causing contact with the reaction solution.

After the completion of addition of the sodium behenate solution, the mixture was left at that temperature for 20 minutes with stirring. The temperature was then elevated to 35° C. over 30 minutes and the solution was ripened for 210 minutes. Immediately after the completion of ripening, the solid content was separated by centrifugal filtration and washed with water until the conductivity of filtrate became 30 μS/cm. In this manner, a fatty acid silver salt was obtained. The solid content obtained was not dried but stored as a wet cake.

The shape of the thus-obtained silver behenate grains was analyzed by electron microphotography. The grains were scaly crystals having average sizes of a=0.14 μm, b=0.4 μm and c=0.6 μm, an average aspect ratio of 5.2, an average equivalent-sphere diameter of 0.52 μm and a coefficient of variation in the equivalent-sphere diameter of 15% (a, b and c comply with the definition in this specification).

To the wet cake corresponding to 260 Kg as a dry solid content, 19.3 Kg of polyvinyl alcohol ("PVA-217", trade name) and water were added to make a total amount of 1,000 Kg. The resulting mixture was made into a slurry by a dissolver blade and the slurry was preliminarily dispersed by a pipeline mixer ("Model PM-10", manufactured by Mizuho Kogyo).

Then, the preliminarily dispersed stock solution was treated three times in a dispersing machine ("Microfluidizer M-610", trade name, manufactured by Microfluidex International Corporation, using a Z-type interaction chamber) under the control of pressure to 1,260 kg/cm$^2$ to obtain a silver behenate dispersion. At the dispersion, the temperature was set to 18° C. by a cooling operation of controlling the temperature of coolant using coiled heat exchangers attached to the inlet side and outlet side of the interaction chamber.

(Preparation of Reducing Agent Dispersion)

<Preparation of Reducing Agent Complex 1 Dispersion>

To 10 kg of Reducing Agent Complex 1 (a 1:1 complex of 6,6'-di-tert-butyl-4,4'-dimethyl-2,2'-butylidenediphenol and triphenylphosphine oxide), 0.12 Kg of triphenylphosphine oxide and 16 Kg of a 10 wt % aqueous solution of modified polyvinyl alcohol ("Poval MP203", produced by Kuraray Co., Ltd.), 10 Kg of water was added and thoroughly mixed to form a slurry.

This slurry was transferred by a diaphragm pump and dispersed in a horizontal sand mill ("UVM-2", manufactured by AIMEX K. K.) filled with zirconia beads having an average diameter of 0.5 mm for 4 hours and 30 minutes. Thereafter, 0.2 g of benzoisothiazolinone sodium salt and water were added to adjust the reducing agent concentration to 22 wt %, thereby obtaining Reducing Agent Complex 1 Dispersion.

The reducing agent complex particles contained in the thus-obtained reducing agent complex dispersion had a median diameter of 0.45 μm and a maximum particle size of 1.4 μm or less. The obtained reducing agent complex dispersion was filtered through a polypropylene-made filter having a pore size of 3.0 μm to remove foreign matters such as dust and then housed.

<Preparation of Reducing Agent 2 Dispersion>

To 10 kg of Reducing Agent 2 (6,6'-di-tert-butyl-4,4'-dimethyl-2,2'-butylidenediphenol) and 16 Kg of a 10 wt % aqueous solution of modified polyvinyl alcohol ("Poval MP203", produced by Kuraray Co., Ltd.), 10 Kg of water was added and thoroughly mixed to form a slurry.

This slurry was transferred by a diaphragm pump and dispersed in a horizontal sand mill ("UVM-2", manufactured by AIMEX K. K.) filled with zirconia beads having an average diameter of 0.5 mm for 3 hours and 30 minutes. Thereafter, 0.2 g of benzoisothiazolinone sodium salt and water were added to adjust the reducing agent concentration to 25 wt %, thereby obtaining Reducing Agent 2 Dispersion.

The reducing agent particles contained in the thus-obtained reducing agent dispersion had a median diameter of 0.40 μm and a maximum particle size of 1.5 μm or less. The obtained reducing agent dispersion was filtered through a polypropylene-made filter having a pore size of 3.0 μm to remove foreign matters such as dust and then housed.

<Preparation of Hydrogen Bond-Forming Compound 1 Dispersion>

To 10 Kg of Hydrogen Bond-Forming Compound 1 (tri(4-tert-butylphenyl) phosphine oxide) and 16 Kg of a 10 wt % aqueous solution of modified polyvinyl alcohol ("Poval MP203", produced by Kuraray Co., Ltd.), 10 Kg of water was added and thoroughly mixed to form a slurry.

The resulting slurry was transferred by a diaphragm pump and dispersed in a horizontal sand mill ("UVM-2", manufactured by AIMEX K. K.) filled with zirconia beads having an average diameter of 0.5 mm for 3 hours and 30 minutes. Thereafter, 0.2 g of benzoisothiazolinone sodium salt and water were added to adjust the hydrogen bond-forming compound concentration to 25 wt %, thereby obtaining Hydrogen Bond-Forming Compound 1 Dispersion.

The hydrogen bond-forming compound particles contained in the thus-obtained hydrogen bond-forming compound dispersion had a median diameter of 0.35 μm and a maximum particle size of 1.5 μm or less. The obtained hydrogen bond-forming compound dispersion was filtered through a polypropylene-made filter having a pore size of 3.0 μm to remove foreign matters such as dust and then housed.

<Preparation of Development Accelerator 1 Dispersion>

To 10 Kg of Development Accelerator 1 and 20 Kg of a 10 wt % aqueous solution of modified polyvinyl alcohol ("Poval MP203", produced by Kuraray Co., Ltd.), 10 Kg of water was added and thoroughly mixed to form a slurry.

The resulting slurry was transferred by a diaphragm pump and dispersed in a horizontal sand mill ("UVM-2", manufactured by AIMEX K. K.) filled with zirconia beads having an average diameter of 0.5 mm for 3 hours and 30 minutes. Thereafter, 0.2 g of benzoisothiazolinone sodium salt and water were added to adjust the development accelerator concentration to 20 wt %, thereby obtaining Development Accelerator 1 Dispersion.

The development accelerator particles contained in the thus-obtained development accelerator dispersion had a median diameter of 0.48 μm and a maximum particle size of 1.4 μm or less. The obtained development accelerator dispersion was filtered through a polypropylene-made filter having a pore size of 3.0 μm to remove foreign matters such as dust and then housed.

Solid Dispersions of Development Accelerator 2, Development Accelerator 3 and Color Tone Adjuster 1 each was obtained as a 20 wt % dispersion in the same manner as Development Accelerator 1.

(Preparation of Polyhalogen Compound)

<Preparation of Organic Polyhalogen Compound 1 Dispersion>

To 10 Kg of Organic Polyhalogen Compound 1 (tribromomethanesulfonylbenzene), 10 Kg of a 20 wt % aqueous solution of modified polyvinyl alcohol ("Poval MP203", produced by Kuraray Co., Ltd.) and 0.4 Kg of a 20 wt % aqueous solution of sodium triisopropylnaphthalenesulfonate, 14 Kg of water was added and thoroughly mixed to form a slurry.

The resulting slurry was transferred by a diaphragm pump and dispersed in a horizontal sand mill ("UVM-2", manufactured by AIMEX K. K.) filled with zirconia beads having an average diameter of 0.5 mm for 5 hours. Thereafter, 0.2 g of benzoisothiazolinone sodium salt and water were added to adjust the organic polyhalogen compound concentration to 26 wt %, thereby obtaining Organic Polyhalogen Compound 1 Dispersion.

The organic polyhalogen compound particles contained in the thus-obtained organic polyhalogen compound dispersion had a median diameter of 0.41 μm and a maximum particle size of 2.0 μm or less. The obtained organic polyhalogen compound dispersion was filtered through a polypropylene-made filter having a pore size of 10.0 μm to remove foreign matters such as dust and then housed.

<Preparation of Organic Polyhalogen Compound 2 Dispersion>

To 10 Kg of Organic Polyhalogen Compound 2 (N-butyl-3-tribromomethanesulfonylbenzamide) and 20 Kg of a 10 wt % aqueous solution of modified polyvinyl alcohol ("Poval MP203", produced by Kuraray Co., Ltd.), 0.4 Kg of a 20 wt % aqueous solution of sodium triisopropylnaphthalenesulfonate was added and thoroughly mixed to form a slurry.

The resulting slurry was transferred by a diaphragm pump and dispersed in a horizontal sand mill ("UVM-2", manufactured by AIMEX K. K.) filled with zirconia beads having an average diameter of 0.5 mm for 5 hours. Thereafter, 0.2 g of benzoisothiazolinone sodium salt and water were added to adjust the organic polyhalogen compound concentration to 30 wt %. This dispersion solution was heated at 40° C. for 5 hours, whereby Organic Polyhalogen Compound 2 Dispersion was obtained.

The organic polyhalogen compound particles contained in the thus-obtained polyhalogen compound dispersion had a median diameter of 0.40 μm and a maximum particle size of 1.3 μm or less. The obtained organic polyhalogen compound dispersion was filtered through a polypropylene-made filter having a pore size of 3.0 μm to remove foreign matters such as dust and then housed.

<Preparation of Phthalazine Compound 1 Solution>

In 174.57 Kg of water, 8 Kg of modified polyvinyl alcohol "MP203" produced by Kuraray Co., Ltd. was dissolved. Thereto, 3.15 Kg of a 20 wt % aqueous solution of sodium triisopropylnaphthalenesulfonate and 14.28 Kg of a 70 wt % aqueous solution of Phthalazine Compound 1 (6-isopropylphthalazine) were added to prepare a 5 wt % solution of Phthalazine Compound 1.

(Preparation of Mercapto Compound)

<Preparation of Aqueous Mercapto Compound 1 Solution>

In 993 g of water, 7 g of Mercapto Compound 1 (1-(3 -sulfophenyl)-5-mercaptotetrazole sodium salt) was dissolved to prepare a 0.7 wt % aqueous solution.

<Preparation of Aqueous Mercapto Compound 2 Solution>

In 980 g of water, 20 g of Mercapto Compound 2 (1-(3 -methylureido)-5-mercaptotetrazole sodium salt) was dissolved to prepare a 2.0 wt % aqueous solution.

<Preparation of Pigment 1 Dispersion>

To 64 g of C.I. Pigment Blue 60 and 6.4 g of "Demol N" (produced by Kao Corporation), 250 g of water was added and thoroughly mixed to form a slurry. The resulting slurry and 800 g of zirconia beads having an average diameter of 0.5 mm were put together into a vessel and dispersed for 25 hours in a dispersing machine (¼G Sand Grinder Mill, manufactured by AIMEX K. K.) to obtain Pigment 1 Dispersion.

The pigment particles contained in the thus-obtained pigment dispersion had an average particle size of 0.21 μm.

<Preparation of SBR Latex Solution>

An SBR latex having a Tg of 22° C. was prepared as follows.

Using ammonium persulfate as a polymerization initiator and an anionic surfactant as an emulsifier, 70.0 mass of styrene, 27.0 mass of butadiene and 3.0 mass of acrylic acid were emulsion-polymerized. After aging at 80° C. for 8 hours, the resulting solution was cooled to 40° C. and adjusted to a pH of 7.0 with aqueous ammonia. Thereto, "SANDET BL" (produced by Sanyo Kasei K. K.) was added to have a concentration of 0.22%. Thereafter, the pH was adjusted to 8.3 by adding an aqueous 5% sodium hydroxide solution and then, the pH was adjusted to 8.4 with aqueous ammonia.

The molar ratio of $Na^+$ ion and $NH_4^+$ ion used here was 1:2.3. To 1 Kg of this solution, 0.15 ml of a 7% aqueous solution of benzoisothiazolinone sodium salt was added to prepare an SBR latex solution.

(SBR Latex: Latex of -St(70.0)-Bu(27.0)-AA(3.0)-):

Tg: 22° C.

Average particle size: 0.1 μm, concentration: 43 wt %, equilibrium moisture content at 25° C. and 60% RH: 0.6 wt %, ion conductivity: 4.2 mS/cm (in the measurement of ion conductivity, the latex stock solution (43 wt %) was measured at 25° C. using a conductivity meter "CM-30S" (manufactured by Toa Denpa Kogyo K. K.)), pH: 8.4.

SBR latexes different in the Tg can be prepared in the same manner by appropriately changing the ratio of styrene and butadiene.

<Preparation of Coating Solution 1 for Emulsion Layer (Photosensitive Layer)>

The fatty acid silver salt dispersion prepared above (1,000 g), 276 ml of water, 33.2 g of Pigment 1 Dispersion, 21 g of Organic Polyhalogen Compound 1 Dispersion, 58 g of Organic Polyhalogen Compound 2 Dispersion, 173 g of Phthalazine Compound 1 Solution, 1,082 g of SBR latex (Tg: 22° C.) solution, 299 g of Reducing Agent Complex 1 Dispersion, 6 g of Development Accelerator 1 Dispersion, 9 ml of Aqueous Mercapto Compound 1 Solution and 27 ml of Aqueous Mercapto Compound 2 Solution were sequentially added. Immediately before the coating, 117 g of Silver Halide Mixed Emulsion A was added and thoroughly mixed. The resulting coating solution for emulsion layer was transferred as it was to a coating die and coated.

The viscosity of the coating solution for emulsion layer obtained above was measured by a Brookfield viscometer manufactured by Tokyo Keiki Kogyo K. K. and found to be 25 [mPa·s] at 40° C. (No. 1 rotor, 60 rpm).

The viscosity of the coating solution measured at 25° C. using "RFS Field Spectrometer" (manufactured by Rheometrics Far East K. K.) was 230, 60, 46, 24 and 18 [mPa·s] at a shear rate of 0.1, 1, 10, 100 and 1,000 [1/sec], respectively.

The amount of zirconium in the coating solution was 0.38 mg per g of silver.

<Preparation of Coating Solution 2 for Emulsion Layer (Photosensitive Layer)>

The fatty acid silver salt dispersion prepared above (1,000 g), 276 ml of water, 32.8 g of Pigment 1 Dispersion, 21 g of Organic Polyhalogen Compound 1 Dispersion, 58 g of Organic Polyhalogen Compound 2 Dispersion, 173 g of Phthalazine Compound 1 Solution, 1,082 g of SBR latex (Tg: 20° C.) solution, 155 g of Reducing Agent 2 Dispersion, 55 g of Hydrogen Bond-Forming Compound 1 Dispersion, 6 g of Development Accelerator 1 Dispersion, 2 g of Development Accelerator 2 Dispersion, 3 g of Development Accelerator 3 Dispersion, 2 g of Color Tone Adjuster 1 Dispersion and 6 ml of Aqueous Mercapto Compound 2 Solution were sequentially added. Immediately before the coating, 117 g of Silver Halide Mixed Emulsion A was added and thoroughly mixed. The resulting coating solution for emulsion layer was transferred as it was to a coating die and coated.

The viscosity of the coating solution for emulsion layer obtained above was measured by a Brookfield viscometer manufactured by Tokyo Keiki Kogyo K. K. and found to be 40 [mPa·s] at 40° C. (No. 1 rotor, 60 rpm).

The viscosity of the coating solution measured at 25° C. using "RFS Field Spectrometer" (manufactured by Rheometrics Far East K. K.) was 530, 144, 96, 51 and 28 [mPa·s] at a shear rate of 0.1, 1, 10, 100 and 1,000 [1/sec], respectively.

The amount of zirconium in the coating solution was 0.25 mg per g of silver.

<Preparation of Coating Solution for Interlayer on Emulsion Surface>

A 5 wt % aqueous solution (27 ml) of "Aerosol OT" (produced by American Cyanamide), 135 ml of a 20 wt % aqueous solution of diammonium phthalate and water for making a total amount of 10,000 g were added to 1,000 g of polyvinyl alcohol "PVA-205" (produced by Kuraray Co., Ltd.), 272 g of a 5 wt % pigment dispersion and 4,200 ml of a 19 wt % solution of methyl methacrylate/styrene/butyl acrylate/hydroxyethyl methacrylate/acrylic acid copolymer (copolymerization weight ratio: 64/9/20/5/2) latex. The pH was adjusted to 7.5 with NaOH to prepare a coating solution for interlayer and then the coating solution for interlayer was transferred to a coating die to give a coverage of 9.1 ml/m$^2$.

The viscosity of the coating solution was measured at 40° C. by a Brookfield viscometer (No. 1 rotor, 60 rpm) and found to be 58 [mPa·s].

<Preparation of Coating Solution for First Protective Layer on Emulsion Surface>

In water, 64 g of inert gelatin was dissolved. Thereto, 80 g of a 27.5 wt % solution of methyl methacrylate/styrene/butyl acrylate/hydroxyethyl methacrylate/acrylic acid copolymer (copolymerization weight ratio: 64/9/20/5/2) latex, 23 ml of a 10 wt % methanol solution of phthalic acid, 23 ml of a 10 wt % aqueous solution of 4-methylphthalic acid, 28 ml of sulfuric acid in a concentration of 0.5 mol/L, 5 ml of a 5 wt % aqueous solution of "Aerosol OT" (produced by American Cyanamide), 0.5 g of phenoxyethanol, 0.1 g of benzoisothiazolinone and water for making a total amount of 750 g were added to prepare a coating solution. Immediately before the coating, 26 ml of a 4 wt % chrome alum was mixed using a static mixer. Then, the coating solution was transferred to a coating die to give a coverage of 18.6 ml/m$^2$.

The viscosity of the coating solution was measured by a Brookfield viscometer at 40° C. (No. 1 rotor, 60 rpm) and found to be 20 [mPa·s].

<Preparation of Coating Solution for Second Protective Layer on Emulsion Surface>

In water, 80 g of inert gelatin was dissolved. Thereto, 102 g of a 27.5 wt % solution of methyl methacrylate/styrene/butyl acrylate/hydroxyethyl methacrylate/acrylic acid copolymer (copolymerization weight ratio: 64/9/20/5/2) latex, 3.2 ml of a 5 wt % solution of Fluorine-Containing Surfactant (F-1) (N-perfluorooctylsulfonyl-N-propylalanine potassium salt), 32 ml of a 2 wt % aqueous solution of Fluorine-Containing Surfactant (F-2) (polyethylene glycol mono(N-perfluorooctylsulfonyl-N-propyl-2-aminoethyl ether [ethylene oxide average polymerization degree: 15]), 23 ml of a 5 wt % solution of "Aerosol OT" (produced by American Cyanamide), 4 g of polymethyl methacrylate fine particles (average particle size: 0.7 μm), 21 g of polymethyl methacrylate fine particles (average particle size: 4.5 μm), 1.6 g of 4-methylphthalic acid, 4.8 g of phthalic acid, 44 ml of sulfuric acid in a concentration of 0.5 mol/L, 10 mg of benzoisothiazolinone and water for making a total amount of 650 g were added. Immediately before the coating, 445 ml of an aqueous solution containing 4 wt % of chrome alum and 0.67 wt % of phthalic acid was mixed using a static mixer to obtain a coating solution for surface protective layer and then the coating solution for surface protective layer was transferred to a coating die to give a coverage of 8.3 ml/m$^2$.

The viscosity of the coating solution was measured at 40° C. by a Brookfield viscometer (No. 1 rotor, 60 rpm) and found to be 19 [mPa·s].

<Preparation of Heat-Developable Photosensitive Material 1>

In the back surface side of the undercoated support prepared above, the coating solution for antihalation layer and the coating solution for back surface protective layer were simultaneously coated one on another to give a coated amount of solid fine particle dye of 0.04 g/m$^2$ as a solid content and a gelatin coated amount of 1.7 g/m$^2$, respectively. Then, the coating was dried to form a back layer.

On the surface opposite the back surface, an emulsion layer, an interlayer, a first protective layer and a second protective layer were simultaneously coated one on another in this order from the undercoated surface by the slide bead coating method to prepare a heat-developable photosensitive material sample. At this time, the temperature was adjusted such that the emulsion layer and the interlayer were 31° C., the first protective layer was 36° C. and the second protective layer was 37° C.

The coated amount (g/m$^2$) of each compound in the emulsion layer is shown below.

| | |
|---|---|
| Silver behenate | 5.55 |
| Pigment (C.I. Pigment Blue 60) | 0.036 |
| Polyhalogen Compound 1 | 0.12 |
| Polyhalogen Compound 2 | 0.37 |
| Phthalazine Compound 1 | 0.19 |
| SBR Latex | 9.97 |
| Reducing Agent Complex 1 | 1.41 |
| Development Accelerator 1 | 0.024 |
| Mercapto Compound 1 | 0.002 |

-continued

| | |
|---|---|
| Mercapto Compound 2 | 0.012 |
| Silver Halide (as Ag) | 0.091 |

The coating and drying conditions were as follows.

The coating was performed at a speed of 160 m/min, the distance between the tip of coating die and the support was set to from 0.10 to 0.30 mm, and the pressure in the vacuum chamber was set lower by 196 to 882 Pa than the atmospheric pressure. The support was destaticized by ionized wind before the coating.

In the subsequent chilling zone, the coating solution was cooled with air showing a dry bulb temperature of 10 to 20° C. The sample was then subjected to contact-free transportation and in a helical floating-type dryer, dried with drying air showing a dry bulb temperature of 23 to 45° C. and a wet bulb temperature of 15 to 21° C.

After drying, the humidity was adjusted to 40 to 60% RH at 25° C. and then, the layer surface was heated to 70 to 90° C. The heated layer surface was then cooled to 25° C.

The heat-developable photosensitive material thus prepared had a matting degree of, in terms of the Beck's smoothness, 550 seconds on the photosensitive layer surface and 130 seconds on the back surface. Furthermore, the pH on the layer surface in the photosensitive layer side was measured and found to be 6.0.

<Preparation of Heat-Developable Photosensitive Material 2>

Heat-Developable Photosensitive Material 2 was prepared in the same manner as Heat-Developable Photosensitive Material 1 except that in the preparation of Heat-Developable Photosensitive Material 1, Coating Solution 1 for Emulsion Layer was changed to Coating Solution 2 for Emulsion Layer, Yellow Dye Compound 15 was eliminated from the antihalation layer, and the fluorine-containing surfactants in the back surface protective layer and emulsion surface protective layer were changed from F-1, F-2, F-3 and F-4 to F-5, F-6, F-7 and F-8, respectively.

The coated amount (g/m$^2$) of each compound in this emulsion layer is shown below.

| | |
|---|---|
| Silver behenate | 5.55 |
| Pigment (C.I. Pigment Blue 60) | 0.036 |
| Polyhalogen Compound 1 | 0.12 |
| Polyhalogen Compound 2 | 0.37 |
| Phthalazine Compound 1 | 0.19 |
| SBR Latex | 9.67 |
| Reducing Agent 2 | 0.81 |
| Hydrogen Bond-Forming Compound 1 | 0.30 |
| Development Accelerator 1 | 0.024 |
| Development Accelerator 2 | 0.010 |
| Development Accelerator 3 | 0.015 |
| Color Tone Adjuster 1 | 0.010 |
| Mercapto Compound 2 | 0.002 |
| Silver Halide (as Ag) | 0.091 |

Chemical structures of the compounds used in Examples of the present invention are shown below.

Spectral Sensitizing Dye A:

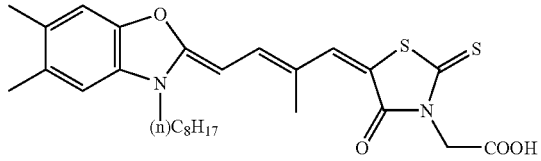

Spectral Sensitizing Dye B:

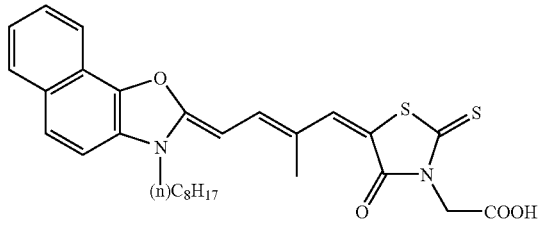

Tellurium Sensitizer C:

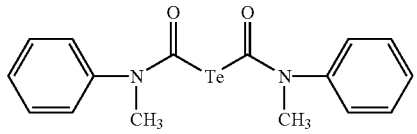

Base Precursor Compound 1:

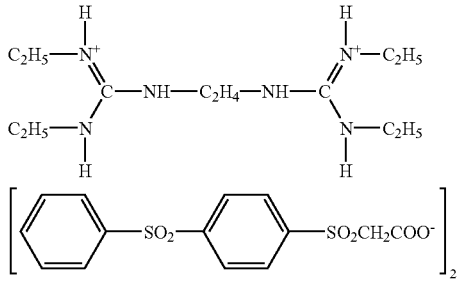

Cyanine Dye Compound 1:

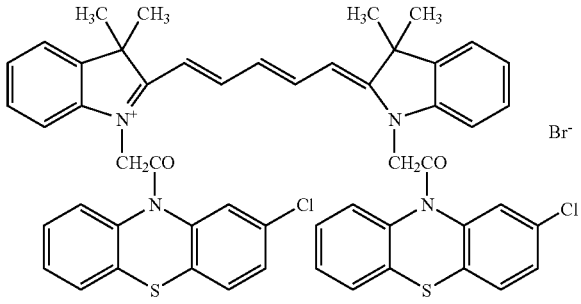

Blue Dye Compound-1:
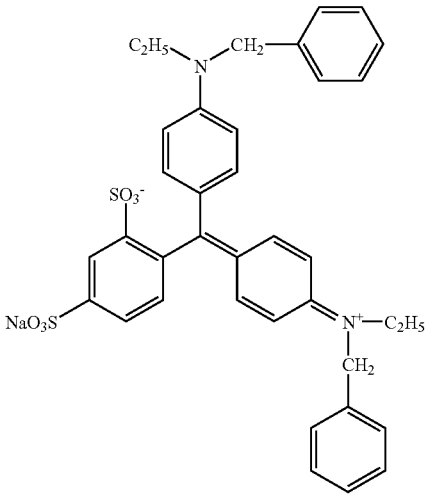
Yellow Dye Compound 1:
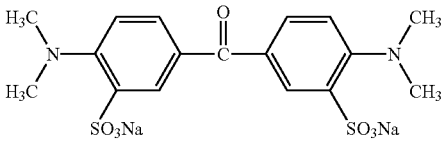
Reducing Agent Complex 1:
A 1:1 complex of
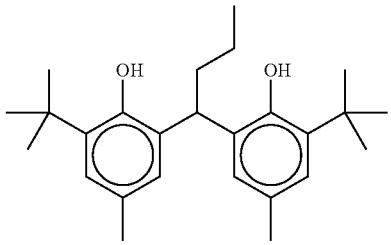
and
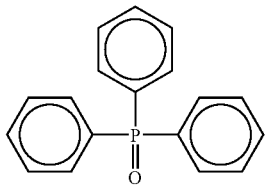
Reducing Agent 2:
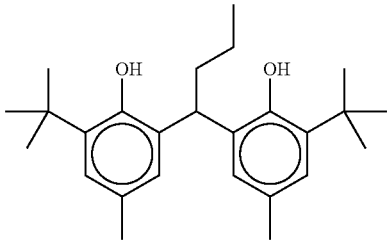
Hydrogen Bond-Forming Compound 1:
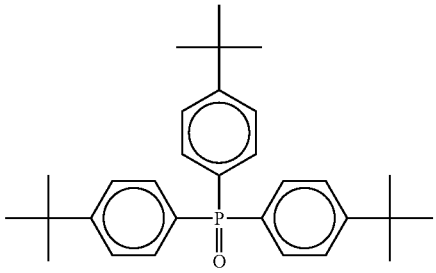
Polyhalogen Compound 1:
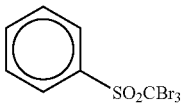
Polyhalogen Compound 2:
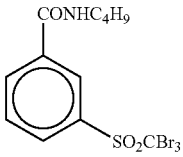
Mercapto Compound 1:
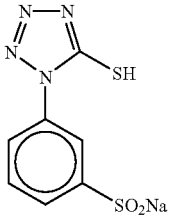

Mercapto Compound 2:

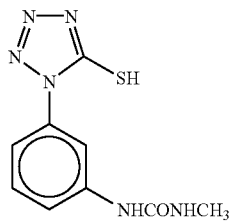

Phthalazine Compound 1:

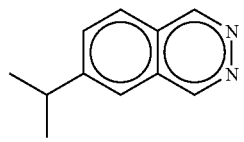

Development Accelerator 1:

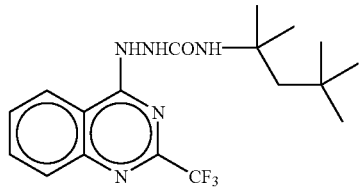

Development Accelerator 2:

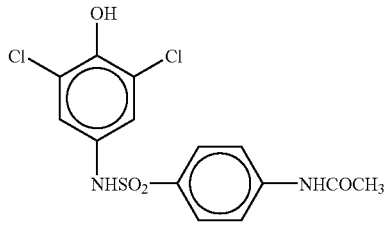

Development Accelerator 3:

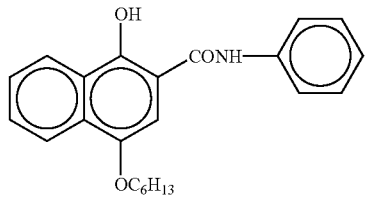

Color Tone Adjuster 1:

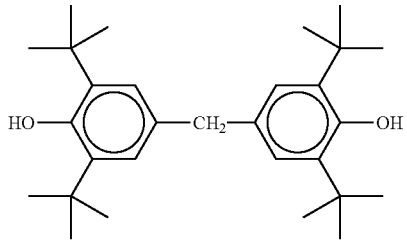

(F-1) $C_8F_{17}SO_2-N(C_3H_7(n))-CH_2COOK$ (F-2) $C_8F_{17}SO_2-N(C_3H_7(n))-CH_2CH_2O-(CH_2CH_2O)_n-H$ $n$ = 15 (average)

(F-3) $C_8F_{17}SO_2-N(C_3H_7(n))-(CH_2CH_2O)_4-CH_2CH_2CH_2CH_2SO_3Na$ (F-4) $C_8F_{17}SO_3K$ (F-5) $CF_3(CF_2)_nCH_2CH_2SCH_2CH_2COOLi$
mixture of n=5 to 11

(F-6) $CF_3(CF_2)_nCH_2CH_2O(CH_2CH_2O)H$
mixture of n=5 to 11, m=5 to 15

(F-7) $CF_3(CF_2)_nCH_2CH_2SO_3Na$
mixture of n=5 to 11

(F-8) $C_6F_{13}CH_2CH_2SO_3Li$

Samples 002 to 012 were prepared thoroughly in the same manner as Heat-Developable Photosensitive Material 1 (Sample 001) except that in the preparation of Sample 001, Fluorine Compounds F-1, F-2, F-3 and F-4 in the emulsion surface protective layer and the back surface protective layer were changed as shown in Table 1 to give the same total mass.

Samples 014 to 024 were prepared thoroughly in the same manner as Heat-Developable Photosensitive Material 2 (Sample 013) except that in the preparation of Sample 013, Fluorine Compounds F-5, F-6, F-7 and F-8 in the emulsion surface protective layer and the back surface protective layer were changed as shown in Table 1 to give the same total mass.

(Evaluation of Photographic Performance)

The samples obtained each was cut into a size of 356×432 mm, wrapped with the following packaging material in the environment of 25° C. and 50% RH, stored at an ordinary temperature for 2 weeks and then evaluated on the items shown below.

(Packaging Material)

Polyethylene (50 μm) containing 10 μm of PET/12 μm of PE/9 μm of aluminum foil/15 μm of Ny/3% of carbon:

oxygen permeability: 0 ml/atm·$m^2$·25° C.·day water permeability: 0 g/atm $m^2$·25° C.·day The samples each was exposed and heat-developed (with four sheets of panel heater set at 112° C.-119° C.-121° C.-121° C., for 24 seconds in total in the case of Samples 001 to 012 and for 14 seconds in total in the case of Samples 013 to 024) in "Fuji Medical Dry Laser Imager FM-DP L"

(in which a semiconductor laser of 660 nm having a maximum output of 60 mW (IIIB) was mounted). The obtained image was evaluated by a densitometer.

Each sample was subjected to uniform exposure of giving a density of 1.5 and to printing of an actual image of breast and then heat-developed for a predetermined time. The obtained samples were observed with an eye over Schaukasten and evaluated on the coated surface state.

The evaluation results are shown in Table 1.

In the Table, the coating streak is shown by the number of thin streaks appeared in the coated direction of the photosensitive material and viewed low in the density as compared with the peripheral part, per the coated width of 1 m.

The coating unevenness was evaluated by rating the degree of cloud-like unevenness with an eye according to the following criteria.

◎: Very good level with overall uniformity and no unevenness.

○: Slight unevenness on careful viewing but negligible.

Δ: Unevenness is seen at uniform exposure but not perceived when an image is printed.

X: Entirely uneven and even with an image, unevenness is perceived on careful viewing.

Samples each was touched by 10 persons with a hand in a room air-conditioned to a room temperature of 28° C. and a relative humidity of 75%, irradiated with light for 3 hours on Schaukasten and evaluated on the staining by a fingerprint using Schaukasten. The evaluation was shown by the following ratings.

◎: Almost negligible staining.

○: Staining by fingerprints of one or two persons is observed but in a slight degree.

Δ: Staining by fingerprints of three or more persons is observed in a serious degree.

The results are shown together in Table 1.

TABLE 1

| Sample | Fluorine Compound (weight ratio) | Coating Streak | Coating Unevenness | Staining of Photo-sensitive Material | Remarks |
|---|---|---|---|---|---|
| 001 | F-1/F-2/F-3/F-4 | 6 | Δ | Δ | Comparison |
| 002 | F-2 | 11 | X | Δ | Comparison |
| 003 | F-4 | 8 | X | Δ | Comparison |
| 004 | FS-6 | 3 | ○ | ○ | Invention |
| 005 | FS-8 | 0 | ◎ | ○ | Invention |
| 006 | FS-11 | 1 | ◎ | ○ | Invention |
| 007 | FS-16 | 2 | ○ | ○ | Invention |
| 008 | FS-20 | 2 | ○ | ○ | Invention |
| 009 | FS-22 | 3 | ○ | ○ | Invention |
| 010 | FS-25 | 2 | ○ | ○ | Invention |
| 011 | FS-8/FS-25 (1/1) | 0 | ◎ | ◎ | Invention |
| 012 | FS-12/FS-26 (1/1) | 0 | ○ | ◎ | Invention |
| 013 | F-5/F-6/F-7/F-8 | 5 | Δ | Δ | Comparison |
| 014 | F-6 | 9 | X | Δ | Comparison |
| 015 | F-7 | 7 | X | Δ | Comparison |
| 016 | FS-3 | 2 | ○ | ○ | Invention |
| 017 | FS-7 | 1 | ◎ | ○ | Invention |
| 018 | FS-9 | 0 | ◎ | ○ | Invention |
| 019 | FS-10 | 0 | ◎ | ○ | Invention |
| 020 | FS-12 | 0 | ◎ | ○ | Invention |
| 021 | FS-15 | 1 | ○ | ○ | Invention |
| 022 | FS-25 | 2 | ○ | ○ | Invention |
| 023 | FS-9/FS-25 (1/1) | 0 | ◎ | ◎ | Invention |
| 024 | FS-11/FS-26 (1/1) | 0 | ○ | ◎ | Invention |

It is apparent from Table 1 that by using the ine compound of the present invention, the coating streak, the coating unevenness and the staining of photosensitive material can be remarkably improved. In particular, it is preferred to use two or more fluorine compounds of the present invention in combination.

EXAMPLE 2

(Preparation of PET Support)

PET having an intrinsic viscosity IV of 0.66 (measured in phenol/tetrachloroethane=6/4 (by weight) at 25° C.) was obtained in a usual manner using terephthalic acid and ethylene glycol. The resulting PET was pelletized and the pellets obtained were dried at 130° C. for 4 hours, melted at 300° C., extruded from a T-die and then quenched to prepare an unstretched film having a thickness large enough to give a thickness of 175 μm after the heat setting.

This film was stretched to 3.3 times in the machine direction using rolls different in the peripheral speed and then stretched to 4.5 times in the cross direction by a tenter. At this time, the temperatures were 110° C. and 130° C., respectively. Subsequently, the film was heat set at 240° C. for 20 seconds and relaxed by 4% in the cross direction at the same temperature. Thereafter, the chuck part of the tenter was slit, both edges of the film were knurled, and the film was taken up at 4 kg/cm$^2$ to obtain a roll having a thickness of 175 μm.

(Surface Corona Treatment)

Both surfaces of the support were treated at room temperature at 20 m/min using a solid state corona treating machine "Model 6 KVA" (manufactured by Pillar Technologies). From the current and voltage read at this time, it was known that a treatment of 0.375 kV·A·min/m$^2$ was applied to the support. The treatment frequency here was 9.6 kHz and the gap clearance between the electrode and the dielectric roll was 1.6 mm.

(Preparation of Undercoated Support)

(1) Preparation of Coating Solution for Undercoat Layer Formulation (1) (for Undercoat Layer in the Photosensitive Layer Side):

| | |
|---|---|
| "PESRESIN A-520" (30 wt % solution) produced by Takamatsu Yushi K.K. | 59 g |
| Polyethylene glycol monononylphenyl ether (average ethylene oxide number: 8.5), 10 wt % solution | 5.4 g |
| "MP-1000" (fine polymer particles, average particle size: 0.4 μm) produced by Soken Kagaku K.K. | 0.91 g |
| Distilled water | 935 ml |

Formulation (2) (for First Layer on the Back Surface):

| | |
|---|---|
| Styrene/butadiene copolymer latex (solid content: 40 wt %, styrene/butadiene weight ratio: 68/32) | 158 g |
| 2,4-Dichloro-6-hydroxy-S-triazine sodium salt, 8 wt % aqueous solution | 20 g |
| 1 Wt % aqueous solution of sodium laurylbenzenesulfonate | 10 ml |
| Distilled water | 854 ml |

Formulation (3) (for Second Layer on the Back Surface):

| | |
|---|---|
| $SnO_2$/SbO (9/1 by weight, average particle size: 0.038 μm, 17 wt % dispersion) | 84 g |
| Gelatin (10 wt % aqueous solution) | 89.2 g |
| "METROSE TC-5" (2 wt % aqueous solution) produced by Shin-Etsu Chemical Co., Ltd. | 8.6 g |
| "MP-1000" produced by Soken Kagaku K.K. | 0.01 g |
| 1 Wt % aqueous solution of sodium dodecylbenzenesulfonate | 10 ml |
| NaOH (1 wt %) | 6 ml |
| "PROXEL" (produced by ICI) | 1 ml |
| Distilled water | 805 ml |

Both surfaces of the 175 μm-thick biaxially stretched polyethylene terephthalate support obtained above each was subjected to the above-described corona discharge treatment and on one surface (photosensitive layer surface), the undercoating solution of formulation (1) was applied by a wire bar to have a wet coated amount of 6.6 ml/m$^2$ (per one surface) and dried at 180° C. for 5 minutes. Thereafter, on the opposite surface thereof (back surface), the undercoating solution of formulation (2) was applied by a wire bar to have a wet coated amount of 5.7 ml/m$^2$ and dried at 180° C. for 5 minutes. On the opposite surface (back surface), the undercoating solution of formulation (3) was further applied by a wire bar to have a wet coated amount of 7.7 ml/m$^2$ and dried at 180° C. for 6 minutes, thereby obtaining an undercoated support.

(Preparation of Coating Solution for Back Surface)

(Preparation of Solid Fine Particle Dispersion (a) of Base Precursor)

Base Precursor Compound 1 (64 g), 28 g of diphenylsulfone and 10 g of surfactant "Demol N" (produced by Kao Corporation) were mixed with 220 ml of distilled water. The mixed solution was dispersed using beads in a sand mill (¼ Gallon Sand Grinder Mill, manufactured by AIMEX K. K.) to obtain Solid Fine Particle Dispersion (a) of Base Precursor Compound, having an average particle size of 0.2 μm.

(Preparation of Solid Fine Particle Dispersion of Dye)

Cyanine Dye Compound 1 (9.6 g) and 5.8 g of sodium p-dodecylbenzenesulfonate were mixed with 305 ml of distilled water and the mixed solution was dispersed using beads in a sand mill (¼ Gallon Sand Grinder Mill, manufactured by AIMEX K. K.) to obtain a solid fine particle dispersion of dye, having an average particle size of 0.2 μm.

(Preparation of Coating Solution for Antihalation Layer)

Gelatin (17 g), 9.6 g of polyacrylamide, 56 g of Solid Fine Particle Dispersion (a) of Base Precursor obtained above, 50 g of the solid fine particle dispersion of dye obtained above, 1.5 g of monodisperse polymethyl methacrylate fine particles (average particle size: 8 μm, standard deviation of particle size: 0.4), 0.03 g of benzoisothiazolinone, 2.2 g of sodium polyethylenesulfonate, 0.1 g of Blue Dye Compound 1, 0.1 g of Yellow Dye Compound 1 and 844 ml of water were mixed to prepare a coating solution for antihalation layer.

(Preparation of Coating Solution for Protective Layer on Back Surface)

In a container kept at 40° C., 50 g of gelatin, 0.2 g of sodium polystyrenesulfonate, 2.4 g of N,N-ethylene-bis (vinylsulfonacetamide), 1 g of sodium tert-octylphenoxyethoxyethanesulfonate, 30 mg of benzoisothiazolinone, 37 mg of Fluorine-Containing Surfactant (F-1) (N-perfluorooctylsulfonyl-N-propylalanine potassium salt), 150 mg of Fluorine-Containing Surfactant (F-2) (polyethylene glycol mono(N-perfluorooctylsulfonyl-N-propyl-2-aminoethyl) ether [ethylene oxide average polymerization degree: 15]), 64 mg of Fluorine-Containing Surfactant (F-3), 32 mg of Fluorine-Containing Surfactant (F-4), 8.8 g of an acrylic acid/ethyl acrylate copolymer (copolymerization weight ratio: 5/95), 0.6 g of "Aerosol OT" (produced by American Cyanamide), 1.8 g of liquid paraffin emulsion as liquid paraffin and 950 ml of water were mixed to prepare a coating solution for protective layer on the back surface.

(Preparation of Silver Halide Emulsion)

<Preparation of Silver Halide Emulsion 1>

A solution was prepared by adding 3.1 ml of a 1 wt % potassium bromide solution, 3.5 ml of sulfuric acid in a concentration of 0.5 mol/L and 31.7 g of phthalated gelatin to 1,421 ml of distilled water and while stirring the solution in a stainless steel-made reaction pot and thereby keeping the liquid temperature at 42° C., the entire amount of Solution A prepared by diluting 22.22 g of silver nitrate with distilled water to a volume of 95.4 ml and the entire amount of Solution B prepared by diluting 15.3 g of potassium bromide and 0.8 g of potassium iodide with distilled water to a volume of 97.4 ml were added at a constant flow rate over 45 seconds. Thereto, 10 ml of an aqueous 3.5 wt % hydrogen peroxide solution was added and then, 10.8 ml of a 10 wt % aqueous solution of benzimidazole was further added. Thereafter, the entire amount of Solution C prepared by diluting 51.86 g of silver nitrate with distilled water to a volume of 317.5 ml and the entire amount of Solution D obtained by diluting 44.2 g of potassium bromide and 2.2 g of potassium iodide with distilled water to a volume of 400 ml were added. Here, Solution C was added at a constant flow rate over 20 minutes and Solution D was added by the controlled double jet method while maintaining the pAg at 8.1. Ten minutes after the initiation of addition of Solution C and Solution D, the entire amount of potassium hexachloroiridate(III) was added to a concentration of $1\times10^{-4}$ mol per mol of silver. Furthermore, 5 seconds after the completion of addition of Solution C, the entire amount of an aqueous potassium hexacyanoferrate(II) solution was added to a concentration of $3\times10^{-4}$ mol per mol of silver. Then, the pH was adjusted to 3.8 using sulfuric acid in a concentration of 0.5 mol/L and after stirring was stopped, the resulting solution was subjected to precipitation/desalting/water washing. The pH was then adjusted to 5.9 using sodium hydroxide in a concentration of 1 mol/L, thereby preparing a silver halide dispersion at a pAg of 8.0.

While stirring the silver halide dispersion obtained above and thereby keeping it at 38° C., 5 ml of a methanol solution containing 0.34 wt % of 1,2-benzoisothiazolin-3-one was added and after 40 minutes, a methanol solution containing Spectral Sensitizing Dye A and Spectral Sensitizing Dye B at a molar ratio of 1:1 was added in an amount, as a total of Sensitizing Dye A and Sensitizing Dye B, of $1.2\times10^{-3}$ mol per mol of silver. After 1 minute, the temperature was elevated to 47° C. and 20 minutes after the elevation of temperature, a methanol solution of sodium benzenethiosulfonate was added in an amount of $7.6\times10^{-5}$ mol per mol of silver. After 5 minutes, a methanol solution of Tellurium Sensitizer B was further added in an amount of $2.9\times10^{-4}$ mol per mol of silver and then, the solution was ripened for 91 minutes. Thereto, 1.3 ml of a 0.8 wt % methanol solution of N,N'-dihydroxy-N"-diethylmelamine was added and after 4 minutes, a methanol solution of 5-methyl-2-mercaptobenzimidazole and a methanol solution of 1-phenyl-2-heptyl-5-mercapto-1,3,4-triazole were added in an amount of $4.8\times10^{-3}$ mol and $5.4\times10^{-3}$ mol, respectively, per mol of silver to prepare Silver Halide Emulsion 1.

The grains in the thus-prepared silver halide emulsion were silver iodobromide grains having an average equivalent-sphere diameter of 0.042 μm and a coefficient of variation in the equivalent-sphere diameter of 20% and uniformly containing 3.5 mol % of iodide. The grain size and the like were determined as an average of 1,000 grains using an electron microscope. The percentage of [100] faces in this grain was 80% as determined using the Kubelka-Munk equation.

<Preparation of Silver Halide Emulsion 2>

Silver Halide Emulsion 2 was prepared in the same manner as in the preparation of Silver Halide Emulsion 1 except that the liquid temperature at the grain formation was changed from 30° C. to 47° C., Solution B was obtained by diluting 15.9 g of potassium bromide with distilled water to a volume of 97.4 ml, Solution D was obtained by diluting 45.8 g of potassium bromide with distilled water to a volume of 400 ml, the addition time of Solution C was changed to 30 minutes and potassium hexacyanoferrate(II) was excluded. Also, precipitation/desalting/water washing/dispersion were performed in the same manner as in the preparation of Silver Halide Emulsion 1. Thereafter, spectral sensitization, chemical sensitization and addition of 5-methyl-2-mercaptobenzimidazole and 1-phenyl-2-heptyl-5-mercapto-1,3,4-triazole were performed in the same manner as in the preparation of Emulsion 1 except that the amount added of the methanol solution containing Spectral Sensitizing Dye A and Spectral Sensitizing Dye B at a molar ratio of 1:1 was changed, as a total of Sensitizing Dye A and Sensitizing Dye B, to $7.5\times10^{-4}$ mol per mol of silver, the amount of Tellurium Sensitizer B added was changed to $1.1\times10^{-4}$ mol per mol of silver, and the amount of 1-phenyl-2-heptyl-5-mercapto-1,3,4-triazole added was changed to $3.3\times10^{-3}$ mol per mol of silver. Thus, Silver Halide Emulsion 2 was obtained. The emulsion grains of Silver Halide Emulsion 2 were pure silver bromide cubic grains having an average equivalent-sphere diameter of 0.080 μm and a coefficient of variation in the equivalent-sphere diameter of 20%.

<Preparation of Silver Halide Emulsion 3>

Silver Halide Emulsion 3 was prepared in the same manner as in the preparation of Silver Halide Emulsion 1 except that the liquid temperature at the grain formation was changed from 30° C. to 27° C. Also, precipitation/desalting/water washing/dispersion were performed in the same manner as in the preparation of Silver Halide Emulsion 1. Thereafter, Silver Halide Emulsion 3 was obtained in the same manner as Emulsion 1 except that a solid dispersion (aqueous gelatin solution) containing Spectral Sensitizing Dye A and Spectral Sensitizing Dye B at a molar ratio of 1:1 was added in an amount, as a total of Sensitizing Dye A and Sensitizing Dye B, of $6\times10^{-3}$ mol per mol of silver and the amount of Tellurium Sensitizer B added was changed to $5.2\times10^{-4}$ mol per mol of silver. The emulsion grains of Silver Halide Emulsion 3 were silver iodobromide grains having an average equivalent-sphere diameter of 0.034 μm and a coefficient of variation in the equivalent-sphere diameter of 20% and uniformly containing 3.5 mol % of iodide.

<Preparation of Mixed Emulsion A for Coating Solution>

70 Wt % of Silver Halide Emulsion 1, 15 wt % of Silver Halide Emulsion 2 and 15 wt % of Silver Halide Emulsion 3 were dissolved and thereto, a 1 wt % aqueous solution of benzothiazolium iodide was added in an amount of $7\times10^{-3}$ mol per mol of silver. Furthermore, water was added to adjust the silver halide content to 38.2 g in terms of silver per kg of the mixed emulsion for coating solution.

<Preparation of Fatty Acid Silver Salt Dispersion>

Behenic acid (87.6 kg, "Edenor C22-85R", trade name, produced by Henkel Co.), 423 L of distilled water, 49.2 L of an aqueous NaOH solution in a concentration of 5 mol/L, and 120 L of tert-butyl alcohol were mixed. The mixture was reacted by stirring at 75° C. for one hour to obtain a sodium behenate solution. Separately, 206.2 L (pH 4.0) of an aqueous solution containing 40.4 kg of silver nitrate was prepared and kept at 10° C. A reactor containing 635 L of distilled water and 30 L of tert-butyl alcohol was kept at 30° C. and while thoroughly stirring, the entire amount of the sodium behenate solution obtained above and the entire amount of the aqueous silver nitrate solution prepared above were added at constant flow rates over the period of 93 minutes and 15 seconds and the period of 90 minutes, respectively. At this time, only the aqueous silver nitrate solution was added for the period of 11 minutes after the initiation of addition of the aqueous silver nitrate solution, then addition of the sodium behenate solution was started, and only the sodium behenate solution was added for the period of 14 minutes and 15 second after the completion of addition of the aqueous silver nitrate solution. During the addition, the temperature inside the reactor was kept at 30° C. and the outer temperature was controlled to make constant the liquid temperature. The piping in the system of adding the sodium behenate solution was kept warm by circulating hot water in the outer side of a double pipe, whereby the outlet liquid temperature at the distal end of the addition nozzle was adjusted to 75° C. The piping in the system of adding the aqueous silver nitrate solution was kept warm by circulating cold water in the outer side of a double pipe. The addition site of sodium behenate solution and the addition site of aqueous silver nitrate solution were symmetrically arranged centered around the stirring axis. Also, these addition sites were each adjusted to a height of not causing contact with the reaction solution.

After the completion of addition of the sodium behenate solution, the mixture was left at that temperature for 20 minutes with stirring. The temperature was then elevated to 35° C. over 30 minutes and the solution was ripened for 210 minutes. Immediately after the completion of ripening, the solid content was separated by centrifugal filtration and washed with water until the conductivity of filtrate became 30 μS/cm. In this manner, a fatty acid silver salt was obtained. The solid content obtained was not dried but stored as a wet cake.

The shape of the thus-obtained silver behenate grains was analyzed by electron microphotography. The grains were scaly crystals having average sizes of a=0.14 μm, b=0.4 μm and c=0.6 μm, an average aspect ratio of 5.2, an average equivalent-sphere diameter of 0.52 μm and a coefficient of variation in the equivalent-sphere diameter of 15% (a, b and c comply with the definition in this specification).

To the wet cake corresponding to 260 Kg as a dry solid content, 19.3 Kg of polyvinyl alcohol ("PVA-217", trade name) and water were added to make a total amount of 1,000 Kg. The resulting mixture was made into a slurry by a dissolver blade and the slurry was preliminarily dispersed by a pipeline mixer ("Model PM-10", manufactured by Mizuho Kogyo).

Then, the preliminarily dispersed stock solution was treated three times in a dispersing machine ("Microfluidizer M-610", trade name, manufactured by Microfluidex International Corporation, using a Z-type interaction chamber) under the control of pressure to 1,260 kg/cm$^2$ to obtain a silver behenate dispersion. At the dispersion, the temperature was set to 18° C. by a cooling operation of controlling the temperature of coolant using coiled heat exchangers attached to the inlet side and outlet side of the interaction chamber.

(Preparation of Reducing Agent Dispersion)

<Preparation of Reducing Agent Complex 1 Dispersion>

To 10 kg of Reducing Agent Complex 1 (a 1:1 complex of 6,6'-di-tert-butyl-4,4'-dimethyl-2,2'-butylidenediphenol and triphenylphosphine oxide), 0.12 Kg of triphenylphosphine oxide and 16 Kg of a 10 wt % aqueous solution of modified polyvinyl alcohol ("Poval MP203", produced by Kuraray Co., Ltd.), 10 Kg of water was added and thoroughly mixed to form a slurry. This slurry was transferred by a diaphragm pump and dispersed in a horizontal sand mill ("UVM-2", manufactured by AIMEX K. K.) filled with zirconia beads having an average diameter of 0.5 mm for 4 hours and 30 minutes. Thereafter, 0.2 g of benzoisothiazolinone sodium salt and water were added to adjust the reducing agent concentration to 22 wt %, thereby obtaining Reducing Agent Complex 1 Dispersion. The reducing agent complex particles contained in the thus-obtained reducing agent complex dispersion had a median diameter of 0.45 μm and a maximum particle size of 1.4 μm or less. The obtained reducing agent complex dispersion was filtered through a polypropylene-made filter having a pore size of 3.0 μm to remove foreign matters such as dust and then housed.

<Preparation of Reducing Agent 2 Dispersion>

To 10 kg of Reducing Agent 2 (6,6'-di-tert-butyl-4,4'-dimethyl-2,2'-butylidenediphenol) and 16 Kg of a 10 wt % aqueous solution of modified polyvinyl alcohol ("Poval MP203", produced by Kuraray Co., Ltd.), 10 Kg of water was added and thoroughly mixed to form a slurry. This slurry was transferred by a diaphragm pump and dispersed in a horizontal sand mill ("UVM-2", manufactured by AIMEX K. K.) filled with zirconia beads having an average diameter of 0.5 mm for 3 hours and 30 minutes. Thereafter, 0.2 g of benzoisothiazolinone sodium salt and water were added to adjust the reducing agent concentration to 25 wt %, thereby obtaining Reducing Agent 2 Dispersion. The reducing agent particles contained in the thus-obtained reducing agent dispersion had a median diameter of 0.40 μm and a maximum particle size of 1.5 μm or less. The obtained reducing agent dispersion was filtered through a polypropylene-made filter having a pore size of 3.0 μm to remove foreign matters such as dust and then housed.

<Preparation of Hydrogen Bond-Forming Compound 1 Dispersion>

To 10 Kg of Hydrogen Bond-Forming Compound 1 (tri(4-tert-butylphenyl)phosphine oxide) and 16 Kg of a 10 wt % aqueous solution of modified polyvinyl alcohol ("Poval MP203", produced by Kuraray Co., Ltd.), 10 Kg of water was added and thoroughly mixed to form a slurry. The resulting slurry was transferred by a diaphragm pump and dispersed in a horizontal sand mill ("UVM-2", manufactured by AIMEX K. K.) filled with zirconia beads having an average diameter of 0.5 mm for 3 hours and 30 minutes. Thereafter, 0.2 g of benzoisothiazolinone sodium salt and water were added to adjust the hydrogen bond-forming compound concentration to 25 wt %, thereby obtaining Hydrogen Bond-Forming Compound 1 Dispersion. The hydrogen bond-forming compound particles contained in the thus-obtained hydrogen bond-forming compound dispersion had a median diameter of 0.35 μm and a maximum particle size of 1.5 μm or less. The obtained hydrogen bond-forming compound dispersion was filtered through a polypropylene-made filter having a pore size of 3.0 μm to remove foreign matters such as dust and then housed.

<Preparation of Development Accelerator 1 Dispersion>

To 10 Kg of Development Accelerator 1 and 20 Kg of a 10 wt % aqueous solution of modified polyvinyl alcohol ("Poval MP203", produced by Kuraray Co., Ltd.), 10 Kg of water was added and thoroughly mixed to form a slurry. The resulting slurry was transferred by a diaphragm pump and dispersed in a horizontal sand mill ("UVM-2", manufactured by AIMEX K. K.) filled with zirconia beads having an average diameter of 0.5 mm for 3 hours and 30 minutes. Thereafter, 0.2 g of benzoisothiazolinone sodium salt and water were added to adjust the development accelerator concentration to 20 wt %, thereby obtaining Development Accelerator 1 Dispersion. The development accelerator particles contained in the thus-obtained development accelerator dispersion had a median diameter of 0.48 μm and a maximum particle size of 1.4 μm or less. The obtained development accelerator dispersion was filtered through a polypropylene-made filter having a pore size of 3.0 μm to remove foreign matters such as dust and then housed.

Solid Dispersions of Development Accelerator 2, Development Accelerator 3 and Color Tone Adjuster 1 each was obtained as a 20 wt % dispersion in the same manner as Development Accelerator 1.

(Preparation of Polyhalogen Compound)

<Preparation of Organic Polyhalogen Compound 1 Dispersion>

To 10 Kg of Organic Polyhalogen Compound 1 (tribromomethanesulfonylbenzene), 10 Kg of a 20 wt % aqueous solution of modified polyvinyl alcohol ("Poval MP203", produced by Kuraray Co., Ltd.) and 0.4 Kg of a 20 wt % aqueous solution of sodium triisopropylnaphthalenesulfonate, 14 Kg of water was added and thoroughly mixed to form a slurry. The resulting slurry was transferred by a diaphragm pump and dispersed in a horizontal sand mill ("UVM-2", manufactured by AIMEX K. K.) filled with zirconia beads having an average diameter of 0.5 mm for 5 hours. Thereafter, 0.2 g of benzoisothiazolinone sodium salt and water were added to adjust the organic polyhalogen compound concentration to 26 wt %, thereby obtaining Organic Polyhalogen Compound 1 Dispersion. The organic polyhalogen compound particles contained in the thus-obtained organic polyhalogen compound dispersion had a median diameter of 0.41 μm and a maximum particle size of 2.0 μm or less. The obtained organic polyhalogen compound dispersion was filtered through a polypropylene-made filter having a pore size of 10.0 μM to remove foreign matters such as dust and then housed.

<Preparation of Organic Polyhalogen Compound 2 Dispersion>

To 10 Kg of Organic Polyhalogen Compound 2 (N-butyl-3-tribromomethanesulfonylbenzamide) and 20 Kg of a 10 wt % aqueous solution of modified polyvinyl alcohol ("Poval MP203", produced by Kuraray Co., Ltd.), 0.4 Kg of a 20 wt % aqueous solution of sodium triisopropylnaphthalenesulfonate was added and thoroughly mixed to form a slurry. The resulting slurry was transferred by a diaphragm pump and dispersed in a horizontal sand mill ("UVM-2", manufactured by AIMEX K. K.) filled with zirconia beads having an average diameter of 0.5 mm for 5 hours. Thereafter, 0.2 g of benzoisothiazolinone sodium salt and water were added to adjust the organic polyhalogen compound concentration to 30 wt %. This dispersion solution was heated at 40° C. for 5 hours, whereby Organic Polyhalogen Compound 2 Dispersion was obtained. The organic polyhalogen compound particles contained in the thus-obtained polyhalogen compound dispersion had a median diameter of 0.40 μm and a maximum particle size of 1.3 μm or less. The obtained organic polyhalogen compound dispersion was filtered through a polypropylene-made filter having a pore size of 3.0 μm to remove foreign matters such as dust and then housed.

<Preparation of Phthalazine Compound 1 Solution>

In 174.57 Kg of water, 8 Kg of modified polyvinyl alcohol "MP203" produced by Kuraray Co., Ltd. was dissolved. Thereto, 3.15 Kg of a 20 wt % aqueous solution of sodium triisopropylnaphthalenesulfonate and 14.28 Kg of a 70 wt % aqueous solution of Phthalazine Compound 1 (6-isopropylphthalazine) were added to prepare a 5 wt % solution of Phthalazine Compound 1.

(Preparation of Mercapto Compound)

<Preparation of Aqueous Mercapto Compound 1 Solution>

In 993 g of water, 7 g of Mercapto Compound 1 (1-(3-sulfophenyl)-5-mercaptotetrazole sodium salt) was dissolved to prepare a 0.7 wt % aqueous solution.

<Preparation of Aqueous Mercapto Compound 2 Solution>

In 980 g of water, 20 g of Mercapto Compound 2 (1-(3-methylureido)-5-mercaptotetrazole sodium salt) was dissolved to prepare a 2.0 wt % aqueous solution.

<Preparation of Pigment 1 Dispersion>

To 64 g of C.I. Pigment Blue 60 and 6.4 g of "Demol N" (produced by Kao Corporation), 250 g of water was added and thoroughly mixed to form a slurry. The resulting slurry and 800 g of zirconia beads having an average diameter of 0.5 mm were put together into a vessel and dispersed for 25 hours in a dispersing machine (¼G Sand Grinder Mill, manufactured by AIMEX K. K.) to obtain Pigment 1 Dispersion. The pigment particles contained in the thus-obtained pigment dispersion had an average particle size of 0.21 μm.

<Preparation of SBR Latex Solution>

An SBR latex having a Tg of 22° C. was prepared as follows.

Using ammonium persulfate as a polymerization initiator and an anionic surfactant as an emulsifier, 70.0 weight of styrene, 27.0 weight of butadiene and 3.0 weight of acrylic acid were emulsion-polymerized. After aging at 80° C. for 8 hours, the resulting solution was cooled to 40° C. and adjusted to a pH of 7.0 with aqueous ammonia. Thereto, "SANDET BL" (produced by Sanyo Kasei K. K.) was added to have a concentration of 0.22%. Thereafter, the pH was adjusted to 8.3 by adding an aqueous 5% sodium hydroxide solution and then, the pH was adjusted to 8.4 with aqueous ammonia. The molar ratio of $Na^+$ ion and $NH_4^+$ ion used here was 1:2.3. To 1 Kg of this solution, 0.15 ml of a 7% aqueous solution of benzoisothiazolinone sodium salt was added to prepare an SBR latex solution.

(SBR Latex: Latex of -St(70.0)-Bu(27.0)-AA(3.0)-):

Tg: 22° C.

Average particle size: 0.1 μm, concentration: 43 wt %, equilibrium moisture content at 25° C. and 60% RH: 0.6 wt %, ion conductivity: 4.2 mS/cm (in the measurement of ion conductivity, the latex stock solution (43 wt %) was measured at 25° C. using a conductivity meter "CM-30S" (manufactured by Toa Denpa Kogyo K. K.)), pH: 8.4.

SBR latexes different in the Tg can be prepared in the same manner by appropriately changing the ratio of styrene and butadiene.

<Preparation of Coating Solution 1 for Emulsion Layer (Photosensitive Layer)>

The fatty acid silver salt dispersion prepared above (1,000 g), 276 ml of water, 33.2 g of Pigment 1 Dispersion, 21 g of Organic Polyhalogen Compound 1 Dispersion, 58 g of Organic Polyhalogen Compound 2 Dispersion, 150 g of Phthalazine Compound 1 Solution, 1,082 g of SBR latex (Tg: 22° C.) solution, 299 g of Reducing Agent Complex 1 Dispersion, 6 g of Development Accelerator 1 Dispersion, 9 ml of Aqueous Mercapto Compound 1 Solution and 13 ml of Aqueous Mercapto Compound 2 Solution were sequentially added. Immediately before the coating, 117 g of Silver Halide Mixed Emulsion A was added and thoroughly mixed. The resulting coating solution for emulsion layer was transferred as it was to a coating die and coated.

The viscosity of the coating solution for emulsion layer obtained above was measured by a Brookfield viscometer manufactured by Tokyo Keiki Kogyo K. K. and found to be 25 [mPa·s] at 40° C. (No. 1 rotor, 60 rpm).

The viscosity of the coating solution measured at 25° C. using "RFS Field Spectrometer" (manufactured by Rheometrics Far East K. K.) was 230, 60, 46, 24 and 18 [mPa·s] at a shear rate of 0.1, 1, 10, 100 and 1,000 [1/sec], respectively.

The amount of zirconium in the coating solution was 0.38 mg per g of silver.

<Preparation of Coating Solution 2 for Emulsion Layer (Photosensitive Layer)>

The fatty acid silver salt dispersion prepared above (1,000 g), 276 ml of water, 32.8 g of Pigment 1 Dispersion, 21 g of Organic Polyhalogen Compound 1 Dispersion, 58 g of Organic Polyhalogen Compound 2 Dispersion, 173 g of Phthalazine Compound 1 Solution, 1,082 g of SBR latex (Tg: 20° C.) solution, 155 g of Reducing Agent 2 Dispersion, 55 g of Hydrogen Bond-Forming Compound 1 Dispersion, 6 g of Development Accelerator 1 Dispersion, 1 g of Development Accelerator 2 Dispersion, 6 g of Development Accelerator 3 Dispersion, 2 g of Color Tone Adjuster 1 Dispersion and 6 ml of Aqueous Mercapto Compound 2 Solution were sequentially added. Immediately before the coating, 117 g of Silver Halide Mixed Emulsion A was added and thoroughly mixed. The resulting coating solution for emulsion layer was transferred as it was to a coating die and coated.

The viscosity of the coating solution for emulsion layer obtained above was measured by a Brookfield viscometer manufactured by Tokyo Keiki Kogyo K. K. and found to be 40 [mPa·s] at 40° C. (No. 1 rotor, 60 rpm).

The viscosity of the coating solution measured at 25° C. using "RFS Field Spectrometer" (manufactured by Rheometrics Far East K. K.) was 530, 144, 96, 51 and 28 [mPa·s] at a shear rate of 0.1, 1, 10, 100 and 1,000 [1/sec], respectively.

The amount of zirconium in the coating solution was 0.25 mg per g of silver.

<Preparation of Coating Solution for Interlayer on Emulsion Surface>

A 5 wt % aqueous solution (27 ml) of "Aerosol OT" (produced by American Cyanamide), 135 ml of a 20 wt % aqueous solution of diammonium phthalate and water for making a total amount of 10,000 g were added to 1,000 g of polyvinyl alcohol "PVA-205" (produced by Kuraray Co., Ltd.), 272 g of a 5 wt % pigment dispersion and 4,200 ml of a 19 wt % solution of methyl methacrylate/styrene/butyl acrylate/hydroxyethyl methacrylate/acrylic acid copolymer (copolymerization weight ratio: 64/9/20/5/2) latex. The pH was adjusted to 7.5 with NaOH to prepare a coating solution for interlayer and then the coating solution for interlayer was transferred to a coating die to give a coverage of 9.1 ml/m$^2$ The viscosity of the coating solution was measured at 40° C. by a Brookfield viscometer (No. 1 rotor, 60 rpm) and found to be 58 [mPa·s].

<Preparation of Coating Solution for First Protective Layer on Emulsion Surface>

In water, 64 g of inert gelatin was dissolved. Thereto, 80 g of a 27.5 wt % solution of methyl methacrylate/styrene/butyl acrylate/hydroxyethyl methacrylate/acrylic acid copolymer (copolymerization weight ratio: 64/9/20/5/2) latex, 23 ml of a 10 wt % methanol solution of phthalic acid, 23 ml of a 10 wt % aqueous solution of 4-methylphthalic acid, 28 ml of sulfuric acid in a concentration of 0.5 mol/L, 5 ml of a 5 wt % aqueous solution of "Aerosol OT" (produced by American Cyanamide), 0.5 g of phenoxyethanol, 0.1 g of benzoisothiazolinone and water for making a total amount of 750 g were added to prepare a coating solution. Immediately before the coating, 26 ml of a 4 wt % chrome alum was mixed using a static mixer. Then, the coating solution was transferred to a coating die to give a coverage of 18.6 ml/m$^2$.

The viscosity of the coating solution was measured by a Brookfield viscometer at 40° C. (No. 1 rotor, 60 rpm) and found to be 20 [mPa·s].

<Preparation of Coating Solution for Second Protective Layer on Emulsion Surface>

In water, 80 g of inert gelatin was dissolved. Thereto, 102 g of a 27.5 wt % solution of methyl methacrylate/styrene/butyl acrylate/hydroxyethyl methacrylate/acrylic acid copolymer (copolymerization weight ratio: 64/9/20/5/2) latex, 3.2 ml of a 5 wt % solution of Fluorine-Containing Surfactant (F-1) (N-perfluorooctylsulfonyl-N-propylalanine potassium salt), 32 ml of a 2 wt % aqueous solution of Fluorine-Containing Surfactant (F-2) (polyethylene glycol mono(N-perfluorooctylsulfonyl-N-propyl-2-aminoethyl ether [ethylene oxide average polymerization degree: 15]), 23 ml of a 5 wt % solution of "Aerosol OT" (produced by American Cyanamide), 4 g of polymethyl methacrylate fine particles (average particle size: 0.7 μm), 21 g of polymethyl methacrylate fine particles (average particle size: 4.5 μm), 1.6 g of 4-methylphthalic acid, 4.8 g of phthalic acid, 44 ml of sulfuric acid in a concentration of 0.5 mol/L, 10 mg of benzoisothiazolinone and water for making a total amount of 650 g were added. Immediately before the coating, 445 ml of an aqueous solution containing 4 wt % of chrome alum and 0.67 wt % of phthalic acid was mixed using a static mixer to obtain a coating solution for surface protective layer and then the coating solution for surface protective layer was transferred to a coating die to give a coverage of 8.3 ml/m$^2$.

The viscosity of the coating solution was measured at 40° C. by a Brookfield viscometer (No. 1 rotor, 60 rpm) and found to be 19 [mPa·s].

<Preparation of Heat-Developable Photosensitive Material 1>

In the back surface side of the undercoated support prepared above, the coating solution for antihalation layer and the coating solution for back surface protective layer were simultaneously coated one on another to give a coated amount of solid fine particle dye of 0.04 g/m$^2$ as a solid content and a gelatin coated amount of 1.7 g/m$^2$, respectively. Then, the coating was dried to form a back layer.

On the surface opposite the back surface, an emulsion layer, an interlayer, a first protective layer and a second protective layer were simultaneously coated one on another in this order from the undercoated surface by the slide bead coating method to prepare a heat-developable photosensitive material sample. At this time, the temperature was adjusted such that the emulsion layer and the interlayer were 31° C., the first protective layer was 36° C. and the second protective layer was 37° C.

The coated amount (g/m$^2$) of each compound in the emulsion layer is shown below.

| | |
|---|---|
| Silver behenate | 5.55 |
| Pigment (C.I. Pigment Blue 60) | 0.036 |
| Polyhalogen Compound 1 | 0.12 |
| Polyhalogen Compound 2 | 0.32 |
| Phthalazine Compound 1 | 0.15 |
| SBR Latex | 9.97 |
| Reducing Agent Complex 1 | 1.41 |
| Development Accelerator 1 | 0.024 |
| Mercapto Compound 1 | 0.002 |
| Mercapto Compound 2 | 0.006 |
| Silver Halide (as Ag) | 0.091 |

The coating and drying conditions were as follows.

The coating was performed at a speed of 160 m/min, the distance between the tip of coating die and the support was set to from 0.10 to 0.30 mm, and the pressure in the vacuum chamber was set lower by 196 to 882 Pa than the atmospheric pressure. The support was destaticized by ionized wind before the coating.

In the subsequent chilling zone, the coating solution was cooled with air showing a dry bulb temperature of 10 to 20° C. The sample was then subjected to contact-free transportation and in a helical floating-type dryer, dried with drying air showing a dry bulb temperature of 23 to 45° C. and a wet bulb temperature of 15 to 21° C.

After drying, the humidity was adjusted to 40 to 60% RH at 25° C. and then, the layer surface was heated to 70 to 90° C. The heated layer surface was then cooled to 25° C.

The heat-developable photosensitive material thus prepared had a matting degree of, in terms of the Beck's smoothness, 550 seconds on the photosensitive layer surface and 130 seconds on the back surface. Furthermore, the pH on the layer surface in the photosensitive layer side was measured and found to be 6.0.

<Preparation of Heat-Developable Photosensitive Material 2>

Heat-Developable Photosensitive Material 2 was prepared in the same manner as Heat-Developable Photosensitive Material 1 except that in the preparation of Heat-Developable Photosensitive Material 1, Coating Solution 1 for Emulsion Layer was changed to Coating Solution 2 for Emulsion Layer, Yellow Dye Compound 15 was eliminated from the antihalation layer, and the fluorine-containing surfactants in the back surface protective layer and emulsion surface protective layer were changed from F-1, F-2, F-3 and F-4 to F-5, F-6, F-7 and F-8, respectively.

The coated amount (g/m$^2$) of each compound in this emulsion layer is shown below.

| | |
|---|---|
| Silver behenate | 5.55 |
| Pigment (C.I. Pigment Blue 60) | 0.036 |
| Polyhalogen Compound 1 | 0.12 |
| Polyhalogen Compound 2 | 0.37 |
| Phthalazine Compound 1 | 0.19 |
| SBR Latex | 9.67 |
| Reducing Agent 2 | 0.81 |
| Hydrogen Bond-Forming Compound 1 | 0.30 |
| Development Accelerator 1 | 0.024 |
| Development Accelerator 2 | 0.005 |
| Development Accelerator 3 | 0.030 |
| Color Tone Adjuster 1 | 0.010 |
| Mercapto Compound 2 | 0.002 |
| Silver Halide (as Ag) | 0.091 |

Chemical structures of the compounds used in Examples of the present invention are shown below.

Spectral Sensitizing Dye A:

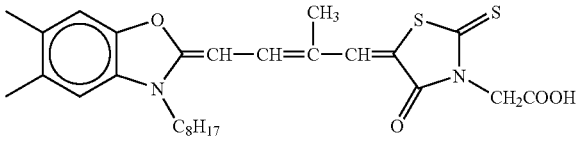

Spectral Sensitizing Dye B:

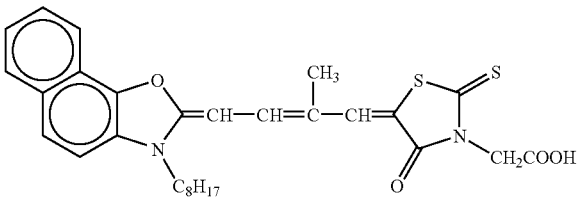

Tellurium Sensitizer C:

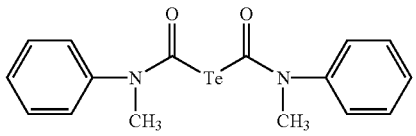

Base Precursor Compound 1:

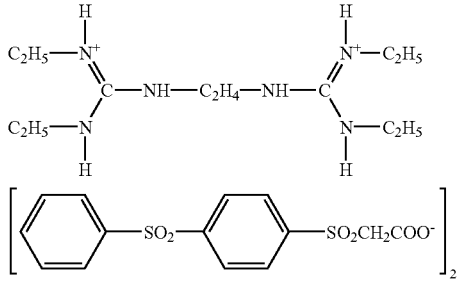

Cyanine Dye Compound 1:

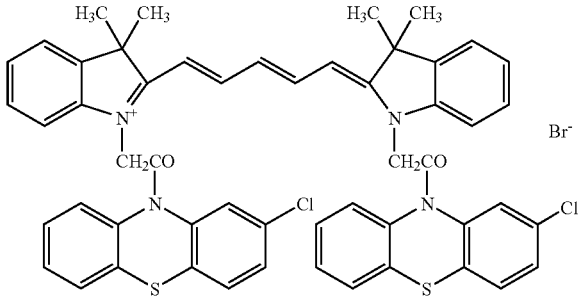

Blue Dye Compound-1:

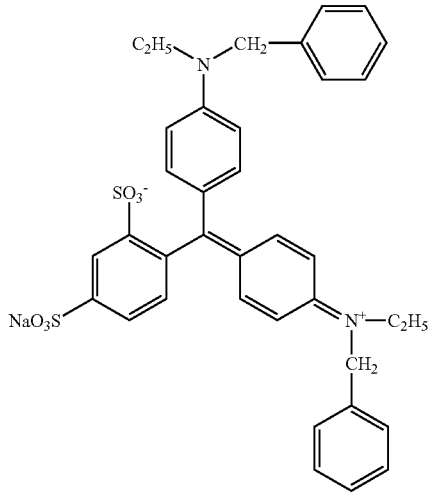

Yellow Dye Compound 1:

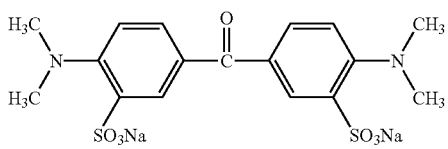

Reducing Agent Complex 1:
A 1:1 complex of
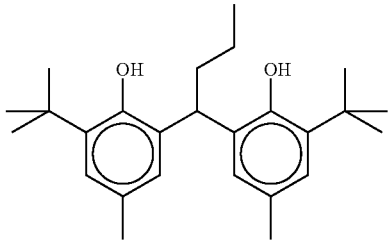
and
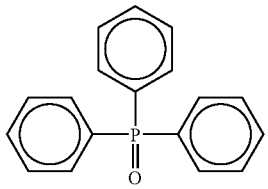
Reducing Agent 2:
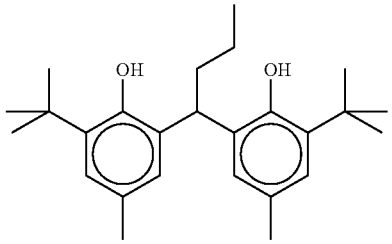
Hydrogen Bond-Forming Compound 1:
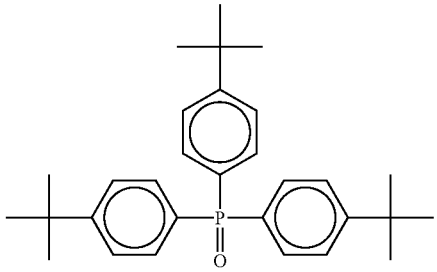
Polyhalogen Compound 1:
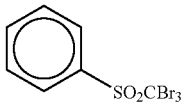
Polyhalogen Compound 2:
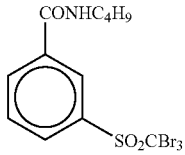
Mercapto Compound 1:
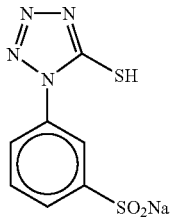
Mercapto Compound 2:
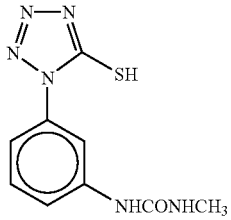
Phthalazine Compound 1:
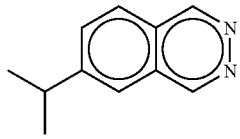
Development Accelerator 1:
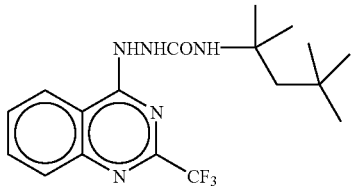

Development Accelerator 2:

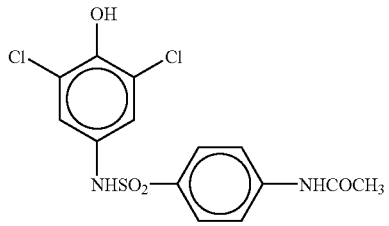

Development Accelerator 3:

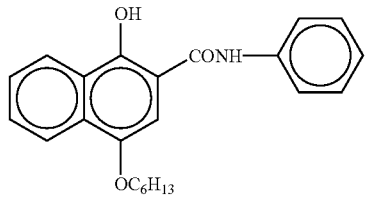

Color Tone Adjuster 1:

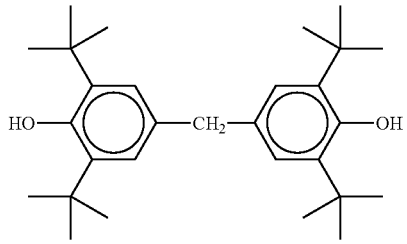

(F-1)

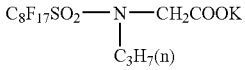

(F-2)

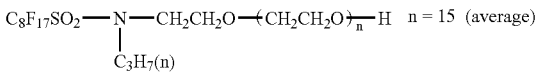

(F-3)

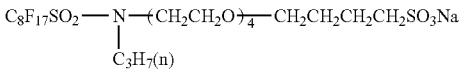

(F-4) $C_8F_{17}SO_3K$ (F-5) $CF_3(CF_2)_nCH_2CH_2SCH_2CH_2COOLi$ mixture of n=5 to 11

(F-6) $CF_3(CF_2)_nCH_2CH_2O(CH_2CH_2O)_mH$ mixture of n=5 to 11, m=5 to 15

(F-7) $CF_3(CF_2)_nCH_2CH_2SO_3Na$ mixture of n=5 to 11

(F-8) $C_6F_{13}CH_2CH_2SO_3Li$

FR-1:

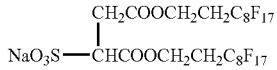

FR-2:

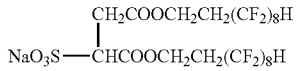

Samples 002 to 012 were prepared thoroughly in the same manner as Heat-Developable Photosensitive Material 1 (Sample 001) except that in the preparation of Sample 001, Fluorine Compounds F-1, F-2, F-3 and F-4 in the emulsion surface protective layer and the back surface protective layer were changed as shown in Table 2 to give the same total weight. Samples 014 to 024 were prepared thoroughly in the same manner as Heat-Developable Photosensitive Material 2 (Sample 013) except that in the preparation of Sample 013, Fluorine Compounds F-5, F-6, F-7 and F-8 in the emulsion surface protective layer and the back surface protective layer were changed as shown in Table 2 to give the same total weight. In the photosensitive material using two kinds of fluorine compounds of the present invention in combination, each compound was used in a half weight.

(Evaluation of Photographic Performance)

The samples obtained each was cut into a size of 356×432 mm, wrapped with the following packaging material in the environment of 25° C. and 50% RH, stored at an ordinary temperature for 2 weeks and then evaluated on the items shown below.

(Packaging Material)

Polyethylene (50 μm) containing 10 μm of PET/12 μm of PE/9 μm of aluminum foil/15 μm of Ny/3% of carbon:

oxygen permeability: 0 ml/atm·$m^2$·25° C.·day water permeability: 0 g/atm·$m^2$·25° C.·day The samples each was exposed and heat-developed (with four sheets of panel heater set at 112° C.-119° C.-121° C.-121° C., for 24 seconds in total in the case of Samples 001 to 012 and for 12 seconds in total in the case of Samples 013 to 024) in "Fuji Medical Dry Laser Imager FM-DP L" (in which a semiconductor laser of 660 nm having a maximum output of 60 mW (IIIB) was mounted). The obtained image was evaluated by a densitometer.

Each sample was subjected to uniform exposure of giving a density of 1.5 and to printing of an actual image of breast and then heat-developed for a predetermined time. The obtained samples were observed with an eye over Schaukasten and evaluated on the coated surface state.

The evaluation results are shown in Table 1. In the Table, the coating streak is shown by the number of thin streaks appeared in the coated direction of the photosensitive material and viewed low in the density as compared with the peripheral part, per the coated width of 1 m. The coating unevenness was evaluated by rating the degree of cloud-like unevenness with an eye according to the following criteria.

◎: Very good level with overall uniformity and no unevenness.

○: Slight unevenness on careful viewing but negligible.

Δ: Unevenness is seen at uniform exposure but not perceived when an image is printed.

X: Entirely uneven and even with an image, unevenness is perceived on careful viewing.

Samples each was touched by 10 persons with a hand in a room air-conditioned to a room temperature of 28° C. and a relative humidity of 75%, irradiated with light for 3 hours on Schaukasten and evaluated on the staining by a fingerprint using Schaukasten. The evaluation was shown by the following ratings.

◎: Almost negligible staining.

○: Staining by fingerprints of one or two persons is observed but in a slight degree.

Δ: Staining by fingerprints of three or more persons is observed in a serious degree.

The results are shown together in Table 2.

It is apparent from Table 2 that by using the fluorine compound of the present invention, the coating streak, the coating unevenness and the staining of photosensitive material can be remarkably improved. In particular, it is preferred to use two or more fluorine compounds of the present invention in combination.

TABLE 2

| Sample | Fluorine Compound | Coating Streak | Coating Unevenness | Staining of Photo-sensitive Material | Remarks |
|---|---|---|---|---|---|
| 001 | F-1/F-2/ F-3/F-4 | 7 | Δ | Δ | Comparison |
| 002 | F-2 | 12 | X | Δ | Comparison |
| 003 | F-4 | 9 | X | Δ | Comparison |
| 004 | FS-1 | 3 | ◎ | ○ | Invention |
| 005 | FS-2 | 2 | ◎ | ○ | Invention |
| 006 | FS-5 | 3 | ◎ | ○ | Invention |
| 007 | FS-14 | 3 | ○ | ○ | Invention |
| 008 | FS-19 | 2 | ◎ | ○ | Invention |
| 009 | FS-27 | 3 | ○ | ○ | Invention |
| 010 | FS-30 | 2 | ○ | ○ | Invention |
| 011 | FS-2/FS-27 | 1 | ◎ | ◎ | Invention |
| 012 | FR-1 | 5 | Δ | Δ | Comparison |
| 013 | F-5/F-6/ F-7/F-8 | 6 | Δ | Δ | Comparison |
| 014 | F-6 | 10 | X | Δ | Comparison |
| 015 | F-7 | 8 | X | Δ | Comparison |
| 016 | FS-1 | 2 | ◎ | ○ | Invention |
| 017 | FS-2 | 2 | ◎ | ○ | Invention |
| 018 | FS-7 | 1 | ◎ | ○ | Invention |
| 019 | FS-9 | 3 | ◎ | ○ | Invention |
| 020 | FS-13 | 3 | ○ | ○ | Invention |
| 021 | FS-20 | 1 | ◎ | ○ | Invention |
| 022 | FS-47 | 2 | ○ | ○ | Invention |
| 023 | FS-2/FS-27 | 0 | ◎ | ◎ | Invention |
| 024 | FR-2 | 5 | Δ | Δ | Comparison |

EXAMPLE 3

(Preparation of PET Support)

PET having an intrinsic viscosity IV of 0.66 (measured in phenol/tetrachloroethane=6/4 (by weight) at 25° C.) was obtained in a usual manner using terephthalic acid and ethylene glycol. The resulting PET was pelletized and the pellets obtained were dried at 130° C. for 4 hours, melted at 300° C., extruded from a T-die and then quenched to prepare an unstretched film having a thickness large enough to give a thickness of 175 μm after the heat setting.

This film was stretched to 3.3 times in the machine direction using rolls different in the peripheral speed and then stretched to 4.5 times in the cross direction by a tenter. At this time, the temperatures were 110° C. and 130° C., respectively. Subsequently, the film was heat set at 240° C. for 20 seconds and relaxed by 4% in the cross direction at the same temperature. Thereafter, the chuck part of the tenter was slit, both edges of the film were knurled, and the film was taken up at 4 kg/cm$^2$ to obtain a roll having a thickness of 175 μm.

(Surface Corona Treatment)

Both surfaces of the support were treated at room temperature at 20 m/min using a solid state corona treating machine "Model 6 KVA" (manufactured by Pillar Technologies). From the current and voltage read at this time, it was known that a treatment of 0.375 kV·A·min/m$^2$ was applied to the support. The treatment frequency here was 9.6 kHz and the gap clearance between the electrode and the dielectric roll was 1.6 mm.

(Preparation of Undercoated Support)

(1) Preparation of Coating Solution for Undercoat Layer Formulation (1) (for Undercoat Layer in the Photosensitive Layer Side):

| | |
|---|---|
| "PESRESIN A-520" (30 wt % solution) produced by Takamatsu Yushi K.K. | 59 g |
| Polyethylene glycol monononylphenyl ether (average ethylene oxide number: 8.5), 10 wt % solution | 5.4 g |
| "MP-1000" (fine polymer particles, average particle size: 0.4 μm) produced by Soken Kagaku K.K. | 0.91 g |
| Distilled water | 935 ml |

Formulation (2) (for First Layer on the Back Surface):

| | |
|---|---|
| Styrene/butadiene copolymer latex (solid content: 40 wt %, styrene/butadiene weight ratio: 68/32) | 158 g |
| 2,4-Dichloro-6-hydroxy-S-triazine sodium salt, 8 wt % aqueous solution | 20 g |
| 1 Wt % aqueous solution of sodium laurylbenzenesulfonate | 10 ml |
| Distilled water | 854 ml |

Formulation (3) (for Second Layer on the Back Surface):

| | |
|---|---|
| $SnO_2$/SbO (9/1 by weight, average particle size: 0.038 μm, 17 wt % dispersion) | 84 g |
| Gelatin (10 wt % aqueous solution) | 89.2 g |
| "METROSE TC-5" (2 wt % aqueous solution) produced by Shin-Etsu Chemical Co., Ltd. | 8.6 g |
| "MP-1000" produced by Soken Kagaku K.K. | 0.01 g |
| 1 Wt % aqueous solution of sodium dodecylbenzenesulfonate | 10 ml |
| NaOH (1 wt %) | 6 ml |
| "PROXEL" (produced by ICI) | 1 ml |
| Distilled water | 805 ml |

(Preparation of Undercoated Support)

Both surfaces of the 175 μm-thick biaxially stretched polyethylene terephthalate support obtained above each was subjected to the above-described corona discharge treatment and on one surface (photosensitive layer surface), the undercoating solution of formulation (1) was applied by a wire bar to have a wet coated amount of 6.6 ml/m$^2$ (per one surface) and dried at 180° C. for 5 minutes. Thereafter, on the opposite surface thereof (back surface), the undercoating solution of formulation (2) was applied by a wire bar to have a wet coated amount of 5.7 ml/m$^2$ and dried at 180° C. for 5 minutes. On the opposite surface (back surface), the undercoating solution of formulation (3) was further applied by a wire bar to have a wet coated amount of 7.7 ml/m$^2$ and dried at 180° C. for 6 minutes, thereby obtaining an undercoated support.

(Preparation of Coating Solution for Back Surface)

(Preparation of Solid Fine Particle Dispersion (a) of Base Precursor)

Base Precursor Compound 1 (1.5 kg), 225 g of surfactant "Demol N" (trade name, produced by Kao Corporation), 937.5 g of diphenylsulfone, 15 g of butyl parahydroxybenzoate ("Mekkins", trade name, produced by Ueno Seiyaku) and water for making a total amount of 5.0 kg were mixed. The mixed solution was dispersed using beads in a horizontal sand mill ("UVM-2", manufactured by AIMEX K. K.). In this dispersion method, the mixed solution was transferred by a diaphragm pump to "UVM-2" filled with zirconia beads having an average diameter of 0.5 mm and dispersed under an internal pressure of 50 hPa or more until a desired average particle size was obtained.

The dispersion was measured on the spectral absorption and dispersed until the absorbance ratio (D450/D650) of the absorbance at 450 nm in the spectral absorption of the dispersion to the absorbance at 650 nm became 2.2 or more. The obtained dispersion was diluted with distilled water to have a base precursor concentration of 20 wt %, filtered (through a polypropylene-made filter having an average pore size of 3 μm) to remove dusts, and used in practice.

(Preparation of Solid Fine Particle Dispersion of Dye)

Cyanine Dye Compound 1 (6.0 kg), 3.0 kg of sodium p-dodecylbenzenesulfonate, 0.6 kg of surfactant "Demol SNB" produced by Kao Corporation and 0.15 kg of a defoaming agent ("Surfinol 104E", trade name, produced by Nisshin Kagaku K. K.) were mixed with distilled water to make a total solution amount of 60 kg. The mixed solution was dispersed using zirconia beads of 0.5 mm in a horizontal sand mill ("UVM-2", manufactured by AIMEX K. K.).

The dispersion was measured on the spectral absorption and dispersed until the absorbance ratio (D650/D750) of the absorbance at 650 nm in the spectral absorption of the dispersion to the absorbance at 750 nm became 5.0 or more. The obtained dispersion was diluted with distilled water to have a cyanine dye concentration of 6 wt %, filtered (through a filter having an average pore size of 1 μm) to remove dusts, and used in practice.

(Preparation of Coating Solution for Antihalation Layer)

Gelatin (30 g), 24.5 g of polyacrylamide, 2.2 g of 1 mol/L caustic soda, 2.4 g of monodisperse polymethyl methacrylate fine particles (average particle size: 8 μm, standard deviation of particle size: 0.4), 0.08 g of benzoisothiazolinone, 35.9 g of the solid fine particle dispersion of dye prepared above, 74.2 g of Solid Fine Particle Dispersion (a) of Base Precursor obtained above, 0.6 g of sodium polyethylenesulfonate, 0.21 g of Blue Dye Compound 1, 0.15 g of Yellow Dye Compound 1 and 8.3 g of an acrylic acid/ethyl acrylate copolymer latex (copolymerization ratio: 5/95) were mixed. Thereto, water was added to make 818 ml in total, thereby preparing a coating solution for antihalation layer.

(Preparation of Coating Solution for Protective Layer on Back Surface)

In a container kept at 40° C., 40 g of gelatin, 1.5 g of liquid paraffin emulsion as liquid paraffin, 35 mg of benzoisothiazolinone, 6.8 g of 1 mol/L caustic soda, 0.5 g of sodium tert-octylphenoxyethoxyethanesulfonate, 0.27 g of sodium polystyrenesulfonate, 5.4 ml of a 2% aqueous solution of Fluorine-Containing Surfactant (SF-1), 6.0 g of an acrylic acid/ethyl acrylate copolymer (copolymerization weight ratio: 5/95) and 2.0 g of N,N-ethylenebis(vinylsulfonacetamide) were mixed. Thereto, water was added to make 1,000 ml, thereby preparing a coating solution for protective layer on the back surface.

(Preparation of Silver Halide Emulsion)

<Preparation of Silver Halide Emulsion 1>

A solution was prepared by adding 3.1 ml of a 1 wt % potassium bromide solution, 3.5 ml of sulfuric acid in a concentration of 0.5 mol/L and 31.7 g of phthalated gelatin to 1,421 ml of distilled water and while stirring the solution in a stainless steel-made reaction pot and thereby keeping the liquid temperature at 30° C., the entire amount of Solution A prepared by diluting 22.22 g of silver nitrate with distilled water to a volume of 95.4 ml and the entire amount of Solution B prepared by diluting 15.3 g of potassium bromide and 0.8 g of potassium iodide with distilled water to a volume of 97.4 ml were added at a constant flow rate over 45 seconds. Thereto, 10 ml of an aqueous 3.5 wt % hydrogen peroxide solution was added and then, 10.8 ml of a 10 wt % aqueous solution of benzimidazole was further added. Thereafter, the entire amount of Solution C prepared by diluting 51.86 g of silver nitrate with distilled water to a volume of 317.5 ml and the entire amount of Solution D obtained by diluting 44.2 g of potassium bromide and 2.2 g of potassium iodide with distilled water to a volume of 400 ml were added. Here, Solution C was added at a constant flow rate over 20 minutes and Solution D was added by the controlled double jet method while maintaining the pAg at 8.1. Ten minutes after the initiation of addition of Solution C and Solution D, the entire amount of potassium hexachloroiridate(III) was added to a concentration of $1\times10^{-4}$ mol per mol of silver. Furthermore, 5 seconds after the completion of addition of Solution C, the entire amount of an aqueous potassium hexacyanoferrate(II) solution was added to a concentration of $3\times10^{-4}$ mol per mol of silver. Then, the pH was adjusted to 3.8 using sulfuric acid in a concentration of 0.5 mol/L and after stirring was stopped, the resulting solution was subjected to precipitation/desalting/water washing. The pH was then adjusted to 5.9 using sodium hydroxide in a concentration of 1 mol/L, thereby preparing a silver halide dispersion at a pAg of 8.0.

While stirring the silver halide dispersion obtained above and thereby keeping it at 38° C., 5 ml of a methanol solution containing 0.34 wt % of 1,2-benzoisothiazolin-3-one was added and after 40 minutes, a methanol solution containing Spectral Sensitizing Dye A and Spectral Sensitizing Dye B at a molar ratio of 1:1 was added in an amount, as a total of Sensitizing Dye A and Sensitizing Dye B, of $1.2\times10^{-3}$ mol per mol of silver. After 1 minute, the temperature was elevated to 47° C. and 20 minutes after the elevation of temperature, a methanol solution of sodium benzenethiosulfonate was added in an amount of $7.6\times10^{-5}$ mol per mol of silver. After 5 minutes, a methanol solution of Tellurium Sensitizer C was further added in an amount of $2.9\times10^{-4}$ mol per mol of silver and then, the solution was ripened for 91 minutes. Thereto, 1.3 ml of a 0.8 wt % methanol solution of N,N'-dihydroxy-N"-diethylmelamine was added and after 4 minutes, a methanol solution of 5-methyl-2-mercaptobenzimidazole and a methanol solution of 1-phenyl-2-heptyl-5-mercapto-1,3,4-triazole were added in an amount of $4.8\times10^{-3}$ mol and $5.4\times10^{-3}$ mol, respectively, per mol of silver to prepare Silver Halide Emulsion 1.

The grains in the thus-prepared silver halide emulsion were silver iodobromide grains having an average equivalent-sphere diameter of 0.042 μm and a coefficient of variation in the equivalent-sphere diameter of 20% and uniformly containing 3.5 mol % of iodide. The grain size and the like were determined as an average of 1,000 grains using an electron microscope. The percentage of {100} faces in this grain was 80% as determined using the Kubelka-Munk equation.

<Preparation of Silver Halide Emulsion 2>

Silver Halide Emulsion 2 was prepared in the same manner as in the preparation of Silver Halide Emulsion 1 except that the liquid temperature at the grain formation was changed from 30° C. to 47° C., Solution B was obtained by diluting 15.9 g of potassium bromide with distilled water to a volume of 97.4 ml, Solution D was obtained by diluting 45.8 g of potassium bromide with distilled water to a volume of 400 ml, the addition time of Solution C was changed to 30 minutes and potassium hexacyanoferrate(II) was excluded. Also, precipitation/desalting/water washing/dispersion were performed in the same manner as in the preparation of Silver Halide Emulsion 1. Thereafter, spectral sensitization, chemical sensitization and addition of 5-methyl-2-mercaptobenzimidazole and 1-phenyl-2-heptyl-5-mercapto-1,3,4-triazole were performed in the same manner as in the preparation of Emulsion 1 except that the amount added of the methanol solution containing Spectral Sensitizing Dye A and Spectral Sensitizing Dye B at a molar ratio of 1:1 was changed, as a total of Sensitizing Dye A and Sensitizing Dye B, to $7.5\times10^{-4}$ mol per mol of silver, the amount of Tellurium Sensitizer C added was changed to $1.1\times10^{-4}$ mol per mol of silver, and the amount of 1-phenyl-2-heptyl-5-mercapto-1,3,4-triazole added was changed to $3.3\times10^{-3}$ mol per mol of silver. Thus, Silver Halide Emulsion 2 was obtained. The emulsion grains of Silver Halide Emulsion 2 were pure silver bromide cubic grains having an average equivalent-sphere diameter of 0.080 μm and a coefficient of variation in the equivalent-sphere diameter of 20%.

<Preparation of Silver Halide Emulsion 3>

Silver Halide Emulsion 3 was prepared in the same manner as in the preparation of Silver Halide Emulsion 1 except that the liquid temperature at the grain formation was changed from 30° C. to 27° C. Also, precipitation/desalting/water washing/dispersion were performed in the same manner as in the preparation of Silver Halide Emulsion 1. Thereafter, Silver Halide Emulsion 3 was obtained in the same manner as Emulsion 1 except that a solid dispersion (aqueous gelatin solution) containing Spectral Sensitizing Dye A and Spectral Sensitizing Dye B at a molar ratio of 1:1 was added in an amount, as a total of Sensitizing Dye A and Sensitizing Dye B, of $6\times10^{-3}$ mol per mol of silver, the amount of Tellurium Sensitizer C added was changed to $5.2\times10^{-4}$ mol per mol of silver, and 3 minutes after the addition of tellurium sensitizer, bromoauric acid and potassium thiocyanate were added in amounts of $5\times10^{-4}$ mol and $2\times10^{-3}$ mol, respectively, per mol of silver. The emulsion grains of Silver Halide Emulsion 3 were silver iodobromide grains having an average equivalent-sphere diameter of 0.034 μm and a coefficient of variation in the equivalent-sphere diameter of 20% and uniformly containing 3.5 mol % of iodide.

(Preparation of Fatty Acid Silver Salt Dispersion B)

<Preparation of Recrystallized Behenic Acid>

Behenic acid (100 kg, "Edenor C22-85R", trade name, produced by Henkel Co.) was mixed with 1,200 kg of isopropyl alcohol, dissolved at 50° C., filtered through a filter of 10 μm and then cooled to 30° C., thereby performing the recrystallization. At the recrystallization, the cooling speed was controlled to 3° C./hour. The crystals obtained were separated by centrifugal filtration, washed by splashing with 100 kg of isopropyl alcohol and then dried. The resulting crystals were esterified and measured by GC-FID, as a result, the silver behenate content was 96% and other than silver behenate, 2% of lignoceric acid and 2% of arachidinic acid were contained.

<Preparation of Fatty Acid Silver Salt Dispersion B>

The recrystallized behenic acid (88 kg), 422 L of distilled water, 49.2 L of an aqueous NaOH solution in a concentration of 5 mol/L, and 120 L of tert-butyl alcohol were mixed. The mixture was reacted by stirring at 75° C. for one hour to obtain Sodium Behenate Solution B. Separately, 206.2 L (pH 4.0) of an aqueous solution containing 40.4 kg of silver nitrate was prepared and kept at 10° C. A reactor containing 635 L of distilled water and 30 L of tert-butyl alcohol was kept at 30° C. and while thoroughly stirring, the entire amount of Sodium Behenate Solution B obtained above and the entire amount of the aqueous silver nitrate solution prepared above were added at constant flow rates over the period of 93 minutes and 15 seconds and the period of 90 minutes, respectively. At this time, only the aqueous silver nitrate solution was added for the period of 11 minutes after the initiation of addition of the aqueous silver nitrate solution, then addition of Sodium Behenate Solution B was started, and only Sodium Behenate Solution B was added for the period of 14 minutes and 15 second after the completion of addition of the aqueous silver nitrate solution. During the addition, the temperature inside the reactor was kept at 30° C. and the outer temperature was controlled to make constant the liquid temperature. The piping in the system of adding Sodium Behenate Solution B was kept warm by circulating hot water in the outer side of a double pipe, whereby the outlet liquid temperature at the distal end of the addition nozzle was adjusted to 75° C. The piping in the system of adding the aqueous silver nitrate solution was kept warm by circulating cold water in the outer side of a double pipe. The addition site of Sodium Behenate Solution B and the addition site of aqueous silver nitrate solution were symmetrically arranged centered around the stirring axis. Also, these addition sites were each adjusted to a height of not causing contact with the reaction solution.

After the completion of addition of Sodium Behenate Solution B, the mixture was left at that temperature for 20 minutes with stirring. The temperature was then elevated to 35° C. over 30 minutes and the solution was ripened for 210 minutes. Immediately after the completion of ripening, the solid content was separated by centrifugal filtration and washed with water until the conductivity of filtrate became 30 μS/cm. In this manner, a fatty acid silver salt was obtained. The solid content obtained was not dried but stored as a wet cake.

The shape of the thus-obtained silver behenate grains was analyzed by electron microphotography. The grains were crystals having average sizes of a=0.21 μm, b=0.4 μm and c=0.4 μm, an average aspect ratio of 2.1, an average equivalent-sphere diameter of 0.51 μm and a coefficient of variation in the equivalent-sphere diameter of 11% (a, b and c comply with the definition in this specification).

To the wet cake corresponding to 260 Kg as a dry solid content, 19.3 Kg of polyvinyl alcohol ("PVA-217", trade name) and water were added to make a total amount of 1,000 Kg. The resulting mixture was made into a slurry by a dissolver blade and the slurry was preliminarily dispersed by a pipeline mixer ("Model PM-10", manufactured by Mizuho Kogyo).

Then, the preliminarily dispersed stock solution was treated three times in a dispersing machine ("Microfluidizer M-610", trade name, manufactured by Microfluidex International Corporation, using a Z-type interaction chamber) under the control of pressure to 1,150 kg/cm$^2$ to obtain a silver behenate dispersion. At the dispersion, the temperature was set to 18° C. by a cooling operation of controlling the temperature of coolant using coiled heat exchangers attached to the inlet side and outlet side of the interaction chamber.

(Preparation of Reducing Agent Dispersion)

<Preparation of Reducing Agent 2 Dispersion>

To 10 kg of Reducing Agent 2 (6,6'-di-tert-butyl-4,4'-dimethyl-2,2'-butylidenediphenol) and 16 Kg of a 10 wt % aqueous solution of modified polyvinyl alcohol ("Poval MP203", produced by Kuraray Co., Ltd.), 10 Kg of water was added and thoroughly mixed to form a slurry. This slurry was transferred by a diaphragm pump and dispersed in a horizontal sand mill ("UVM-2", manufactured by AIMEX K. K.) filled with zirconia beads having an average diameter of 0.5 mm for 3 hours and 30 minutes. Thereafter, 0.2 g of benzoisothiazolinone sodium salt and water were added to adjust the reducing agent concentration to 25 wt %, thereby obtaining Reducing Agent 2 Dispersion. The reducing agent particles contained in the thus-obtained reducing agent dispersion had a median diameter of 0.40 μm and a maximum particle size of 1.5 μm or less. The obtained reducing agent dispersion was filtered through a polypropylene-made filter having a pore size of 3.0 μm to remove foreign matters such as dust and then housed.

<Preparation of Hydrogen Bond-Forming Compound 1 Dispersion>

To 10 Kg of Hydrogen Bond-Forming Compound 1 (tri(4-tert-butylphenyl)phosphine oxide) and 16 Kg of a 10 wt % aqueous solution of modified polyvinyl alcohol ("Poval MP203", produced by Kuraray Co., Ltd.), 10 Kg of water was added and thoroughly mixed to form a slurry. The resulting slurry was transferred by a diaphragm pump and dispersed in a horizontal sand mill ("UVM-2", manufactured by AIMEX K. K.) filled with zirconia beads having an average diameter of 0.5 mm for 3 hours and 30 minutes. Thereafter, 0.2 g of benzoisothiazolinone sodium salt and water were added to adjust the hydrogen bond-forming compound concentration to 25 wt %, thereby obtaining Hydrogen Bond-Forming Compound 1 Dispersion. The hydrogen bond-forming compound particles contained in the thus-obtained hydrogen bond-forming compound dispersion had a median diameter of 0.35 μm and a maximum particle size of 1.5 μm or less. The obtained hydrogen bond-forming compound dispersion was filtered through a polypropylene-made filter having a pore size of 3.0 μm to remove foreign matters such as dust and then housed.

<Preparation of Development Accelerator 4 Dispersion>

To 10 Kg of Development Accelerator 4 and 20 Kg of a 10 wt % aqueous solution of modified polyvinyl alcohol ("Poval MP203", produced by Kuraray Co., Ltd.), 10 Kg of water was added and thoroughly mixed to form a slurry. The resulting slurry was transferred by a diaphragm pump and dispersed in a horizontal sand mill ("UVM-2", manufactured by AIMEX K. K.) filled with zirconia beads having an average diameter of 0.5 mm for 3 hours and 30 minutes. Thereafter, 0.2 g of benzoisothiazolinone sodium salt and water were added to adjust the development accelerator concentration to 20 wt %, thereby obtaining Development Accelerator 1 Dispersion. The development accelerator particles contained in the thus-obtained development accelerator dispersion had a median diameter of 0.48 μm and a maximum particle size of 1.4 μm or less. The obtained development accelerator dispersion was filtered through a polypropylene-made filter having a pore size of 3.0 μm to remove foreign matters such as dust and then housed.

(Preparation of Polyhalogen Compound)

<Preparation of Organic Polyhalogen Compound 1 Dispersion>

To 10 Kg of Organic Polyhalogen Compound 1 (tribromomethanesulfonylbenzene), 10 Kg of a 20 wt % aqueous solution of modified polyvinyl alcohol ("Poval MP203", produced by Kuraray Co., Ltd.) and 0.4 Kg of a 20 wt % aqueous solution of sodium triisopropylnaphthalenesulfonate, 14 Kg of water was added and thoroughly mixed to form a slurry. The resulting slurry was transferred by a diaphragm pump and dispersed in a horizontal sand mill ("UVM-2", manufactured by AIMEX K. K.) filled with zirconia beads having an average diameter of 0.5 mm for 5 hours. Thereafter, 0.2 g of benzoisothiazolinone sodium salt and water were added to adjust the organic polyhalogen compound concentration to 26 wt %, thereby obtaining Organic Polyhalogen Compound 1 Dispersion. The organic polyhalogen compound particles contained in the thus-obtained organic polyhalogen compound dispersion had a median diameter of 0.41 μm and a maximum particle size of 2.0 μm or less. The obtained organic polyhalogen compound dispersion was filtered through a polypropylene-made filter having a pore size of 10.0 μm to remove foreign matters such as dust and then housed.

<Preparation of Organic Polyhalogen Compound 2 Dispersion>

To 10 Kg of Organic Polyhalogen Compound 2 (N-butyl-3-tribromomethanesulfonylbenzamide) and 20 Kg of a 10 wt % aqueous solution of modified polyvinyl alcohol ("Poval MP203", produced by Kuraray Co., Ltd.), 0.4 Kg of a 20 wt % aqueous solution of sodium triisopropylnaphthalenesulfonate was added and thoroughly mixed to form a slurry. The resulting slurry was transferred by a diaphragm pump and dispersed in a horizontal sand mill ("UVM-2", manufactured by AIMEX K. K.) filled with zirconia beads having an average diameter of 0.5 mm for 5 hours. Thereafter, 0.2 g of benzoisothiazolinone sodium salt and water were added to adjust the organic polyhalogen compound concentration to 30 wt %. This dispersion solution was heated at 40° C. for 5 hours, whereby Organic Polyhalogen Compound 2 Dispersion was obtained. The organic polyhalogen compound particles contained in the thus-obtained polyhalogen compound dispersion had a median diameter of 0.40 μm and a maximum particle size of 1.3 μm or less. The obtained organic polyhalogen compound dispersion was filtered through a polypropylene-made filter having a pore size of 3.0 μm to remove foreign matters such as dust and then housed.

<Preparation of Phthalazine Compound 1 Solution>

In 174.57 Kg of water, 8 Kg of modified polyvinyl alcohol "MP203" produced by Kuraray Co., Ltd. was dissolved. Thereto, 3.15 Kg of a 20 wt % aqueous solution of sodium triisopropylnaphthalenesulfonate and 14.28 Kg of a 70 wt % aqueous solution of Phthalazine Compound 1 (6-isopropylphthalazine) were added to prepare a 5 wt % solution of Phthalazine Compound 1.

<Preparation of Aqueous Mercapto Compound 2 Solution>

In 980 g of water, 20 g of Mercapto Compound 2 (1-(3-methylureido)-5-mercaptotetrazole sodium salt) was dissolved to prepare a 2.0 wt % aqueous solution.

<Preparation of Pigment 1 Dispersion>

To 64 g of C.I. Pigment Blue 60 and 6.4 g of "Demol N" (produced by Kao Corporation), 250 g of water was added and thoroughly mixed to form a slurry. The resulting slurry and 800 g of zirconia beads having an average diameter of 0.5 mm were put together into a vessel and dispersed for 25 hours in a dispersing machine (¼G Sand Grinder Mill, manufactured by AIMEX K. K.) to obtain Pigment 1 Dispersion. The pigment particles contained in the thus-obtained pigment dispersion had an average particle size of 0.21 μm.

<Preparation of SBR Latex Solution>

An SBR latex having a Tg of 22° C. was prepared as follows.

Using ammonium persulfate as a polymerization initiator and an anionic surfactant as an emulsifier, 70.0 mass of styrene, 27.0 mass of butadiene and 3.0 mass of acrylic acid were emulsion-polymerized. After aging at 80° C. for 8 hours, the resulting solution was cooled to 40° C. and adjusted to a pH of 7.0 with aqueous ammonia. Thereto, "SANDET BL" (produced by Sanyo Kasei K. K.) was added to have a concentration of 0.22%. Thereafter, the pH was adjusted to 8.3 by adding an aqueous 5% sodium hydroxide solution and then, the pH was adjusted to 8.4 with aqueous ammonia. The molar ratio of $Na^+$ ion and $NH_4^+$ ion used here was 1:2.3. To 1 Kg of this solution, 0.15 ml of a 7% aqueous solution of benzoisothiazolinone sodium salt was added to prepare an SBR latex solution.

(SBR Latex: Latex of -St(70.0)-Bu(27.0)-AA(3.0)-):

Tg: 22° C.

Average particle size: 0.1 μm, concentration: 43 wt %, equilibrium moisture content at 25° C. and 60% RH: 0.6 wt %, ion conductivity: 4.2 mS/cm (in the measurement of ion conductivity, the latex stock solution (43 wt %) was measured at 25° C. using a conductivity meter "CM-30S" (manufactured by Toa Denpa Kogyo K. K.)), pH: 8.4.

SBR latexes different in the Tg can be prepared in the same manner by appropriately changing the ratio of styrene and butadiene.

<Preparation of Coating Solution 3 for Emulsion Layer (Photosensitive Layer)>

Fatty Acid Silver Salt Dispersion B prepared above (1,000 g), 276 ml of water, 33.2 g of Pigment 1 Dispersion, 32 g of Organic Polyhalogen Compound 1 Dispersion, 46 g of Organic Polyhalogen Compound 2 Dispersion, 173 g of Phthalazine Compound 1 Solution, 1,082 g of SBR latex (Tg: 20° C.) solution, 153 g of Reducing Agent 2 Dispersion, 55 g of Hydrogen Bond-Forming Compound 1 Dispersion, 4.8 g of Development Accelerator 1 Dispersion, 5.2 g of Development Accelerator 2 Dispersion, 2.1 g of Color Tone Adjuster 1 Dispersion and 8 ml of Aqueous Mercapto Compound 2 Solution were sequentially added. Immediately before the coating, 140 g of Silver Halide Mixed Emulsion A was added and thoroughly mixed. The resulting coating solution for emulsion layer was transferred as it was to a coating die and coated.

The viscosity of the coating solution for emulsion layer obtained above was measured by a Brookfield viscometer manufactured by Tokyo Keiki Kogyo K. K. and found to be 25 [mPa·s] at 40° C. (No. 1 rotor, 60 rpm).

The viscosity of the coating solution measured at 25° C. using "RFS Field Spectrometer" (manufactured by Rheometrics Far East K. K.) was 530, 144, 96, 51 and 28 [mPa·s] at a shear rate of 0.1, 1, 10, 100 and 1,000 [1/sec], respectively.

The amount of zirconium in the coating solution was 0.25 mg per g of silver.

<Preparation of Coating Solution for Interlayer on Emulsion Surface>

A 5 wt % aqueous solution (27 ml) of "Aerosol OT" (produced by American Cyanamide), 135 ml of a 20 wt % aqueous solution of diammonium phthalate and water for making a total amount of 10,000 g were added to 1,000 g of polyvinyl alcohol "PVA-205" (produced by Kuraray Co., Ltd.), 272 g of a 5 wt % pigment dispersion and 4,200 ml of a 19 wt % solution of methyl methacrylate/styrene/butyl acrylate/hydroxyethyl methacrylate/acrylic acid copolymer (copolymerization weight ratio: 64/9/20/5/2) latex. The pH was adjusted to 7.5 with NaOH to prepare a coating solution for interlayer and then the coating solution for interlayer was transferred to a coating die to give a coverage of 9.1 ml/$m^2$.

The viscosity of the coating solution was measured at 40° C. by a Brookfield viscometer (No. 1 rotor, 60 rpm) and found to be 58 [mPa·s].

<Preparation of Coating Solution for First Protective Layer on Emulsion Surface>

In water, 64 g of inert gelatin was dissolved. Thereto, 80 g of a 27.5 wt % solution of methyl methacrylate/styrene/butyl acrylate/hydroxyethyl methacrylate/acrylic acid copolymer (copolymerization weight ratio: 64/9/20/5/2) latex, 23 ml of a 10 wt % methanol solution of phthalic acid, 23 ml of a 10 wt % aqueous solution of 4-methylphthalic acid, 28 ml of sulfuric acid in a concentration of 0.5 mol/L, 5 ml of a 5 wt % aqueous solution of "Aerosol OT" (produced by American Cyanamide), 0.5 g of phenoxyethanol, 0.1 g of benzoisothiazolinone and water for making a total amount of 750 g were added to prepare a coating solution. Immediately before the coating, 26 ml of a 4 wt % chrome alum was mixed using a static mixer. Then, the coating solution was transferred to a coating die to give a coverage of 18.6 ml/$m^2$.

The viscosity of the coating solution was measured by a Brookfield viscometer at 40° C. (No. 1 rotor, 60 rpm) and found to be 20 [mPa·s].

<Preparation of Coating Solution for Second Protective Layer on Emulsion Surface>

In water, 80 g of inert gelatin was dissolved. Thereto, 102 g of a 27.5 wt % solution of methyl methacrylate/styrene/butyl acrylate/hydroxyethyl methacrylate/acrylic acid copolymer (copolymerization weight ratio: 64/9/20/5/2) latex, 5.4 ml of a 2 wt % aqueous solution of Fluorine-Containing Surfactant (SF-1), 5.4 ml of a 2 wt % aqueous solution of Fluorine-Containing Surfactant (SF-2), 23 ml of a 5 wt % solution of "Aerosol OT" (produced by American Cyanamide), 4 g of polymethyl methacrylate fine particles (average particle size: 0.7 μm), 21 g of polymethyl methacrylate fine particles (average particle size: 4.5 μm), 1.6 g of 4-methylphthalic acid, 4.8 g of phthalic acid, 44 ml of sulfuric acid in a concentration of 0.5 mol/L, 10 mg of benzoisothiazolinone and water for making a total amount of 650 g were added. Immediately before the coating, 445 ml of an aqueous solution containing 4 wt % of chrome alum and 0.67 wt % of phthalic acid was mixed using a static mixer to obtain a coating solution for surface protective layer and then the coating solution for surface protective layer was transferred to a coating die to give a coverage of 8.3 ml/$m^2$.

The viscosity of the coating solution was measured at 40° C. by a Brookfield viscometer (No. 1 rotor, 60 rpm) and found to be 19 [mPa·s].

<Preparation of Heat-Developable Photosensitive Material 3>

In the back surface side of the undercoated support prepared above, the coating solution for antihalation layer and the coating solution for back surface protective layer were simultaneously coated one on another to give a gelatin coated amount of 0.44 g/$m^2$ and 1.7 g/$m^2$, respectively. Then, the coating was dried to form a back layer.

On the surface opposite the back surface, an emulsion layer, an interlayer, a first protective layer and a second protective layer were simultaneously coated one on another in this order from the undercoated surface by the slide bead coating method to prepare a heat-developable photosensitive material sample. At this time, the temperature was adjusted such that the emulsion layer and the interlayer were 31° C., the first protective layer was 36° C. and the second protective layer was 37° C.

The coated amount (g/$m^2$) of each compound in the emulsion layer is shown below.

| | |
|---|---|
| Silver behenate | 5.27 |
| Pigment (C.I. Pigment Blue 60) | 0.036 |
| Polyhalogen Compound 1 | 0.17 |
| Polyhalogen Compound 2 | 0.28 |
| Phthalazine Compound 1 | 0.18 |
| SBR Latex | 9.43 |
| Reducing Agent 2 | 0.77 |
| Hydrogen Bond-Forming Compound 1 | 0.28 |
| Development Accelerator 1 | 0.019 |
| Development Accelerator 4 | 0.020 |
| Color Tone Adjustor 1 | 0.008 |
| Mercapto Compound 2 | 0.003 |
| Silver Halide (as Ag) | 0.091 |

The coating and drying conditions were as follows.

The coating was performed at a speed of 160 m/min, the distance between the tip of coating die and the support was set to from 0.10 to 0.30 mm, and the pressure in the vacuum chamber was set lower by 196 to 882 Pa than the atmospheric pressure. The support was destaticized by ionized wind before the coating.

In the subsequent chilling zone, the coating solution was cooled with air showing a dry bulb temperature of 10 to 20° C. The sample was then subjected to contact-free transportation and in a helical floating-type dryer, dried with drying air showing a dry bulb temperature of 23 to 45° C. and a wet bulb temperature of 15 to 21° C.

After drying, the humidity was adjusted to 40 to 60% RH at 25° C. and then, the layer surface was heated to 70 to 90° C. The heated layer surface was then cooled to 25° C.

The heat-developable photosensitive material thus prepared had a matting degree of, in terms of the Beck's smoothness, 550 seconds on the photosensitive layer surface and 130 seconds on the back surface. Furthermore, the pH on the layer surface in the photosensitive layer side was measured and found to be 6.0.

Chemical structures of the compounds used in Examples of the present invention are shown below.

SF-1: $C_8F_{17}CH_2CH_2SO_3Na$

SF-2: $C_8F_{17}CH_2CH_2SCH_2CH_2COONa$

Development Accelerator 4:

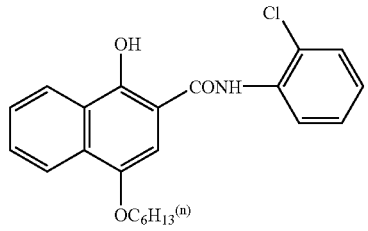

Samples 101 to 116 were prepared in the same manner as Heat-Developable Photosensitive Material 3 except that Fluorine Compounds SF-1 and SF-2 were changed as shown in Table 3.

(Evaluation of Photographic Performance)

The samples obtained each was cut into a size of 356×432 mm, wrapped with the following packaging material in the environment of 25° C. and 50%, stored at an ordinary temperature for 2 weeks and then evaluated on the items shown below.

(Packaging material)

Polyethylene (50 μm) containing 10 μm of PET/12 μm of PE/9 μm of aluminum foil/15 μm of Ny/3% of carbon:

oxygen permeability: 0 ml/atm·$m^2$·25° C.·day water permeability: 0 g/atm·$m^2$·25° C.·day The samples each was exposed and heat-developed (with four sheets of panel heater set at 112° C.-119° C.-121° C.-121° C., for 24 seconds in total in the case of Heat-Developable Photosensitive Material 3) in "Fuji Medical Dry Laser Imager FM-DP L" (in which a semiconductor laser of 660 nm having a maximum output of 60 mW (IIIB) was mounted). The obtained image was evaluated by a densitometer.

It was confirmed that in any sample, excellent image density and good gradation as a heat-developable photosensitive material could be obtained.

(Evaluation of Coated Surface State and Fingerprint Staining)

The samples each was subjected to uniform exposure of giving a density of 1.5 and to a treatment in the above-described heat-developing machine. These samples were evaluated on the coated surface state and the fingerprint staining in the same manner as in Example 2. The results are shown in Table 3.

TABLE 3

| Sample | Fluorine Compound | Coating Streak | Coating Unevenness | Staining of Photo-sensitive Material | Remarks |
|---|---|---|---|---|---|
| 101 | SF-1/SF-2 | 7 | Δ | Δ | Comparison |
| 102 | SF-1 | 12 | X | Δ | Comparison |
| 103 | SF-2 | 9 | X | Δ | Comparison |
| 104 | FS-41 | 2 | ◎ | ○ | Invention |

TABLE 3-continued

| Sample | Fluorine Compound | Coating Streak | Coating Unevenness | Staining of Photo-sensitive Material | Remarks |
|---|---|---|---|---|---|
| 105 | FS-42 | 4 | ○ | ○ | Invention |
| 106 | FS-45 | 3 | ○ | ○ | Invention |
| 107 | FS-103 | 2 | ◎ | ○ | Invention |
| 108 | FS-87 | 1 | ◎ | ◎ | Invention |
| 109 | FS-91 | 1 | ◎ | ◎ | Invention |
| 110 | FS-92 | 3 | ○ | ◎ | Invention |
| 111 | FS-93 | 3 | ○ | ◎ | Invention |
| 112 | FS-94 | 4 | ○ | ◎ | Invention |
| 113 | FS-95 | 3 | ○ | ◎ | Invention |
| 114 | FS-96 | 2 | ◎ | ◎ | Invention |
| 115 | FR-1 | 7 | Δ | Δ | Comparison |
| 116 | FR-2 | 6 | Δ | Δ | Comparison |

It is apparent from Table 3 that by using the fluorine compound of the present invention, the coated surface state and the fingerprint staining are improved.

EXAMPLE 4

Heat-Developable Photosensitive Material 4 was prepared in the same manner as Heat-Developable Photosensitive Material 3 of Example 3 except that in the preparation of Heat-Developable Photosensitive Material 3, Development Accelerator 4 and Color Toner Adjuster 1 were excluded and the coated amount of the hydrogen bond-forming compound was changed to 2 times. Samples 210 to 216 were prepared by replacing the fluorine compound of Heat-Developable Photosensitive Material 4 in the same manner as in Example 3. These samples were evaluated in the same manner as in Example 3 except that the heat-development time was 24 seconds in total with four sheets of panel heater set to 112° C.-119° C.-121° C.-121° C. Also in this case, it was confirmed that by using the fluorine compound of the present invention, the coated surface state and the fingerprint staining could be improved similarly to Example 3.

According to the present invention, the coating solutions for a heat-developable photosensitive material are improved in the coatability, so that a heat-developable photosensitive material suppressed from the generation of streaks or unevenness and reduced in the staining caused on touching by a hand wetted with sweat or oil can be provided.

While the invention has been described in detail and with reference to specific embodiments thereof, it will be apparent to one skilled in the art that various changes and modifications can be made therein without departing from the spirit and scope thereof.

What is claimed is:

1. A photothermographic material comprising:

a support;

a photosensitive silver halide in an amount of 0.05 to 0.3 $g/m^2$, in terms of coated silver per $m^2$ of the photo sensitive material;

a non-photosensitive organic silver salt in an amount of 0.5 to 2.0 $g/m^2$;

a heat developer;

a binder; and a fluorine compound present in an emulsion surface protective layer and a back surface protective layer, wherein said fluorine compound is a compound represented by the following formula (B):

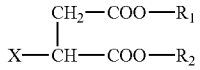

(B)

wherein $R_1$ and $R_2$ independently are represented by the formula -La-Raf-W, wherein La represents a substituted or unsubstituted alkylene group, a substituted or unsubstituted alkyleneoxy group or a divalent group formed by combining these groups, Raf represents a perfluoroalkylene group having from 1 to 5 carbon atoms and W represents a hydrogen atom, a fluorine atom or an alkyl group;

X represents $-L_b-SO_3M_0$, wherein $M_0$ represents a hydrogen atom or a cation, and $L_b$ represents a methylene group.

2. The photothermegraphie material as claimed in claim 1, wherein said heat developer is represented by the following formula (R):

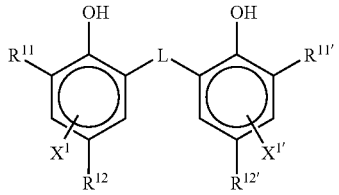

(R)

wherein $R^{11}$ and $R^{11'}$ each independently represents an alkylene group having from 1 to 20 carbon atoms, $R^{12}$ and $R^{12'}$ each independently represents a hydrogen atom or substituent capable of substituting to the benzene ring, L represents a —S— group or a —$CHR^{13}$ — group, $R^{13}$ represents a hydrogen atom or an alkyl group having from 1 to 20 carbon atoms, and $X^1$ and $X^{1'}$ each independently represents a hydrogen atom or a group capable of substituting to the benzene ring.

3. The photothermographic material as claimed in claim 1, which comprises: an image-forming layer on the support; and a compound represented by the following formula (D) in the same surface side as the image-forming layer on the support:

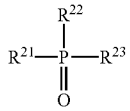

(D)

wherein $R^{21}$ to $R^{23}$ each independently represents an alkyl group, an aryl group, an alkoxy group, an aryloxy group, an amino group or a heterocyclic group, and these groups each may he unsubstituted or may have a substituent.

4. The photothermographic material as claimed in claim 1, which comprises: an image-forming layer on the support; and a compound represented by the following formula (H) in the same surface side as the image-forming layer on the support:

$$Q\text{-}(Y)_n\text{—}C(Z_1)\ (Z_2)X \quad \text{(H)}$$

wherein Q represents an alkyl group, an aryl group or a heterocyclic group, Y represents a divalent linking group, n represents 0 or 1, $Z_1$ and $Z_2$ each represents a halogen group, and X represents a hydrogen atom or an electron-withdrawing group.

5. The photothermographic material as claimed in claim 2, which comprises a development accelerator having an effect of accelerating development on said heat developer represented by formula (R).

6. The photothermographic material as claimed in claim 5, wherein said development accelerator is a hydrazine compound.

* * * * *